US008305134B2

(12) United States Patent
Hirose et al.

(10) Patent No.: US 8,305,134 B2
(45) Date of Patent: Nov. 6, 2012

(54) REFERENCE CURRENT SOURCE CIRCUIT PROVIDED WITH PLURAL POWER SOURCE CIRCUITS HAVING TEMPERATURE CHARACTERISTICS

(75) Inventors: Tetsuya Hirose, Kobe (JP); Toyoaki Kito, Kobe (JP); Yuji Osaki, Kobe (JP)

(73) Assignee: Semiconductor Technology Academic Research Center, Kanagawa (JP)

( * ) Notice: Subject to any disclaimer, the term of this patent is extended or adjusted under 35 U.S.C. 154(b) by 234 days.

(21) Appl. No.: 12/713,362

(22) Filed: Feb. 26, 2010

(65) Prior Publication Data

US 2010/0225384 A1 Sep. 9, 2010

(30) Foreign Application Priority Data

Mar. 2, 2009 (JP) ..... 2009-048379
Feb. 25, 2010 (JP) ..... 2010-040627

(51) Int. Cl.
*G05F 1/10* (2006.01)

(52) U.S. Cl. ..... 327/538; 327/513

(58) Field of Classification Search ..... 327/512, 327/513, 535, 537, 538, 539, 540, 543
See application file for complete search history.

(56) References Cited

U.S. PATENT DOCUMENTS 6,987,416 B2 * 1/2006 Ker et al. ..... 327/539
7,224,210 B2 * 5/2007 Garlapati et al. ..... 327/539
2005/0264345 A1 12/2005 Ker et al.

FOREIGN PATENT DOCUMENTS

JP 11-231955 8/1999
JP 2001-344028 12/2001
JP 2005-301410 10/2005

OTHER PUBLICATIONS

R. Jacob Baker et al., "CMOS Circuit Design, Layout, and Simulation", IEEE Press Series on Microelectronic Systems, 2004.
H. J. Oguey et al., "CMOS Current Reference Without Resistance", IEEE Journal of Solid-State Circuits, vol. 32, No. 7, pp. 1132-1135, Jul. 1997.
T. Hirose et al., "Temperature-compensated CMOS current reference circuit for ultralow-power subthreshold LSIs", IEICE Electronics Express, vol. 5, No. 6, pp. 204-210, Jun. 2008.

(Continued)

*Primary Examiner* — Jeffrey Zweizig
(74) *Attorney, Agent, or Firm* — Wenderoth Lind & Ponack, L.L.P.

(57) ABSTRACT

A reference current source circuit outputs a constant reference current even if surrounding environments such as temperature and power source voltage change in a power source circuit that operates in a minute current region in an order of nanoamperes. The reference current source circuit includes an nMOS-configured power source circuit, a pMOS-configured power source circuit, and a current subtracter circuit. The nMOS-configured power source circuit includes a current generating nMOSFET, and generates a first current having temperature characteristics of an output current dependent on an electron mobility. The pMOS-configured power source circuit includes a current generating pMOSFET, and generates a second current having temperature characteristics of an output current dependent on a hole mobility. The current subtracter circuit generates a constant reference current by subtracting the second current from the first current.

8 Claims, 43 Drawing Sheets

OTHER PUBLICATIONS

K. Ueno et al., "A 0.3-μW, 7 ppm/° C. CMOS Voltage Reference Circuit for On-Chip Process Monitoring in Analog Circuits", Proceedings of the 34th European Solid-State Circuits Conference, pp. 398-401, Sep. 2008.

Kenichi Ueno et al., "Reference Voltage Source Circuit for Technique of Correcting Variation of Inter-chip Characteristics in CMOS Analog Circuit", VDEC Designer Forum 2008, P-09, Jun. 2008 (along with English translation).

Kazuma Yoshii et al., "Current Reference for Subthreshold LSIs", Journal of General Conference of the Institute of Electronics, Information and Communication Engineers (IEICE), Electronics, C-12-29, issued by IEICE, Mar. 2007 (along with English translation).

K. Ueno et al., "Current reference circuit for subthreshold CMOS LSIs", 2008 International Conference on Solid State Devices and Materials, Tsukuba, Japan, pp. 1000-1001, Sep. 2008.

* cited by examiner

*Fig.31*

| PARAMETER | SYMBOL | TYPICAL VALUE | DISTRIBUTION WIDTH |
|---|---|---|---|
| MOBILITY | $\mu_N$ | 475.8 ($cm^2/(V \cdot s)$) | ±16.50 |
| | $\mu_P$ | 148.2 ($cm^2/(V \cdot s)$) | ±13.50 |
| THICKNESS OF OXIDE FILM | $t_{ox}$ | 7.575 (nm) | ±0.500 |
| CHANNEL LENGTH | L | 0.35 ($\mu$m) | ±0.050 |
| CHANNEL WIDTH | W | 0.40 ($\mu$m) | ±0.075 |
| THRESHOLD VOLTAGE | $V_{THN}$ | 0.49 (V) | ±0.105 |
| | $V_{THP}$ | 0.69 (V) | ±0.100 |

*Fig.32*

| PARAMETER | SYMBOL | $A_P$ |
|---|---|---|
| THRESHOLD VOLTAGE | $V_{THN}$ | $0.67 \times 10^{-8}$ (V) |
| | $V_{THP}$ | $1.03 \times 10^{-8}$ (V) |
| MOBILITY | $\mu_N$ | $4.9 \times 10^{-9}$ ($cm^2/(V \cdot s)$) |
| | $\mu_P$ | $7.1 \times 10^{-9}$ ($cm^2/(V \cdot s)$) |

101N
OUTPUT CURRENT $I_n$ (nA)
125
100
75.0
50.0
25.0
0
25.0
50.0
75.0
TEMPERATURE (°C)

101P
OUTPUT CURRENT $I_p$ (nA)
125
100
75.0
50.0
25.0
0
25.0
50.0
75.0
TEMPERATURE (°C)

101
REFERENCE OUTPUT CURRENT $I_{ref}$ (nA)
125
100
75.0
50.0
25.0
0
25.0
50.0
75.0
TEMPERATURE (°C)

104N
OUTPUT CURRENT $I_n$ (nA)
80
70
60
50
40
30
20
10
0
25.0
50.0
75.0
TEMPERATURE (°C)

104P
OUTPUT CURRENT $I_p$ (nA)
80
70
60
50
40
30
20
10
0
25.0
50.0
75.0
TEMPERATURE (°C)

104
REFERENCE OUTPUT CURRENT $I_{ref}$ (nA)
80
70
60
50
40
30
20
10
0
25.0
50.0
75.0
TEMPERATURE (°C)

104
REFERENCE OUTPUT CURRENT $I_{ref}$ (nA)
80
70
60
50
40
30
20
10
0
25.0
50.0
75.0
TEMPERATURE (°C)

104P
OUTPUT CURRENT $I_p$ (nA)
80
70
60
50
40
30
20
10
0
25.0
50.0
75.0
TEMPERATURE (°C)

104N
OUTPUT CURRENT $I_n$ (nA)
80
70
60
50
40
30
20
10
0
25.0
50.0
75.0
TEMPERATURE (°C)

106N
OUTPUT CURRENT $I_n$ (nA)
80
70
60
50
40
30
20
10
0
25.0
50.0
75.0
TEMPERATURE (°C)

106P
OUTPUT CURRENT $I_p$ (nA)
80
70
60
50
40
30
20
10
0
25.0
50.0
75.0
TEMPERATURE (°C)

106
REFERENCE OUTPUT CURRENT $I_{ref}$ (nA)
80
70
60
50
40
30
20
10
0
25.0
50.0
75.0
TEMPERATURE (°C)

106
REFERENCE OUTPUT CURRENT $I_{ref}$ (nA)
80
70
60
50
40
30
20
10
0
25.0
50.0
75.0
TEMPERATURE (°C)

106P
OUTPUT CURRENT $I_p$ (nA)
80
70
60
50
40
30
20
10
0
25.0
50.0
75.0
TEMPERATURE (°C)

106N
OUTPUT CURRENT $I_n$ (nA)
80
70
60
50
40
30
20
10
0
25.0
50.0
75.0
TEMPERATURE (°C)

106
35.0
32.5
30.0
27.5
25.0
22.5
20.0
REFERENCE OUTPUT CURRENT $I_{ref}$ (nA)
0
25.0
50.0
75.0
TEMPERATURE (°C)

104
35.0
32.5
30.0
27.5
25.0
22.5
20.0
REFERENCE OUTPUT CURRENT $I_{ref}$ (nA)
0
25.0
50.0
75.0
TEMPERATURE (°C)

101
35.0
32.5
30.0
27.5
25.0
22.5
20.0
REFERENCE OUTPUT CURRENT $I_{ref}$ (nA)
0
25.0
50.0
75.0
TEMPERATURE (°C)

101
33.0
32.5
32.0
31.5
31.0
REFERENCE OUTPUT CURRENT $I_{ref}$ (nA)
0
25.0
50.0
75.0
TEMPERATURE (°C)

104
25.5
25.25
25.0
24.75
24.5
REFERENCE OUTPUT CURRENT $I_{ref}$ (nA)
0
25.0
50.0
75.0
TEMPERATURE (°C)

106
26.5
26.25
26.0
25.75
25.5
REFERENCE OUTPUT CURRENT $I_{ref}$ (nA)
0
25.0
50.0
75.0
TEMPERATURE (°C)

101

104

106
REFERENCE OUTPUT CURRENT $I_{ref}$ (nA)
60
50
40
30
20
10
TEMPERATURE (°C)
0
25.0
50.0
75.0

101
1.15
1.1
1.05
1.0
.95
.9
.85
.8
NORMALIZED REFERENCE OUTPUT CURRENT $I_N$ (nA)
0
25.0
50.0
75.0
TEMPERATURE (°C)

104
1.15
1.1
1.05
1.0
.95
.9
.85
.8
NORMALIZED REFERENCE OUTPUT CURRENT $I_N$ (nA)
0
25.0
50.0
75.0
TEMPERATURE (°C)

106
1.15
1.1
1.05
1.0
.95
.9
.85
.8
NORMALIZED REFERENCE OUTPUT CURRENT $I_N$ (nA)
0
25.0
50.0
75.0
TEMPERATURE (°C)

106

104

101
FREQUENCY No
150
125
100
75.0
50.0
25.0
0.0
OUTPUT CURRENT $I_0$($\times 10^{-9}$A)
10
20
30
40
50

*Fig.44*

| EVALUATION ITEM | | IMPLEMENTAL EXAMPLE 1 (101) | IMPLEMENTAL EXAMPLE 4 (104) | IMPLEMENTAL EXAMPLE 6 (106) | COMPARATIVE EXAMPLE (106N) |
|---|---|---|---|---|---|
| AVERAGE CURRENT $I_{ref}$ (nA) | | 31.8 | 25.2 | 26.2 | 60.8 |
| TEMPERATURE ERROR $\Delta I_{ref}$ (nA) (−20 TO 100°C) | | 0.588 | 0.218 | 0.196 | 6.6 |
| TEMPERATURE DEPENDENCE $\Delta I_{ref}/I_{ref}$ (%) (−20 TO 100°C) | | **1.8** | **0.87** | **0.75** | **10.85** |
| CONSUMPTION CURRENT ($\mu$A) OF ENTIRE CIRCUIT | | 0.75 | 0.49 | 0.67 | — |
| INFLUENCE (%) OF PROCESS VARIATION (DISPERSION/AVERAGE) | | **18.4** | **16.1** | **13.3** | — |
| (DETAILS) | AVERAGE (nA) | 32.2 | 25.2 | 26.4 | — |
| | DISPERSION (nA) | 5.94 | 4.06 | 3.52 | — |

REFERENCE CURRENT SOURCE CIRCUIT PROVIDED WITH PLURAL POWER SOURCE CIRCUITS HAVING TEMPERATURE CHARACTERISTICS

BACKGROUND OF THE INVENTION

1. Field of the Invention

The present invention relates to a reference current source circuit capable of outputting a constant current even if surrounding environments such as temperature and power source voltage change.

2. Description of the Related Art

Following rapid development of network environment, downscaling of information and communication devices and the like, we can expect realization of ubiquitous networking society in near future. In the ubiquitous networking society, we can obtain various pieces of necessary information from sensor devices buried in whatever locations around us. In order to realize such a society, it is essential to develop a smart sensor LSI sensing information surrounding us. Such a smart LSI should operate continuously over a long period of time with ultralow power consumption, so that it is necessary to acquire power from ambient energy or use a micro battery as a power source. In any case, it is necessary to make the smart sensor LSI operate by supply of quite limited power.

The power consumption of CMOS (Complementary Metal Oxide Semiconductor) LSI has been reduced by downscaling of elements and reduction of power source voltage following the downscaling so far. However, it is difficult to considerably reduce power consumption in a current circuit design on the premise that a metal-oxide-semiconductor field effect transistor (referred to as "MOSFET (Metal-Oxide-Semiconductor Field Effect Transistor)", hereinafter) operates in a strong inversion region. In the present specification and the like, a p channel MOSFET is referred to as "pMOSFET" or "pMOS", and an n channel MOSFET is referred to as "nMOSFET" or "nMOS".

Therefore, as a method of considerably reducing power consumption of such a circuit system, there is proposed making a circuit design on the premise that a MOSFET operates in a sub-threshold region. Since current when the MOSFET operates in the sub-threshold region is in an order of nanoamperes (nA), the power consumption of the circuit system can be held down to be equal to or smaller than power in an order of microwatts (μW). On assumption that a circuit is made to operate with a microenergy source such as a button battery, it is possible to construct a circuit system capable of continuously operating over a few years.

Prior art documents relating to the present invention are as follows.

Patent Document 1: Japanese Patent Laid-Open Publication No. JP 11-231955 A;

Patent Document 2: Japanese Patent Laid-Open Publication No. JP 2001-344028 A;

Patent Document 3: Japanese Patent Laid-Open Publication No. JP 2005-301410 A;

Non-Patent Document 1: R. Jacob Baker et al., "CMOS CIRCUIT DESIGN, LAYOUT, AND SIMULATION", IEEE Press Series on Microelectronic Systems, 2004.

Non-Patent Document 2: H. J. Oguey et al., "CMOS Current Reference Without Resistance", IEEE Journal of Solid-State Circuits, Vol. 32, No. 7, pp. 1132-1135, July 1997;

Non-Patent Document 3: T. Hirose et al., "Temperature-compensated CMOS current reference circuit for ultralow-power subthreshold LSIs", IEICE Electronics Express, Vol. 5, No. 6, pp. 204-210, June 2008;

Non-Patent Document 4: K. Ueno et al., "A 0.3-μW, 7 ppm/° C. CMOS voltage reference circuit for on-chip process monitoring in analog circuits", Proceedings of the 34th European Solid-State Circuits Conference, pp. 398-401, September 2008;

Non-Patent Document 5: Kenichi Ueno et al., "Reference Voltage Source Circuit for Technique of Correcting Variation of Inter-chip Characteristics in CMOS Analog Circuit", VDEC Designer Forum 2008, P-09, June 2008;

Non-Patent Document 6: Kazuma Yoshii et al., "Current Reference for Subthreshold LSIs", Journal of General Conference of the Institute of Electronics, Information and Communication Engineers (IEICE), Electronics, C-12-29, issued by IEICE, March 2007; and Non-Patent Document 7: K. Ueno et al., "Current reference circuit for subthreshold CMOS LSIs", 2008 International Conference on Solid State Devices and Materials, Tukuba, Japan, pp. 1000-1001, September 2008.

Although the circuit design on the premise that the MOSFET operates in the sub-threshold region can reduce power consumption, the characteristics of the MOSFET in such an operation region change sensitively to temperature change and process variations. Since the smart sensor LSI is predicted to be used in various environments, it is impossible to ignore such characteristic changes. In order to make such a circuit system operate stably, it is necessary to always supply constant current to the circuit system in every environment. First of all, to this end, it is necessary to construct a reference source circuit that stably operates despite changes in temperature and power source voltage.

The reference source circuit according to prior art will be first described. The carrier mobility and voltage-to-current characteristics of the MOSFET as well as a current mirror circuit that plays an important role in the current source circuit will be described below. In addition, operation principal of an existing reference current source circuit will be described.

The carrier mobility of the MOSFET will first be described. The MOSFET is a unipolar device that operates according to a kind of carriers (electrons for nMOS and holes for pMOS). The carriers in silicon move by drift that occurs in the presence of an electric field and diffusion that occurs due to a concentration gradient of electrons or holes. The drift current will be addressed herein. When an electric field is applied to a medium having free carriers and conductivity, the carriers are accelerated and obtain drift velocity superimposed on a thermal random motion. In a low electric field, a drift velocity Vd is proportional to field intensity $\epsilon$. A proportional coefficient is referred to as "mobility" and the drift velocity Vd and the field intensity $\epsilon$ hold the following relationship as represented by Equation (1):

$$v_d = \mu\epsilon \tag{1}$$

where mobility μ is inversely proportional to an effective mass of the carriers. Since electrons are smaller in mass than holes, the mobility of the electrons is larger than that of the holes. A carrier scattering mechanism includes phonon scattering (thermal oscillation), impurity scattering, inter-carrier clone scattering, and scattering by neutral impurity atoms. At high temperature, the phonon scattering dominantly occurs and the mobility μ (T) is represented by the following Equation (2):

$$\mu(T) = \mu(T_0)\left(\frac{T}{T_0}\right)^{-m}. \tag{2}$$

That is, the mobility μ(T) has properties of becoming smaller as temperature T is higher. In this case, $T_o$ denotes room temperature and m denotes a temperature coefficient of the mobility dependent on CMOS technology. The electron mobility differs from the hole mobility in a value of the temperature coefficient m. Accordingly, an nMOS using electrons as carries differs from a pMOS using holes as carriers in the temperature dependence.

FIG. 1 is a graph showing characteristics of a gate-source voltage $V_{GS}$ to a drain current (on linear scale) $I_D$ of a MOSFET according to prior art. FIG. 2 is a graph showing characteristics of the gate-source voltage $V_{GS}$ to a drain current (on logarithmic scale) $I_D$ of the MOSFET according to prior art. Referring to FIGS. 1 and 2, a region where the gate-source voltage $V_{GS}$ is higher than a threshold voltage $V_{TH}$ is referred to as "strong inversion region", and a region where the gate-source voltage $V_{GS}$ is lower than the threshold voltage $V_{TH}$ is referred to as "sub-threshold inversion region" (weak inversion region). Referring to FIG. 1, the drain current $I_D$ appears to increase so as to depend on a voltage ($V_{GS}-V_{TH}$) in the strong inversion region. However, as apparent from FIG. 2, if the drain current $I_D$ is represented by a value on logarithmic scale, the current in the sub-threshold region is not zero but a minute current flows in the same region.

FIG. 3 is a graph showing characteristics of a drain-source voltage $V_{DS}$ to the drain current $I_D$ of the MOSFET according to prior art. That is, FIG. 3 shows relationship between the drain-source voltage $V_{DS}$ and the drain current $I_D$ in the strong inversion region. In FIG. 3, a left side ($V_{DS}<V_{GS}-V_{TH}$) of a dotted line is referred to as "linear characteristic region (non-saturation characteristic region)", and a right side ($V_{DS}>V_{GS}-V_{TH}$) of the dotted line is referred to as "saturation characteristic region". In the linear characteristic region, the drain current $I_D$ depends on the drain-source voltage $V_{DS}$ and is represented by the following Equation (3):

$$I_D = \beta\left[(V_{GS} - V_{TH}) - \frac{1}{2}V_{DS}\right]V_{DS}, \tag{3}$$

where $\beta=\mu C_{OX}K$, $\mu$ denotes the carrier mobility, $C_{OX}$ denotes a capacity of an oxide film per unit area, K denotes an aspect ratio (=W/L), W denotes a gate width, and L denotes a gate length. When the drain-source voltage $V_{DS}$ is sufficiently low, the Equation (3) can be approximated to the following Equation (4):

$$I_D=\beta(V_{GS}-V_{TH})V_{DS} \tag{4}$$

According to the Equation (4), the MOSFET operating in this region can be dealt with as a large resistance when the $V_{DS}$ is low enough. In the saturation region, the Equation (3) can be approximated to the following Equation (5):

$$I_D = \frac{\beta}{2}(V_{GS} - V_{TH})^2. \tag{5}$$

Since the drain current $I_D$ can be represented by the Equation (5), the drain current $I_D$ is decided by the gate-source voltage $V_{GS}$ without depending on the drain-source voltage $V_{DS}$.

As mentioned above, the minute current flows in the MOSFET in the sub-threshold region. Due to this, by adopting the circuit design on the premise of this region, power consumption of the circuit system can be considerably reduced. The drain current $I_D$ of the MOSFET in this case is represented by the following Equation (6) when the drain-source voltage $V_{DS}$ is, for example, equal to or lower than 0.1 V (in sub-threshold linear region):

$$I_D = KI_0\exp\left(\frac{V_{GS} - V_{TH}}{\eta V_T}\right)\left[1 - \exp\left(-\frac{V_{DS}}{V_T}\right)\right], \tag{6}$$

where $I_O=\mu C_{OX}V_T^2(\eta-1)$, $V_T(=kT/q)$ denotes a thermal voltage, k denotes Boltzmann coefficient, T denotes an absolute temperature, q denotes a charge elementary quantity, and $\eta$ denotes a sub-threshold swing coefficient. Furthermore, the drain current $I_D$ can be approximated to the following Equation (7) if the drain-source voltage $V_{DS}$ is, for example, equal to or higher than 0.1 V:

$$I_D = KI_0\exp\left(\frac{V_{GS} - V_{TH}}{\eta V_T}\right). \tag{7}$$

Since the drain current $I_D$ can be approximated to the Equation (7), the drain current $I_D$ is decided by the gate-source voltage $V_{GS}$ without depending on the drain-source voltage $V_{DS}$.

FIG. 4 is a circuit diagram showing a current mirror circuit according to prior art. As mentioned above, in the saturation characteristic region, the drain current $I_D$ is decided by the gate-source voltage $V_{GS}$ without depending on the drain-source voltage $V_{DS}$. If two MOSFET M1 and MOSFET M2 operating in such a characteristic region are connected as shown in FIG. 4, the MOSFETs M1 and M2 are the same in the gate-source voltage $V_{GS}$. Therefore, based on the Equation (5), an output current $I_{out}$ is represented by the following Equation (8):

$$I_{out} = \frac{K_2}{K_1}I_{ref}. \tag{8}$$

Accordingly, various currents can be obtained according to aspect ratios K1 and K2 of the MOSFETs Ml and M2, respectively. As long as the MOSFETs M1 and M2 are equal in size to each other, the same current can be copied for the MOSFETs Ml and M2 without depending on drain voltages. The same thing is true for an instance in which the drain-source voltage $V_{DS}$ is, for example, equal to or higher than 0.1 V in the sub-threshold region. However, the drain current $I_D$ of an actual MOSFET depends on the drain-source voltage $V_{DS}$ due to a channel length modulation effect. If the MOSFET is in the strong inversion region, the drain current $I_D$ is represented by the following Equation (9):

$$I_D = \frac{\beta}{2}(V_{GS} - V_{TH})^2(1 + \lambda V_{DS}). \tag{9}$$

Therefore, a difference in the drain-source voltage $V_{DS}$ between the MOSFETs M1 and M2 generates a slight error between a reference output current $I_{ref}$ and the output current $I_{out}$. In this case, $\lambda$ denotes a channel length modulation coefficient that is proportional to 1/L. Thus, the error becomes smaller as the gate length L is larger.

In the current mirror circuit shown in FIG. 4, if the output voltage changes by $\Delta V_{out}$, the output current changes via an output resistance $r_{o2}$ of the MOSFET M2. If this change in the current is assumed as $\Delta I_{out}$, the $\Delta I_{out}$ is represented by the following Equation (10):

$$\Delta I_{out} = \frac{\Delta V_{out}}{r_{o2}}. \tag{10}$$

Accordingly, as the output resistance $r_{o2}$ is larger, the change $\Delta I_{out}$ in the output current becomes smaller and accuracy of the current mirror circuit improves.

FIG. 5 is a circuit diagram showing a cascode current mirror circuit according to prior art. Examples of a method of increasing the output current include cascode connection shown in FIG. 5. By the cascode connection, the drain resistance $r_{o2}$ of the MOSFET M2 is changed to $(g_{m4}r_{o4})r_{o2}$ that is a multiple of MOSFET M4 by a genuine gain $g_{m4}r_{o4}$. Accordingly, the change $\Delta I_{out}$ in the output current is represented by the following Equation (11):

$$\Delta I_{out} = \frac{\Delta V_{out}}{(g_{m4}r_{o4})r_{o2}}. \tag{11}$$

According to the Equation (10), the change $\Delta I_{out}$ in the output current can be further suppressed by as much as a genuine gain $g_{m4}r_{o4}$ of the MOSFET M4. However, if the cascode connection is used, a pair of MOSFETs is additionally connected. Due to this, it is necessary to consume extra voltage (overdrive voltage) required for the MOSFETs to operate, disadvantageously with increasing a lower limit value of the power source voltage.

FIG. 6 is a circuit diagram showing a feedback operational amplifier according to prior art. Referring to FIG. 6, a voltage of an output terminal of an operational amplifier 53 changes so as to eliminate a difference between input signals by function of a feedback circuit 54 if the feedback circuit 54 negatively feeds back a part of the output signal to the operational amplifier 53. In this way, voltages of two input terminals of the feedback target operational amplifier 53 are made be equal to each other, and this state is referred to as "virtual short-circuit". As mentioned above, the accuracy of the current mirror circuit is improved as the difference in the drain-source voltage $V_{DS}$ between the two MOSFETs is smaller. Accordingly, if the virtual short-circuit of the operational amplifier 53 is used, then the two MOSFETs coincide with each other in $V_{DS}$, and the accuracy of the current mirror circuit can be improved.

FIG. 7 is a circuit diagram showing a beta-multiplication self-referencing bias circuit according to prior art (See, for example, the Non-Patent Document 1). MOSFETs $M_{p1}$ and $M_{p2}$ have a common gate-source voltage, and configure one current mirror circuit. Thus, the same current flows in the two MOSFETs $M_{p1}$ and $M_{p2}$. Accordingly, the same current flows in MOSFETs $M_{n1}$ and $M_{n2}$. If these MOS transistors are made to operate in the sub-threshold region, both currents therefor can be represented by the Equation (7). However, since a resistance R is connected to a source of the MOSFET $M_{n1}$, a gate-source voltage $V_{GSn1}$ of the MOSFET $M_{n1}$ is lower than a gate-source voltage $V_{GSn2}$ of the MOSFET $M_{n2}$. Therefore, it is necessary to adjust the MOSFETs $M_{n1}$ and $M_{n2}$ to satisfy the following Equation (12):

$$V_R + V_{GSn1} = V_{GSn2} \tag{12}$$

where $V_R$ denotes a voltage as applied to the resistance R. As apparent from a circuit configuration of FIG. 7, the same current flows in this entire circuit, and the current thus flowing is decided by a magnitude of the resistance R. However, it is disadvantageously necessary to set the current flowing in the circuit in an order of several nanoamperes (nA) so as to make the beta-multiplication self-referencing bias circuit operate in the sub-threshold region. Thus, it is necessary to make the resistance R a significantly large resistance, as a result, a chip area disadvantageously increases.

FIG. 8 is a circuit diagram showing a configuration of a reference current source circuit according to a first prior art disclosed in the Non-Patent Document 2. In this circuit, a MOSFET $M_R$ is made to operate in a strong inversion linear region and a MOSFET $M_B$ is made to operate in a strong inversion saturation region so as to apply a sufficiently high bias voltage to the MOSFET $M_R$. As mentioned above, the MOS transistor operating in the strong inversion region can be dealt with as the resistance, it is possible to prevent an increase in a chip area caused by the resistance, which is a problem with a beta-multiplication self-referencing bias circuit. The operation principle of this circuit will be described below.

A current generated in the circuit is decided by the MOSFET $M_R$ (current generation transistor), which operates in the strong inversion linear region. That is, a current I flowing in the circuit is represented by the following Equation (13) based on the Equation (4):

$$I = \beta_R (V_B - V_{TH}) V_{DSR} \tag{13}$$

where $\beta_R$ denotes a design parameter of the MOSFET $M_R$, $V_B$ denotes a bias voltage applied to a gate of the MOSFET $M_R$, and $V_{DSR}$ denotes a drain-source voltage of the MOSFET $M_R$. Since MOSFETs $M_{n1}$ and $M_{n2}$ shown in FIG. 8 operate in the sub-threshold region, a drain-source voltage $V_{DSR}$ is represented by the following Equation (14) based on the Equation (4):

$$V_{DSR} = \eta V_T \ln(K_1/K_2) \tag{4}$$

Based on this, a minute current can be generated by controlling the design parameter $\beta_R$ and the drain-source voltage $V_{DSR}$ of the MOSFET $M_R$. The temperature dependence of the current represented by the Equations (13) and (14) is considered. The temperature dependences of a carrier mobility $\mu$ and a threshold voltage $V_{TH}$ are represented by the following Equations (15) and (16), respectively:

$$\mu = \mu(T_0)\left(\frac{T}{T_0}\right)^{-m}, \text{ and} \tag{15}$$

$$V_{TH} = V_{TH0} - \kappa T, \tag{16}$$

where $\mu(T_0)$ denotes a mobility at room temperature, m denotes a temperature coefficient of the mobility dependent on CMOS technology, $V_{TH0}$ denotes a threshold voltage at absolute zero point, $\kappa$ denotes a temperature coefficient of the threshold voltage. In this case, a temperature coefficient $TC_I$ of an output current I is represented by the following Equation (17):

$$\begin{aligned} TC_I &= \frac{1}{I}\frac{dI}{dT} = \frac{1}{\beta_R}\frac{d\beta_R}{dT} + \frac{1}{V_B - V_{TH}}\frac{d(V_B - V_{TH})}{dT} + \frac{1}{V_{DSR}}\frac{dV_{DSR}}{dT} \\ &= \frac{1-m}{T} + \frac{1}{V_B - V_{TH}}\frac{d(V_B - V_{TH})}{dT} \end{aligned} \tag{17}$$

Moreover, since the MOSFET $M_B$ shown in FIG. 8 operates in the saturation region, a bias voltage $V_B$ as applied to a gate of the MOSFET $M_B$ is represented by the following Equation (18):

$$V_B = V_{TH} + \sqrt{\frac{2I}{\beta_B}}. \tag{18}$$

Accordingly, the Equation (17) is represented by the following Equation (19):

$$TC_I = \frac{2-m}{T}. \tag{19}$$

Since a value of a parameter m of an ordinary MOSFET is about 1.5, the temperature coefficient of the output current is always positive. That is, the ordinary MOSFET has such characteristics that the current increases according to rise in temperature. Based on this, this current source circuit is referred to as "PTC (Positive Temperature Coefficient) current source circuit", hereinafter. If the PTC current source circuit is used in an environment in which operating temperature changes, the output current from this current source circuit increases according to temperature and such a problem that the current source circuit cannot supply constant current occurs.

FIG. 9 is a circuit diagram showing a configuration of a reference voltage source circuit according to a second prior art disclosed in the Non-Patent Documents 4 and 5. It is reported that this circuit is used as a voltage source and it is not assumed that this circuit is used as a current source. However, a current of the circuit has characteristic property. That is, the circuit has characteristics of being capable of stably generating a current despite variations in a threshold voltage. Referring to FIG. 9, the circuit is configured to include a current source sub-circuit 51 and a voltage source sub-circuit 52. The sizes of respective MOS transistors are set so that a temperature coefficient of an output voltage $V_{ref}$ generated by the voltage source sub-circuit 52 is zero, and this leads to that the output voltage $V_{ref}$ is represented by the following Equation (20):

$$V_{ref}=V_{TH0} \quad (20).$$

Since a current generation transistor $M_R$ is biased by this output voltage $V_{ref}$, the output current I from this circuit is represented by the following Equation (21) based on the Equations (7), (13), and (16):

$$I=\beta_R \kappa T V_{DSR} \quad (21),$$

$$V_{DSR}=\eta V_T \ln(K_1/K_2) \quad (22).$$

A temperature coefficient $TC_I$ of the output circuit I of this circuit is represented by the following Equation (23) based on the Equation (17):

$$TC_I = \frac{1}{I}\frac{dI}{dT} = \frac{2-m}{T}. \quad (23)$$

Accordingly, the temperature coefficient $TC_I$ of the output current I from the circuit is always positive. That is, the current increases according to rise in temperature. In the reference current source circuit according to the first prior art, the gate-source voltage $V_{GS}$ of the MOSFET $M_R$ is biased which operates in the strong inversion saturation region as represented by the Equation (18). The output current is represented by the following Equation (24):

$$I = \beta_R \sqrt{\frac{2I}{\beta_B}}\, V_{DSR}. \quad (24)$$

On the other hand, in this circuit, a threshold voltage of each MOSFET is biased to absolute zero point. The output current I is represented by the Equation (21). In the Equation (24), a value of $$\sqrt{\frac{2I}{\beta_B}}$$

changes according to variations in manufacturing process. On the other hand, κT in the Equation (21) is stable despite the process variations. Therefore, it can be predicted that the output current from this circuit has less influence on the process variations.

FIG. 10 is a circuit diagram showing a configuration of a reference current source circuit according to a third prior art disclosed in, for example, the Non-Patent Document 6. The reference current source circuits according to the first and second prior arts have such a problem that the current increases in proportion to the temperature. In order to solve this problem, the Non-Patent Document 6 discloses the following respects. A current source circuit having such characteristics that the current decreases in proportion to the temperature, that is, an NTC (Negative Temperature Coefficient) current source circuit is separately provided, and the currents of these circuits are added up, and this leads to improvement in the temperature characteristics of the current.

The circuit of FIG. 10 is configured to include a PTC current source circuit 61, an NTC current source circuit 62, and a current adder circuit 63. The circuit adopts cascode connection to improve the current mirror circuit. The NTC current source circuit 62 is configured so that a MOSFET $M_{B2}$ operating in the sub-threshold region and a MOSFET $M_{B3}$ operating in the saturation region are connected to each other in place of a MOSFET $M_{B1}$ of the PTC current source circuit 61. In this case, a gate-source voltage $V_{B2}$ of a current generation transistor $M_{R2}$ of the NTC current source circuit 62 is represented by the following Equation (25):

$$V_{B2} = 2V_{TH} + \sqrt{\frac{2I}{\beta_{B3}}} + \eta V_T \ln\left(\frac{I}{K_{B2} I_0}\right). \quad (25)$$

A temperature coefficient $TC_I$ of an output current $I_{ref}$ is represented by the following Equation (26) based on the Equations (17) and (25):

$$TC_I = \frac{2-m}{T} - \frac{1}{T\left(1-\frac{\kappa T - V_A}{V_{TH0}}\right)}, \quad (26)$$

where T denotes the temperature, $V_{TH0}$ denotes a threshold voltage at the absolute zero point, κ denotes a temperature coefficient of the threshold voltage, and the voltage $V_A$ is represented by the following Equation (27):

$$V_A = \frac{1}{2}\sqrt{\frac{2I}{\beta_{B3}}} + \eta V_T \ln\left(\frac{I}{K_{B2} I_0}\right) - \eta V_T. \quad (27)$$

In this case, since a parameter κT is a very small value as compared with the threshold voltage $V_{TH0}$ at the absolute zero point, the Equation (26) is represented by the following Equation (28):

$$TC_I = \frac{2-m}{T} - \frac{1}{T}\left(1+\frac{\kappa T}{V_{TH0}}\right) = \frac{1-m}{T} - \frac{\kappa}{V_{TH0}}. \quad (28)$$

Accordingly, the temperature coefficient $TC_I$ of the output current I from the NTC current source circuit 62 is always negative. Based on the aforementioned, the current generated by the PTC current source circuit 61 and having the positive temperature coefficient and the current generated by the NTC current source circuit 62 and having the negative temperature coefficient are inputted to the current adder circuit 63. It is thereby possible to configure the reference current source circuit (FIG. 10) that outputs a current the temperature coefficient of which is zero. It is noted that the voltage $V_{B2}$ represented by the Equation (25) is applied as a bias voltage to the current generation transistor $M_{R2}$ of the NTC current source circuit 62. Therefore, an output current $I_{NTC}$ from the NTC current source circuit 62 is represented by the following Equation (29) based on the Equations (13) and (25):

$$I_{NTC} = \beta_{R2}\left(V_{TH} + \sqrt{\frac{2I_{NTC}}{\beta_{B3}}} + \eta V_T \ln\left(\frac{I_{NTC}}{K_{B2}I_0}\right)\right)V_{DS}. \tag{29}$$

Now, attention is paid to the Equations (28) and (29). Each of the both Equations (28) and (29) includes the threshold voltage $V_{TH}$ ($\infty V_{TH0}$). The threshold voltage $V_{TH0}$ at the absolute zero point greatly changes with respect to process variations and current characteristics greatly change. Accordingly, with the technique of generating the constant current using such an NTC current source circuit 62, the current characteristics are possibly changed by the process variations. The problems of the prior art mentioned so far will be put into shape as follows.

A technique of generating a constant current using a voltage source circuit referring to a band-gap of silicon has been conventionally adopted (See, for example, the Patent Document 1). FIG. 11A is a chart showing a method of generating a constant current according to the prior art, that is, a graph showing temperature changes of a PTAT (Proportional To Absolute Temperature) current 71 that increases in proportion to the temperature and a CTAT (Conversely Proportional To Absolute Temperature) current 72 that decreases in proportion to the temperature. FIG. 11B is a graph showing that the constant current is obtained by adding up the PTAT current 71 and the CTAT current 72 shown in FIG. 11A. That is, as shown in FIGS. 11A and 11B, it is possible to obtain the current that is constant despite temperature change by adding the PTAT current 71 and the CTAT current 72.

However, the band-gap voltage source circuit has a problem of high electric power and such a problem that a package area increases when the band-gap voltage source circuit is made to operate with low current because of use of a resistance. These current source circuits generate the current increasing and the current decreasing according to the temperature as circuits, respectively, and generate the constant current that does not change with respect to temperature by adding up these currents.

The above-mentioned first and second prior arts propose the power source circuits operating in the minute current region in an order of nanoamperes. The current flowing in each of these circuits has characteristics of increasing in proportion to the temperature. According to the third prior art, the reference current source circuit has such characteristics that a constant current can be obtained even with a temperature change but that the current is strongly influenced by variations of a threshold voltage, and that the current has great change. According to the first and second prior arts, the reference current source circuits operate stably against process variations but have the following problems. FIG. 12A is a graph showing that a minute current generator circuit according to the prior art cannot generate the CTAT current 72. FIG. 12B is a graph showing that the minute current generator circuit according to the prior art cannot obtain a reference current output without temperature dependence as a result of FIG. 12A. As shown in FIGS. 12A and 12B, the reference voltage source circuit referring to the band-gap according to the prior art cannot generate the current decreasing according to temperature, and a reference current source circuit generating a current constant with respect to temperature cannot be constructed.

SUMMARY OF THE INVENTION

It is an object of the present invention to provide a reference current source circuit capable of solving the above-mentioned problems and outputting a constant reference current even if surrounding environments such as temperature and power source voltage change in a power source circuit that operates in a minute current region in an order of nanoamperes.

In order to achieve the aforementioned objective, according to one aspect of the present invention, there is provided a reference current source circuit includes first and second power source circuits, and a current subtractor circuit. The first power source circuit includes a current generating nMOSFET, and generates a first current having a temperature characteristic of an output current dependent on an electron mobility. The second power source circuit includes a current generating pMOSFET, and generates a second current having a temperature characteristic of an output current dependent on a hole mobility. The current subtracter circuit generates a constant reference current by subtracting the second current from the first current.

In the above-mentioned reference current source circuit, the first power source circuit generates a plurality of first currents, the second power source circuit generates a plurality of second currents, and the subtracter circuit generates the constant reference current based on the plurality of first currents and the plurality of second currents.

In addition, in above-mentioned reference current source circuit, the first power source circuit further includes a first gate bias voltage generator circuit and a first drain bias generator circuit. The first gate bias voltage generator circuit generates a gate bias voltage so that the current generating nMOSFET operates in a strong inversion region, and the first drain bias generator circuit generates a drain bias for the current generating nMOSFET. The second power source circuit further includes a second gate bias voltage generator circuit and a second drain bias voltage generator circuit. The second gate bias voltage generator circuit generates a gate bias voltage so that the current generating pMOSFET operates in a strong inversion region, and the second drain bias voltage generator circuit generates a drain bias for the current generating pMOSFET.

Further, in above-mentioned reference current source circuit, the first gate bias generator circuit includes ones of a plurality of differential pairs and a plurality of differential pair circuits.

Still further, in above-mentioned reference current source circuit, the first power source circuit further includes a first current mirror circuit for supplying a power source current to the current generating nMOSFET, the first drain bias generator circuit, and the first gate bias voltage generator circuit. The second power source circuit further includes a second current mirror circuit for supplying a power source current to the current generating pMOSFET, the second drain bias generator circuit, and the second gate bias voltage generator circuit.

Further, in above-mentioned reference current source circuit, the first current mirror circuit includes a first operational amplifier for suppressing a change of a power source current accompanying a change of a power source voltage. The second current mirror circuit includes a second operational amplifier for suppressing a change of a power source current accompanying the change in the power source voltage.

In above-mentioned reference current source circuit, each of the first power source circuit and the second power source circuit further includes a startup circuit, which includes a detection circuit and a starting transistor. The detection circuit detects that the first power source circuit and the second power source circuit do not operate. The starting transistor starts the first power source circuit and the second power source circuit by flowing a predetermined current into the first power source circuit and the second power source circuit when the detection circuit detects that the first power source circuit and the second power source circuit do not operate.

Further, in above-mentioned reference current source circuit, the startup circuit of each of the first power source circuit and the second power source circuit further includes a current supply circuit for supplying a bias operating current to the detection circuit. The current supply circuit includes a minute current generator circuit, and a third current mirror circuit. The minute current generator circuit generates a predetermined minute current from the power source voltage, and the third current mirror circuit for generating a minute current corresponding to the generated minute current as the bias operating current.

Still further, in above-mentioned reference current source circuit, the startup circuit of the first power source circuit further includes a first current supply circuit for supplying a bias operating current to the detection circuit. The first current supply circuit includes a minute current generator circuit, and a third current mirror circuit. The minute current generator circuit generates a predetermined minute current from a power source voltage. The third current mirror circuit generates a minute current corresponding to the generated minute current as the bias operating current. The startup circuit of the second power source circuit further includes a second current supply circuit for supplying a bias operating current to the detection circuit. The second current supply circuit includes a fourth current mirror circuit for generating a current corresponding to an operating current after starting the second power source circuit as the bias operating current.

ADVANTAGEOUS EFFECT OF THE INVENTION

The reference current source circuit according to the present invention includes: the first power source circuit having temperature characteristics of the output current dependent on the electron mobility and generating the first current; the second power source circuit having temperature characteristics of the output current dependent on the hole mobility; and the current subtracter circuit generating the constant reference current by subtracting the second current from the first current. It is thereby possible to cancel the temperature dependence and obtain the constant reference current without any temperature dependence with complementary circuit configurations based on a difference between the electron mobility and the hole mobility in the temperature characteristics of the generated currents.

BRIEF DESCRIPTION OF THE DRAWINGS

FIG. 31 is a table showing an example of the global variation parameter set (typical values and variations of a 0.35 μm-CMOS parameters) in the Monte Carlo simulation executed by the inventors of the present invention for the reference current source circuits 101, 104, and 106 according to the first, fourth, and sixth implemental examples;

FIG. 32 is a table showing a parameter set of threshold voltages and mobilities in the Monte Carlo simulation;

FIG. 44 is a table showing results of characteristic evaluation of the reference current source circuits 101, 104, and 106 according to the first, fourth, and sixth implemental examples, respectively, and the nMOS-configured power source circuit 106N of the reference current source circuit 106 according to the sixth implemental example;

DESCRIPTION OF NUMERICAL REFERENCES

Figure 1:
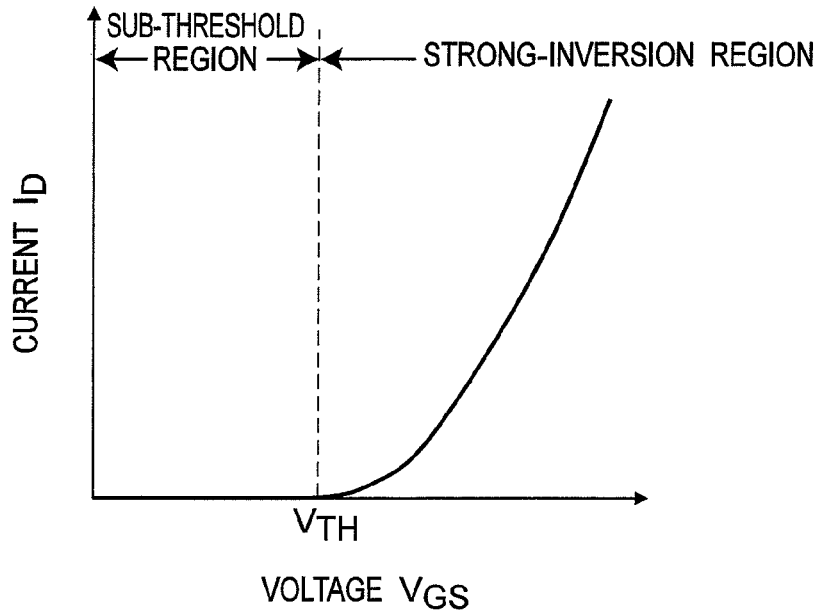
Fig.1 PRIOR ART
FIG. 1 is a graph showing characteristics of a gate-source voltage $V_{GS}$ to a drain current (on linear scale) $I_D$ of a MOSFET according to prior art.
Figure 2:
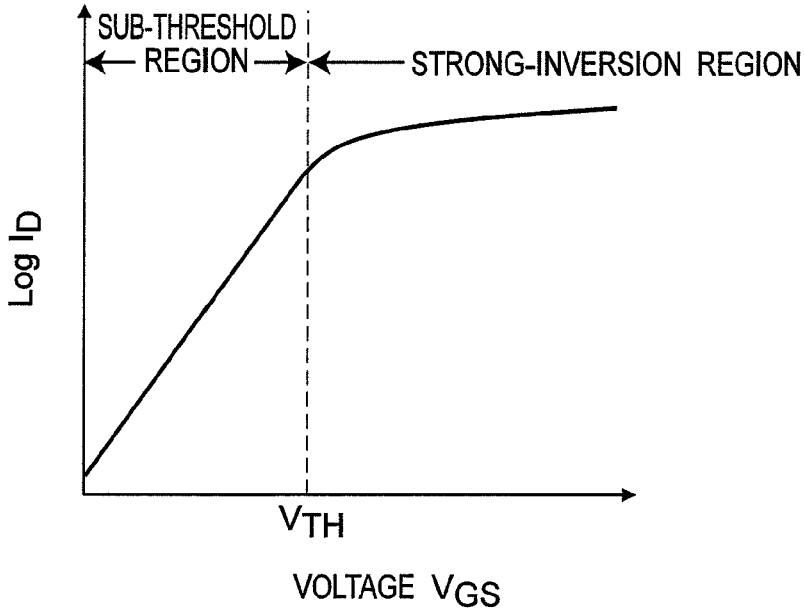
Fig.2 PRIOR ART
FIG. 2 is a graph showing characteristics of the gate-source voltage $V_{GS}$ to a drain current (on logarithmic scale) $I_D$ of the MOSFET according to prior art.
Figure 3:
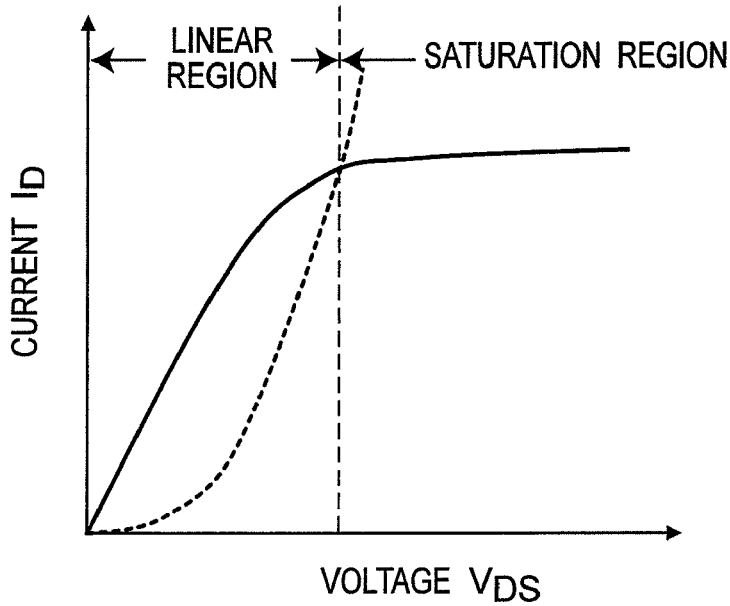
Fig.3 PRIOR ART
FIG. 3 is a graph showing characteristics of a drain-source voltage $V_{DS}$ to the drain current $I_D$ of the MOSFET according to prior art.
Figure 4:
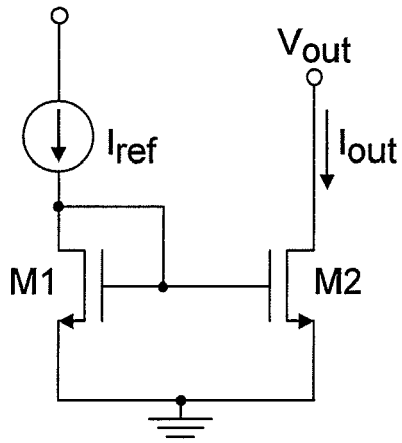
Fig.4 PRIOR ART
FIG. 4 is a circuit diagram showing a current mirror circuit according to prior art.
Figure 5:
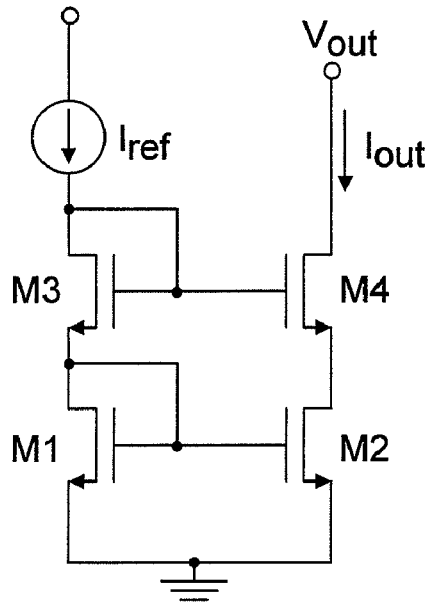
Fig.5 PRIOR ART
FIG. 5 is a circuit diagram showing a cascode current mirror circuit according to prior art.
Figure 6:
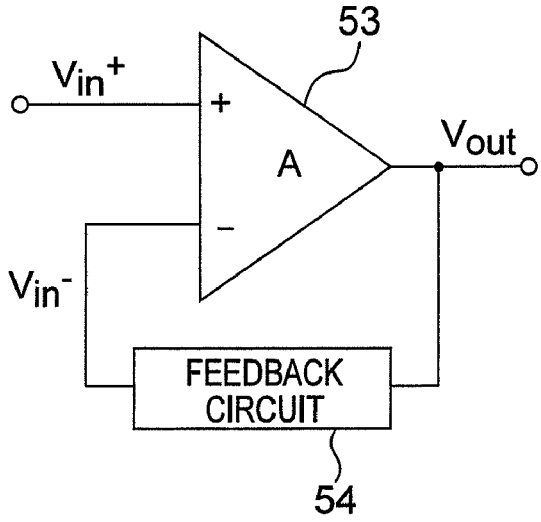
Fig.6 PRIOR ART
FIG. 6 is a circuit diagram showing a feedback operational amplifier according to prior art.
Figure 7:
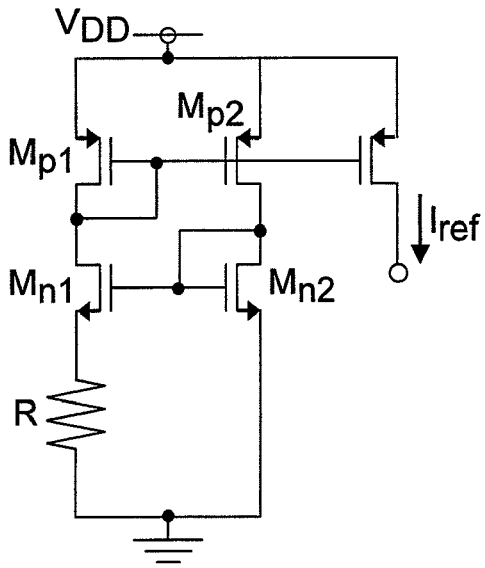
Fig.7 PRIOR ART
FIG. 7 is a circuit diagram showing a beta-multiplication self-referencing bias circuit according to prior art.
Figure 8:
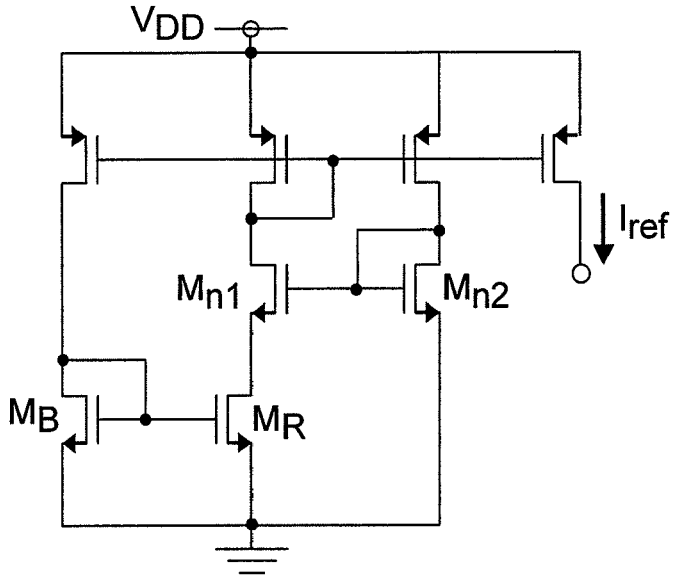
Fig.8 PRIOR ART
FIG. 8 is a circuit diagram showing a configuration of a reference current source circuit according to a first prior art.

1, 11, 21, and 101*n* to 108*n* . . . nMOS-configured power source circuit;
2, 12, 22, and 101P to 108P . . . pMOS-configured power source circuit;
3, 13, 23, and 108SB . . . Current subtractor circuit;
81 . . . Bias voltage generator circuit;
82 and 83 . . . Temperature control circuit;
91 and 92 . . . Operational amplifier;
93 and 94 . . . Inverter;
101 to 106, 301, 302, 101A, 101B, 107A, 107B, 107BA . . . Reference current source circuit;
101SN, 101SP, and 101SPA . . . Startup circuit;
CM1, CM2, CM11, CM12, CM21, CM22, CM21*a*, CM22*a*, CM31, and CM32 . . . Current mirror circuit;
D1 to D4 . . . Differential pair;
DB1, DB2, DB11, and DB12 . . . Drain bias generator circuit;
GB1, GB2, GB11, GB12, GB21, GB22 . . . Gate bias voltage generator circuit;
Q1 to Q420 . . . MOSFET; and
Tp, Tn, T1*p*, T2*p*, T1*n*, and T2*p* . . . Connection point.

DETAILED DESCRIPTION OF THE INVENTION

Preferred embodiments according to the present invention will be described hereinafter with reference to the drawings. In the respective preferred embodiments below, the same reference symbols denote like constituent elements, respectively.

Preferred Embodiments

As mentioned above, various reference current source circuits have been proposed so far. However, many of these circuits have the problem of weakness to variations in manufacturing process, and such characteristics that many of the circuits, in particular, change sensitively to variations of a threshold voltage. Therefore, in the preferred embodiments of the present invention, a reference current source circuit capable of operating in a sub-threshold region and supplying a stable current despite temperature change and process variations is proposed.

A current of a power source circuit that generates a minute current in an order of nanoamperes depends on temperature characteristics of a mobility. By using this feature, that is, by configuring the above-mentioned power source circuit and a power source circuit complementary to the above-mentioned power source circuit, it is possible to generate a current dependent on the electron mobility and a current dependent on the hole mobility. By use of the currents dependent on two physical parameters, respectively, temperature characteristics of a current flowing in the circuit can be changed. Specifically, the current dependent on the hole mobility is subtracted from that dependent on the electron mobility, and this leads to that the reference current source circuit can generate a current that is not dependent on temperature. According to the present invention, a circuit design based on the above-mentioned theory is made and a resultant circuit is confirmed to operate stably. Moreover, a study about variations is made. A voltage source circuit that outputs a threshold voltage at an absolute zero point of a MOSFET has characteristics of having a large performance for variations. Using this voltage source circuit and the voltage source circuit complementary to this voltage source circuit, current subtraction is performed. The reference current source circuit can thereby generate a minute current in an order of nanoamperes that has a large performance for variations resulting from temperature change referred to as a so-called PVT (Process Voltage Temperature) variations and variations caused by the process.

Figure 13:
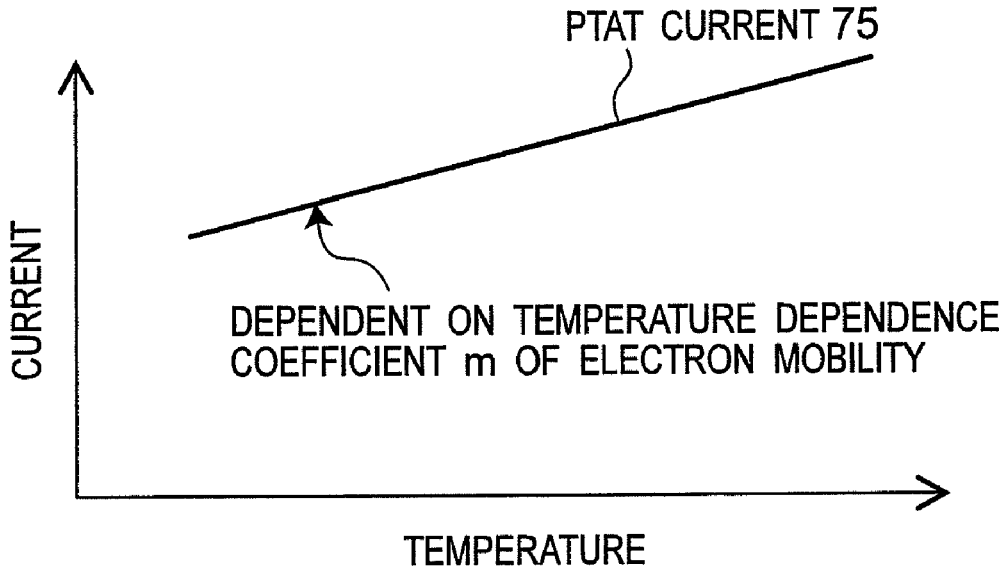
FIG. 13 is a graph showing temperature change of a PTAT current 75 dependent on a temperature dependence coefficient m of the electron mobility according to preferred embodiments of the present invention.

FIG. 13 is a graph showing temperature change of a PTAT current 75 dependent on a temperature dependence coefficient m of the electron mobility according to the preferred embodiments of the present invention. Referring to FIG. 13, the PTAT current 75 increases so as to depend on the temperature coefficient m of the electron mobility as the temperatures rise as mentioned above. The inventors of the present invention paid attention to the fact that not only electrons but also holes serve as carriers of the MOSFET, and the inventors considered generating not only a current dependent on the electron mobility but also a current dependent on the hole mobility.

Figure 14A:
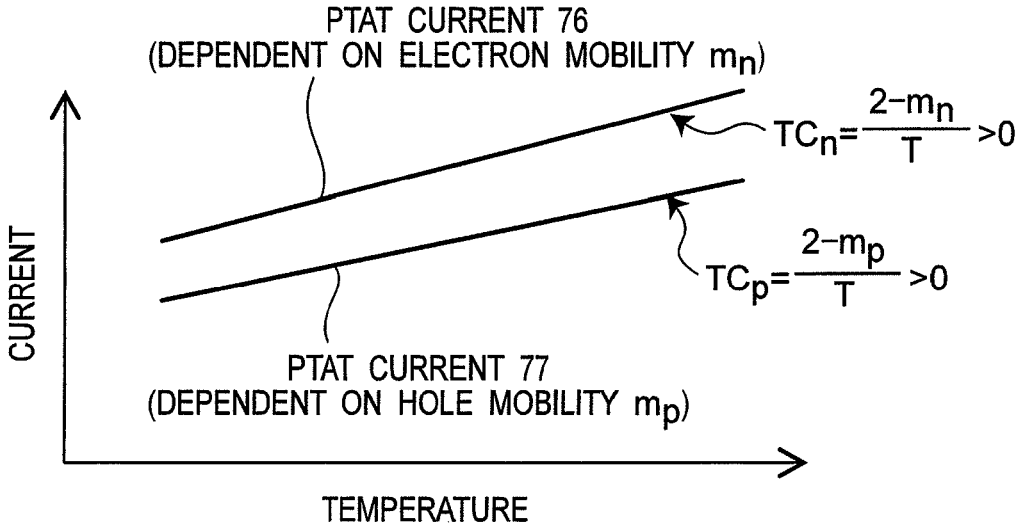
FIG. 14A is a graph showing temperature changes of a PTAT current 76 dependent on a temperature dependence coefficient $m_n$ of the electron mobility and a PTAT current 77 dependent on a temperature dependence coefficient $m_p$ of the hole mobility according to the preferred embodiments of the present invention.
Figure 14B:
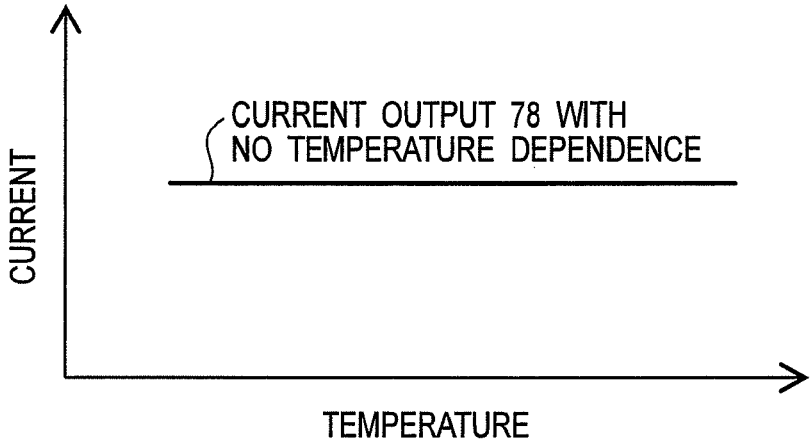
FIG. 14B is a graph showing that a current output 78 with no temperature dependence is generated based on the two PTAT currents 76 and 77 of FIG. 14A.

FIG. 14A is a graph showing temperature changes of a PTAT current 76 dependent on a temperature dependence coefficient $m_n$ of the electron mobility and a PTAT current 77 dependent on a temperature dependence coefficient $m_p$ of the hole mobility according to the preferred embodiments of the present invention. FIG. 14B is a graph showing that a current output 78 with no temperature dependence is generated based on the two PTAT currents 76 and 77 of FIG. 14A. In this case, a temperature coefficient $TC_n$ of the PTAT current dependent on the electron mobility and a temperature coefficient $TC_p$ of the PTAT current dependent on the hole mobility are represented by the following formulas, respectively.

$$TC_n = \frac{2 - m_n}{T} > 0$$

$$TC_p = \frac{2 - m_p}{T} > 0$$

Out of these two currents, the other current is subtracted from one current or the two currents are subjected to weighted subtraction by linear combination (specifically, a weighting coefficient can be set to a predetermined constant by changing design parameters for configuring MOSFETs, respectively). Accordingly, it is considered to be able to obtain the constant current 78 of FIG. 14B. That is, the reference current source circuits according to the prior arts mentioned above have such a problem that the current increases according to the rise in temperature since the temperature coefficient of the output current is always positive. In order to solve the above problem, the inventors propose the reference current source circuit generating a constant current with respect to temperature change using temperature characteristics of mobilities of the nMOS and pMOS, that is, temperature characteristics of the electron mobility and the hole mobility.

As mentioned with reference to FIGS. 14A and 14B, the temperature dependence of the output current from the reference current source circuit depends on temperature coefficients m of the mobilities of the current generation transistor $M_R$. As already mentioned, since these temperature coefficients of the output current are always positive, the current increases according to rise in temperature. In this case, complementary circuit configurations of these circuits will be considered. The complementary circuit configurations make it possible to configure circuits referring to the carrier mobilities of the pMOS. The circuits can thereby generate the currents based on the temperature characteristics of the carrier mobilities, that is, the electron mobility and the hole mobility, respectively. Since the temperature coefficients of the carrier mobilities, that is, the electron mobility and the hole mobility differ from each other, the temperature dependences of the currents generated based on these dependences differ from each other. Therefore, the inventors of the present invention propose the reference current source circuit that generates a constant current with respect to temperature change by configuring the circuit of FIG. 15.

Figure 15:
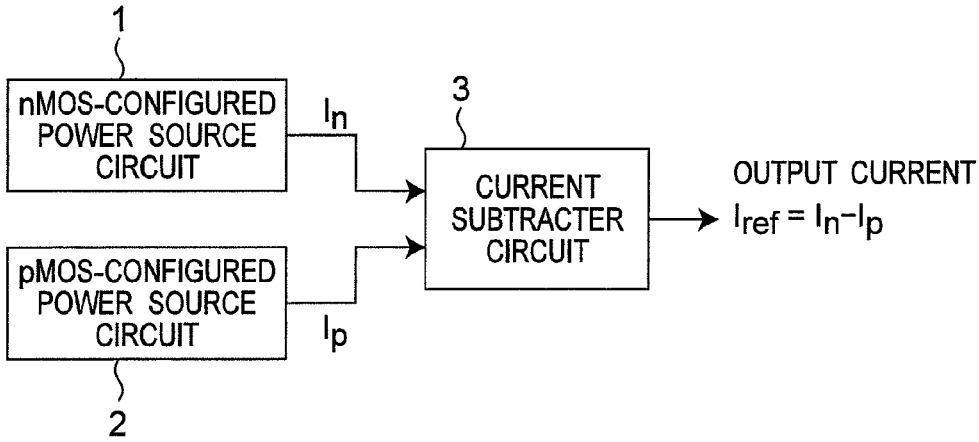
FIG. 15 is a block diagram showing a configuration of the reference current source circuit according to the preferred embodiments of the present invention.

FIG. 15 is a block diagram showing a configuration of the reference current source circuit according to the preferred embodiments of the present invention. Referring to FIG. 15, the reference current source circuit according to the preferred embodiments is characterized by including:

(1) an nMOS-configured power source circuit 1, in which temperature characteristics of an output current from the nMOS-configured power source circuit 1 are decided by the electron mobility;

(2) a pMOS-configured power source circuit 2, in which temperature characteristics of an output current from the pMOS-configured power source circuit 2 are decided by the hole mobility; and (3) a current subtracter circuit 3 for generating an output current $I_n$ based on an output voltage from the nMOS-configured power source circuit 1, generating an output current $I_p$ based on an output voltage from the pMOS-configured power source circuit 2, and outputting an output current $I_{ref}=I_n-I_p$ by subtracting the output current $I_p$ from the output current $I_n$.

In this case, a temperature coefficient $TC_{In}$ of the output current $I_n$ from the nMOS-configured power source circuit 1 and a temperature coefficient $TC_{Ip}$ of the output current $I_p$ from the pMOS-configured power source circuit 2 are represented by the following Equations (30) and (31) based on the Equation (19), respectively:

$$TC_{In} = \frac{1}{I_n}\frac{dI_n}{dT} = \frac{2 - m_n}{T}, \tag{30}$$

and $$TC_{Ip} = \frac{1}{I_p}\frac{dI_p}{dT} = \frac{2 - m_p}{T}, \tag{31}$$

where $m_n$ denotes the temperature coefficient of the mobility of the nMOSFET, and $m_p$ denotes the temperature coefficient of the mobility of the pMOSFET. The gradients of the output currents with respect to temperature changes are represented by the following Equations (32) and (33) based on the Equations (30) and (31), respectively:

$$\frac{dI_n}{dT} = \frac{2-m_n}{T} I_n, \tag{32}$$

and $$\frac{dI_p}{dT} = \frac{2-m_p}{T} I_p. \tag{33}$$

As apparent from the Equations (32) and (33), the gradients change according to the currents $I_n$ and $I_p$, respectively. The gradient of the output current $I_{ref}$ obtained by calculating a difference between these currents using the current subtracter circuit with respect to the temperature change is represented by the following Equation (34):

$$\frac{dI_{ref}}{dT} = \frac{2-m_n}{T} I_n - \frac{2-m_p}{T} I_p = \frac{2-m_n}{T} I_n f(T), \tag{34}$$

where f(T) is represented by the following Equation (35):

$$f(T) = 1 - \frac{2-m_p}{2-m_n}\frac{I_p}{I_n}. \tag{35}$$

A method of generating a constant current according to the present preferred embodiments will next be described.

Figure 16A:
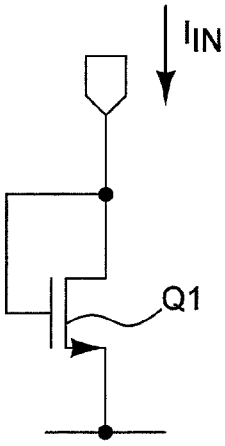
FIG. 16A is a circuit diagram of a diode-connected MOSFET operating in the sub-threshold region.
Figure 16B:
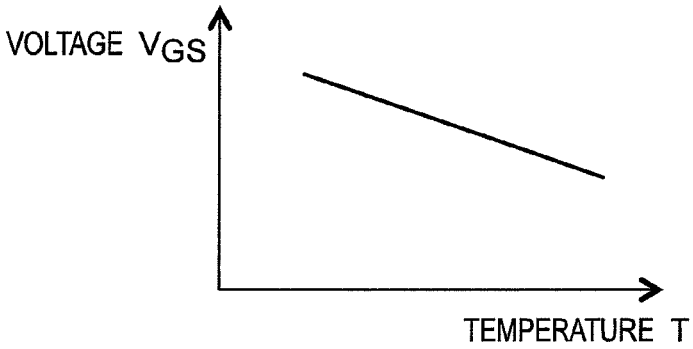
FIG. 16B is a graph showing temperature characteristics of a gate-source voltage $V_{GS}$ of the MOSFET.

FIG. 16A is a circuit diagram of a diode-connected MOSFET operating in the sub-threshold region. FIG. 16B is a graph showing temperature characteristics of a gate-source voltage $V_{GS}$ of the MOSFET. As shown in FIG. 16A, if a current bias $I_{IN}$ flows into a MOSFET Q1 having the diode-connected configuration, the gate-source voltage $V_{GS}$ of the MOSFET Q1 is decided. This voltage $V_{GS}$ is represented by the following Equation:

$$V_{GS} = V_{TH} + \eta V_T \ln\left(\frac{I_{DS}}{KI_0}\right).$$

In this Equation, the threshold voltage $V_{TH}$ has such characteristics that the voltage decreases according to temperature. In addition, since a function ($I_{DS}/K_{IO}$) contained in a logarithmic term is smaller than 1, the logarithmic term is a negative value. Accordingly, as shown in FIG. 16B, the gate-source voltage $V_{GS}$ decreases according to the temperature.

Figure 17A:
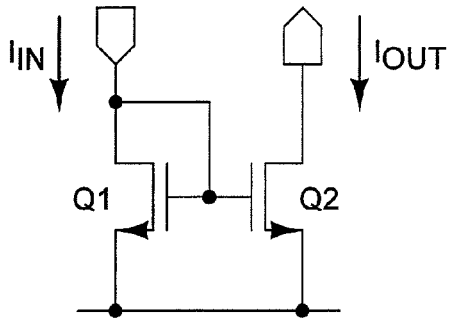
FIG. 17A is a circuit diagram showing a first example of a current mirror circuit.
Figure 17B:
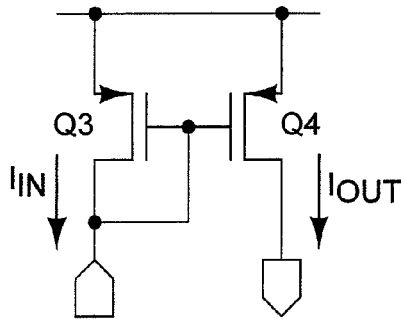
FIG. 17B is a circuit diagram showing a second example of the current mirror circuit.

FIG. 17A is a circuit diagram showing a first example of a current mirror circuit. FIG. 17B is a circuit diagram showing a second example of the current mirror circuit. For example, in the current mirror circuits of FIGS. 17A and 17B, current characteristics of MOSFETs (Q1, Q2) and those of MOSFETs (Q3, Q4) are decided by the gate-source voltage $V_{GS}$. Since the paired MOSFETs (Q1, Q2) and (Q3, Q4) have the same gate-source voltage $V_{GS}$, each current mirror circuit outputs the same output current $I_{OUT}$ in response to the same input current $I_{IN}$.

Figure 18A:
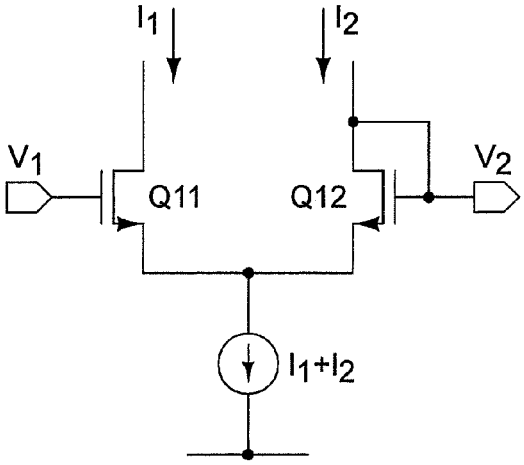
FIG. 18A is a circuit diagram showing a first example of a differential pair circuit including two MOSFETs Q11 and Q12 used for temperature control according to the preferred embodiments of the present invention.
Figure 18B:
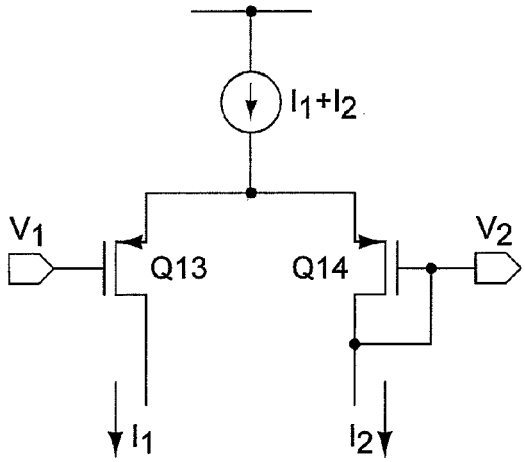
FIG. 18B is a circuit diagram showing a second example of a differential pair circuit including two MOSFETs Q13 and Q14 used for temperature control according to the preferred embodiments of the present invention.

FIG. 18A is a circuit diagram showing a first example of a differential pair circuit including two MOSFETs Q11 and Q12 used for temperature control according to the preferred embodiments of the present invention. FIG. 18B is a circuit diagram showing a second example of a differential pair circuit including two MOSFETs Q13 and Q14 used for temperature control according to the preferred embodiments of the present invention. As shown in FIGS. 18A and 18B, the temperature characteristics of the voltage can be controlled using the differential pair including the two MOSFETs (Q11, Q12) or (Q13, Q14). In this case, one MOSFET in each differential pair is assumed as a signal detection terminal and the other is assumed as a diode-connected output terminal. If currents flowing in this differential pair are set to be equal to each other, the differential pair circuit can output a voltage in proportion to the temperature from the input terminal to the output terminal. By controlling sizes of the transistors in the differential pair, the differential pair circuit can generate the voltage in proportion to the temperature as represented by the following Formula:

$$\begin{aligned} V_2 - V_1 &= V_{GS2} - V_{GS1} \\ &= V_{TH} + \eta V_T \ln\left(\frac{I_2}{K_2 I_0}\right) - V_{TH} - \eta V_T \ln\left(\frac{I1}{K_1 I_0}\right) \\ &= \eta V_T \ln\left(\frac{K_1 I_2}{K_2 I_1}\right) \rightarrow \eta V_T \ln\left(\frac{K_1}{K_2}\right) \end{aligned}$$

The gradient of a voltage change with respect to the temperature can be controlled by changing a ratio of the sizes of the transistors.

Figure 19:
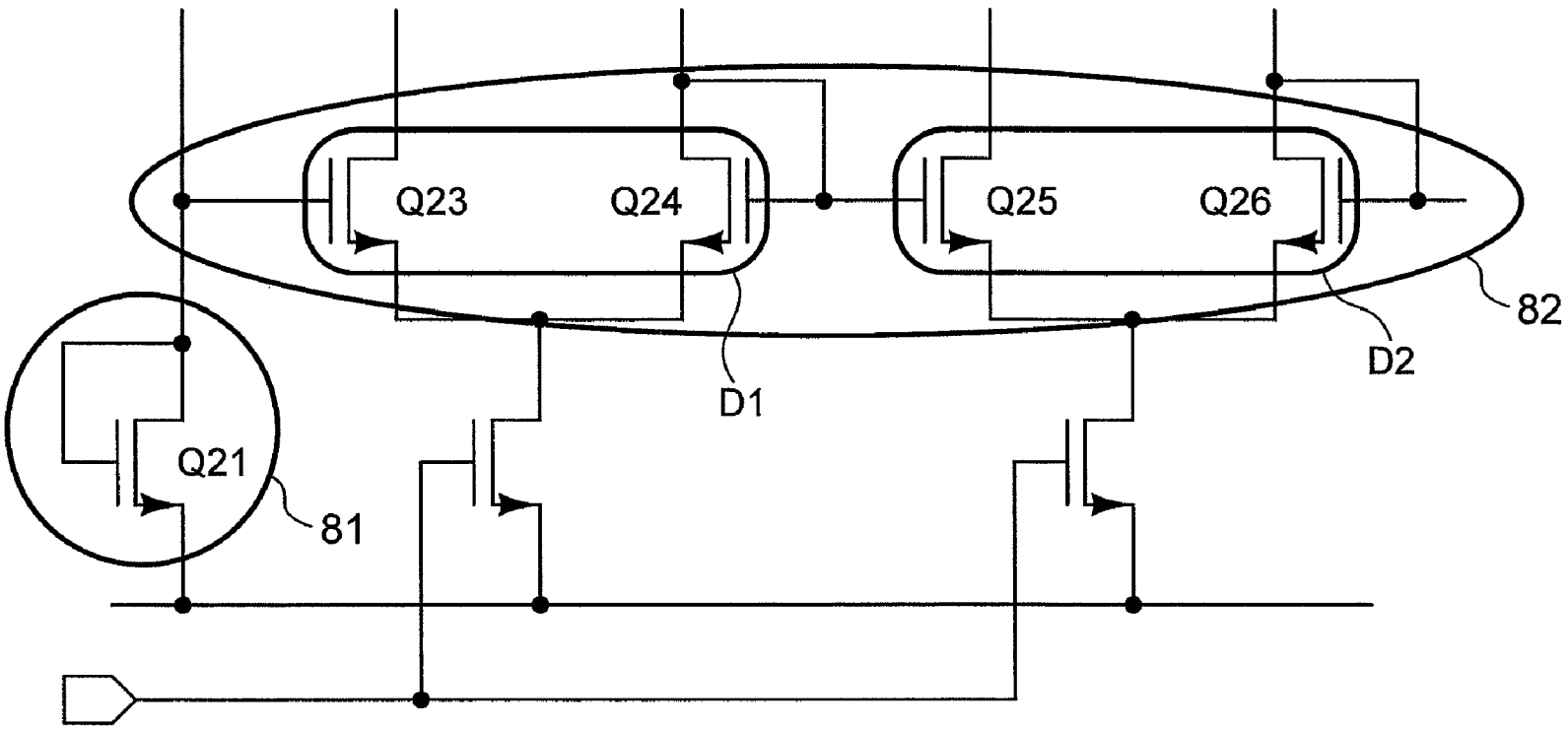
FIG. 19 is a circuit diagram showing a first example of a temperature control method according to the preferred embodiments of the present invention.

FIG. 19 is a circuit diagram showing a first example of a temperature control method according to the preferred embodiments of the present invention. As shown in FIG. 19, at the subsequent stage of a bias voltage generator circuit 81 including a diode-connected MOSFET Q21, differential pairs D1 (Q23, Q24) and D2 (Q25, Q26) are cascade-connected. This configuration enables a temperature control circuit 82 to control the gradient of voltage change with respect to temperature. That is, the temperature control circuit 82 controls the gradient of the voltage change with respect to the temperature according to the sizes of the transistors. However, the sizes thereof are included in the logarithmic term. Thus, even if the transistor sizes are made large, an effect of the larger sizes is limited by a logarithmic relation. In order to solve this, the differential pairs D1 (Q23, Q24) and D2 (Q25, Q26) are cascade-connected at the subsequent stage of the bias voltage generator circuit 81. With this configuration, logarithmic terms are added up. Therefore, it is possible to substantially obtain an effect of exponentiation and realize the temperature control with a low size ratio. In this case, if one size parameter of the differential pair D1 is realized by $2K_1$ and only the differential pair D1 is used, an output voltage $V_o = V_2 - V_1$ is represented by the following Formula (41).

$$V_0 = \eta V_T \ln\left(\frac{2K_1}{K_2}\right)$$

If one size parameter of the differential pairs D1 and D2 is realized by $K_1$ and the differential pairs D1 and D2 are cascade-connected, the output voltage $V_o = V_2 - V_1$ is represented by the following Equation (36):

$$V_0 = \eta V_T \ln\left(\frac{K_1}{K_2}\right) + \eta V_T \ln\left(\frac{K_1}{K_2}\right) = \eta V_T \ln\left(\frac{K_1^2}{K_2^2}\right). \tag{36}$$

As apparent from the Equation (36), the temperature control with respect to the output voltage $V_o$ can be increased.

Figure 20:
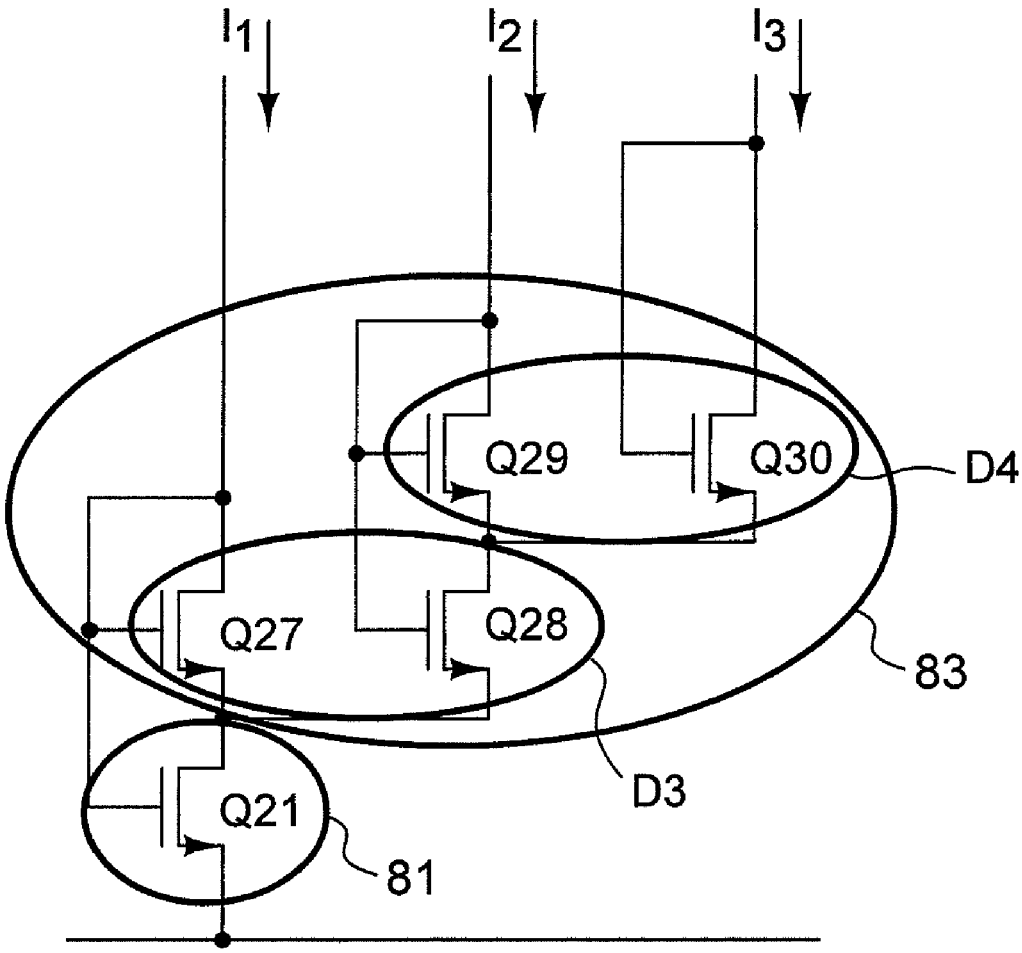
FIG. 20 is a circuit diagram showing a second example of the temperature control method according to the preferred embodiments of the present invention.

FIG. 20 is a circuit diagram showing a second example of the temperature control method according to the preferred embodiments of the present invention. A circuit of FIG. 20 shows a modified version of the temperature control method shown in FIG. 19. That is, in the circuit of FIG. 19, the differential pairs D1 and D2 are cascade-connected in a transverse direction. In the circuit of FIG. 20, at the subsequent stage of a bias voltage generator circuit 81 including a diode-connected MOSFET Q21, two differential pairs D3 (Q27, Q28) and D4 (Q29, Q30) are provided in a column fashion, and this leads to simplification of the circuit. In this case, Q27 and Q29 are provided to detect the gate-source voltage $V_{GS}$ of the diode-connected MOSFETs, respectively, and Q28 and Q30 are provided to output a voltage with the diode-connected MOSFET configurations.

Methods of configuring the reference current source circuit using various circuits will be described below.

First Preferred Embodiment

Figure 21:
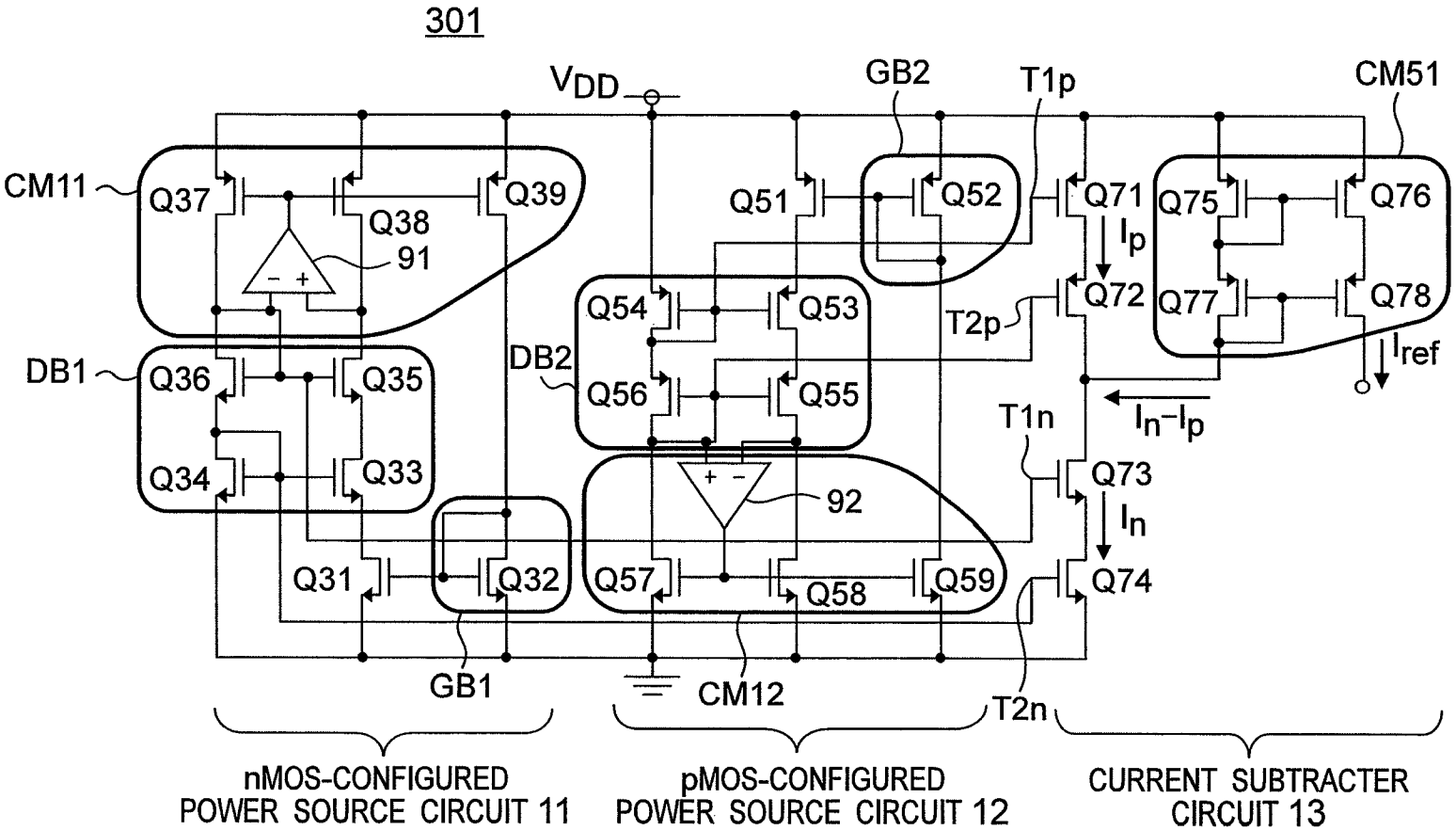
FIG. 21 is a circuit diagram showing a configuration of a reference current source circuit 301 according to a first preferred embodiment of the present invention.

FIG. 21 is a circuit diagram showing a configuration of a reference current source circuit 301 according to a first preferred embodiment of the present invention. As shown in FIG. 21, the reference current source circuit 301 according to the first preferred embodiment is configured to include an nMOS-configured power source circuit 11, a pMOS-configured power source circuit 12, and a current subtracter circuit 13. In this case, the nMOS-configured power source circuit 11 is provided for generating a current using a MOSFET Q31, in which the temperature characteristics of the output current from the nMOS-configured power source circuit 11 are dependent on an electron mobility. The nMOS-configured power source circuit 11 is configured to include the following:

(a) the nMOSFET Q31 generating the current;

(b) a gate bias voltage generator circuit GB1 including a diode-connected nMOSFET Q32, generating a gate bias voltage so that the nMOSFET Q31 operates in a strong inversion region, and applying the gate bias voltage to a gate of the nMOSFET Q31;

(c) a drain bias generator circuit DB1 including two pairs of nMOSFETs (Q33, Q34) and (Q35, Q36), and generating a drain bias to be applied to the nMOSFET Q31; and (d) a current mirror circuit CM11 including an operational amplifier 91 that is configured to include three pMOSFETs Q37 to Q39 and a CMOS circuit, and stably supplying a power source current. In the nMOS-configured power source circuit 11, the gate voltages of the nMOSFETs Q35 and Q36 are added up as a first voltage, which is applied to a gate of an nMOSFET Q73 of the current subtracter circuit 13 via a connection point T1*n*. The gates voltages of the nMOSFETs Q33 and Q34 are added up as a second voltage, which is applied to a gate of the nMOSFET Q74 of the current subtracter circuit 13 via a connection point T2*n*. The two nMOSFETs Q73 and Q74 connected in series generate a current $I_n$ corresponding to a current generated by the nMOS-configured power source circuit 11.

In addition, the pMOS-configured power source circuit 12 is formed to be complementary to the nMOS-configured power source circuit 11, and generates a current using a pMOSFET Q51, in which the temperature characteristics of the output current from the pMOS-configured power source circuit 12 are dependent on a hole mobility. The pMOS-configured power source circuit 12 is configured to include the following:

(a) a pMOSFET Q51 generating the current;

(b) a gate bias voltage generator circuit GB2 including a diode-connected pMOSFET Q52, generating a gate bias voltage so that the pMOSFET Q51 operates in the strong inversion region, and applying the gate bias voltage to a gate of the pMOSFET Q51;

(c) a drain bias generator circuit DB2 including two pairs of pMOSFETs (Q53, Q54) and (Q55, Q56), and generating a drain bias to be applied to the pMOSFET Q51; and (d) a current mirror circuit CM12 including an operational amplifier 92 that is configured to include three nMOSFETs Q57 to Q59 and a CMOS circuit, and stably supplying a power source current. In the pMOS-configured power source circuit 12, the gate voltages of the pMOSFETs Q53 and Q54 are added up as a third voltage, which is applied to a gate of a pMOSFET Q71 of the current subtracter circuit 13 via a connection point T1*p*. The gates voltages of the pMOSFETs Q55 and Q56 are added up as a fourth voltage, which is applied to a gate of an nMOSFET Q72 of the current subtracter circuit 13 via a connection point T2*p*. The two pMOSFETs Q71 and Q72 connected in series generate a current $I_p$ corresponding to a current generated by the pMOS-configured power source circuit 12.

In addition, the current subtracter circuit 13 is configured to include four MOSFETs Q71 to Q74 connected in series between a voltage source $V_{DD}$ and a ground, and a current mirror circuit CM51 configured to include four pMOSFETs Q75 to Q78. The subtracted current $(I_n-I_p)$ is obtained by connecting a drain of the pMOSFET Q77 of the current mirror circuit CM51 to a connection point between the two MOSFETs Q72 and Q73, and a reference output current $I_{ref}$ corresponding to the subtracted current $(I_n-I_p)$ and being constant with respect to a temperature change is obtained at a source of the nMOSFET Q78 of the current mirror circuit CM51.

An output current I from the reference current source circuit 301 configured as mentioned above is represented by the following Equation (37) based on the Equations (13) to (15) and (18):

$$I = KC_{OX}\mu(T_0)(T/T_0)^{-m}(\eta V_T)^2, \quad \text{where } K = \frac{K_R^2}{K_B}(\ln(K_1/K_2))^2. \tag{37}$$

Accordingly, the Equation (6) is represented by the following Equation (38):

$$f(T) = 1 - \frac{2-m_p}{2-m_n}\frac{K_p\mu_p(T_0)}{K_n\mu_n(T_0)}\left(\frac{T}{T_0}\right)^{m_n-m_p}. \tag{38}$$

Sizes Kn and Kp of the respective MOSFETs are set to satisfy a temperature function f(T)=0, and this leads to that the reference current source circuit 301 can generate the constant current with respect to the temperature change.

Second Preferred Embodiment

Figure 22:
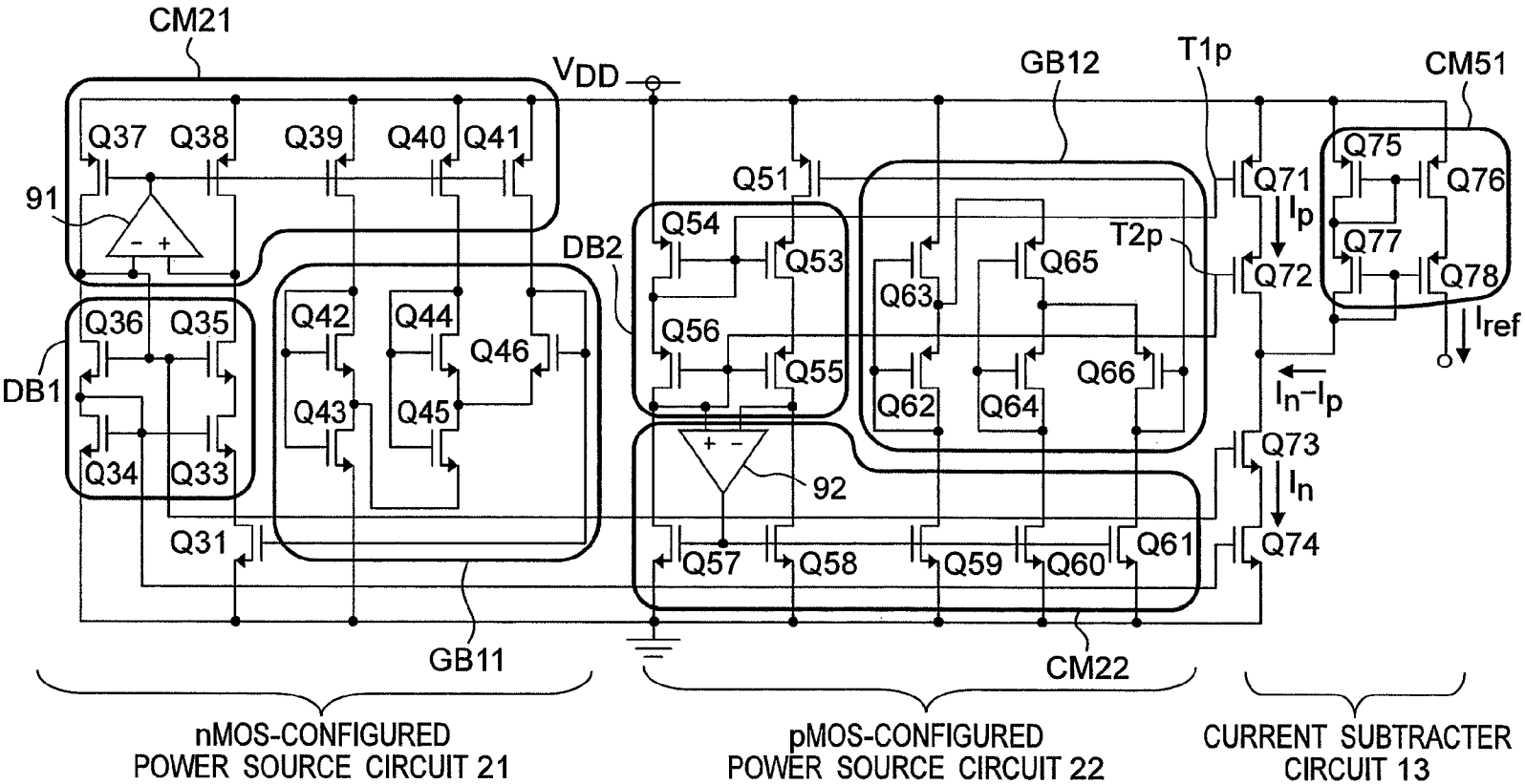
FIG. 22 is a circuit diagram showing a configuration of a reference current source circuit 302 according to a second preferred embodiment of the present invention.

FIG. 22 is a circuit diagram showing a configuration of a reference current source circuit 302 according to a second preferred embodiment of the present invention. As shown in FIG. 22, the reference current source circuit 302 according to the second preferred embodiment is configured to include an nMOS-configured power source circuit 21, a pMOS-configured power source circuit 22, and a current subtracter circuit 13. In this case, the nMOS-configured power source circuit 21 is provided for generating a current using a MOSFET Q31, in which the temperature characteristics of the output current from the nMOS-configured power source circuit 21 are dependent on an electron mobility. The nMOS-configured power source circuit 21 is configured to include the following:

(a) the nMOSFET Q31 generating the current;

(b) a gate bias voltage generator circuit GB11 for configuring two differential pairs using four nMOSFETs Q42 and Q44 to Q46, the gate bias voltage generator circuit GB11 further including an nMOSFET Q43, generating a gate bias voltage so that the nMOSFET Q31 operates in a strong inversion region, and applying the gate bias voltage to a gate of the nMOSFET Q31;

(c) a drain bias generator circuit DB1 including two pairs of nMOSFETs (Q33, Q34) and (Q35, Q36), and generating a drain bias to be applied to the nMOSFET Q31; and (d) a current mirror circuit CM21 including an operational amplifier 91 that is configured to include five pMOSFETs Q37 to Q41 and a CMOS circuit, and stably supplying a power source current. In the nMOS-configured power source circuit 21, the gate voltages of the nMOSFETs Q35 and Q36 are added up as a first voltage, which is applied to a gate of an nMOSFET Q73 of the current subtracter circuit 13 via a connection point T1*n*. The gates voltages of the nMOSFETs Q33 and Q34 are added up as a second voltage, which is applied to a gate of an nMOSFET Q74 of the current subtracter circuit 13 via a connection point T2*n*. The two nMOSFETs Q73 and Q74 connected in series generate a current $I_n$ corresponding to a current generated by the nMOS-configured power source circuit 21.

In addition, the pMOS-configured power source circuit 22 is formed to be complementary to the nMOS-configured power source circuit 21, and generates a current using a pMOSFET Q51, in which the temperature characteristics of the output current from the pMOS-configured power source circuit 22 are dependent on a hole mobility. The pMOS-configured power source circuit 22 is configured to include the following:

(a) the pMOSFET Q51 generating the current;

(b) a gate bias voltage generator circuit GB12 for configuring two differential pairs using four pMOSFETs Q62 and Q64 to Q66, the gate bias voltage generator circuit GB12 further including an pMOSFET Q63, generating a gate bias voltage so that the pMOSFET Q51 operates in the strong inversion region, and applying the gate bias voltage to a gate of the pMOSFET Q51;

(c) a drain bias generator circuit DB1 including two pairs of pMOSFETs (Q53, Q54) and (Q55, Q56), and generating a drain bias to be applied to the pMOSFET Q51; and (d) a current mirror circuit CM22 including an operational amplifier 92 that is configured to include five nMOSFETs Q57 to Q61 and a CMOS circuit, and stably supplying a power source current. In the pMOS-configured power source circuit 22, the gate voltages of the pMOSFETs Q53 and Q54 are added up as a third voltage, which is applied to a gate of the pMOSFET Q71 of the current subtracter circuit 13 via a connection point T1*p*. The gates voltages of the pMOSFETs Q55 and Q56 are added up as a fourth voltage, which is applied to a gate of the nMOSFET Q72 of the current subtracter circuit 13 via a connection point T2*p*. The two pMOSFETs Q71 and Q72 connected in series generate a current $I_p$ corresponding to a current generated by the pMOS-configured power source circuit 12.

In addition, the current subtracter circuit 13 is configured in a manner similar to that of the circuit of FIG. 21. The subtracted current ($I_n$−$I_p$) is obtained, and a reference output current $I_{ref}$ corresponding to the subtracted current ($I_n$−$I_p$) and being constant with respect to a temperature change is obtained at a source of the pMOSFET Q78 of the current mirror circuit CM51.

The temperature characteristics of the reference current source circuit 302 configured as mentioned above will be considered below. As shown in the Equations (19) and (23), the reference current source circuit 301 of FIG. 21 and the reference current source circuit 302 of FIG. 22 are identical in a temperature coefficient of the output current I.

Accordingly, even if the reference current source circuit 302 configured as shown in FIG. 22 is used, the gradient of the output current with respect to the temperature change can be represented by the Equation (5) or (6), in a manner similar to that of use of the reference current source circuit 301 of FIG. 21. That is, the output current I from the reference current source circuit 302 of FIG. 22 is represented by the following Equations (39) and (40) based on the Equations (21) and (22):

$$I=KC_{OX}\mu(T_0)(T/T_0)^{-m}\kappa T\eta V_T \quad (39), \text{ and}$$

$$K=K_R\ln(K_1/K_2) \quad (40).$$

Accordingly, the Equation (6) is represented by the following Equation (41):

$$f(T)=1-\frac{2-m_p}{2-m_n}\frac{K_p\kappa_p\mu_p(T_0)}{K_n\kappa_n\mu_n(T_0)}\left(\frac{T}{T_0}\right)^{m_n-m_p}. \quad (41)$$

In this case, sizes Kn and Kp of the respective MOSFETs are set to satisfy the temperature function f(T)=0, and this leads to that the reference current source circuit 302 can generate the constant current with respect to the temperature change. In addition, the output current from the reference current source circuit 302 of FIG. 22 is more stable against process variations than that from the reference current source circuit 301 of FIG. 21. Therefore, the influence of the process variations on the reference current source circuit 302 of FIG. 22 is smaller than that on the reference current source circuit 301 of FIG. 21.

The inventors of the present invention carried out a circuit simulation by SPICE so as to evaluate characteristics of the output currents from the reference current source circuits 301 and 302. The 0.35 μm-CMOS process is used, and the power source voltage was 2.5 V. In this case, in an evaluation of the temperature dependence of each output current, a circuit temperature was changed from −20° C. to 100° C., a change width of each output current in this case was divided by an average current, and a division result was calculated as a temperature change rate.

Figure 23:
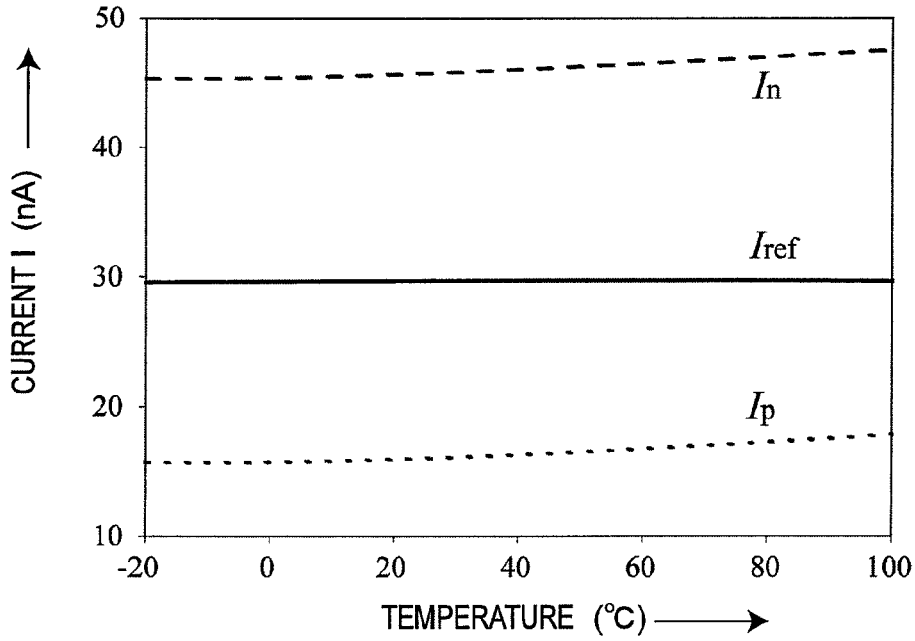
FIG. 23 is a graph showing the temperature dependence of the output current I from the reference current source circuit 301 of FIG. 21.

FIG. 23 is a graph showing the temperature dependence of the output current I from the reference current source circuit 301 of FIG. 21. FIG. 23 shows a change in the output current when the temperature of the reference current source circuit 301 was changed from −20° C. to 100° C. In FIG. 23, $I_n$ and $I_p$ denote the current generated by the nMOS-configured power source current 11 and the current generated by the pMOS-configured power source current 12, respectively. The currents $I_n$ and $I_p$ increase according to rise in temperature. The current obtained by calculating the difference between the currents $I_n$ and $I_p$ is the output current $I_{ref}$ from the entire circuit. As apparent from FIG. 23, the output current $I_{ref}$ was almost constant with respect to the temperature change. As a result of the simulation, the change width of the output current $I_{ref}$ was 0.14 nA, the average current was 29.7 nA, and the temperature change rate calculated from these was 0.47%. As compared with the fact that the temperature change rate of the output current from the reference current source circuit according to the first prior art is 8.62%, the reference current source circuit 301 can realize improvement of about 94.5%. It was confirmed from this that the reference current source circuit 301 can generate the constant current with respect to the temperature change by obtaining the difference ($I_n$–$I_p$) between the output currents $I_n$ and $I_p$ from the nMOS-configured power source circuit 11 and the pMOS-configured power source circuit 12 different in the temperature characteristics.

Figure 24:
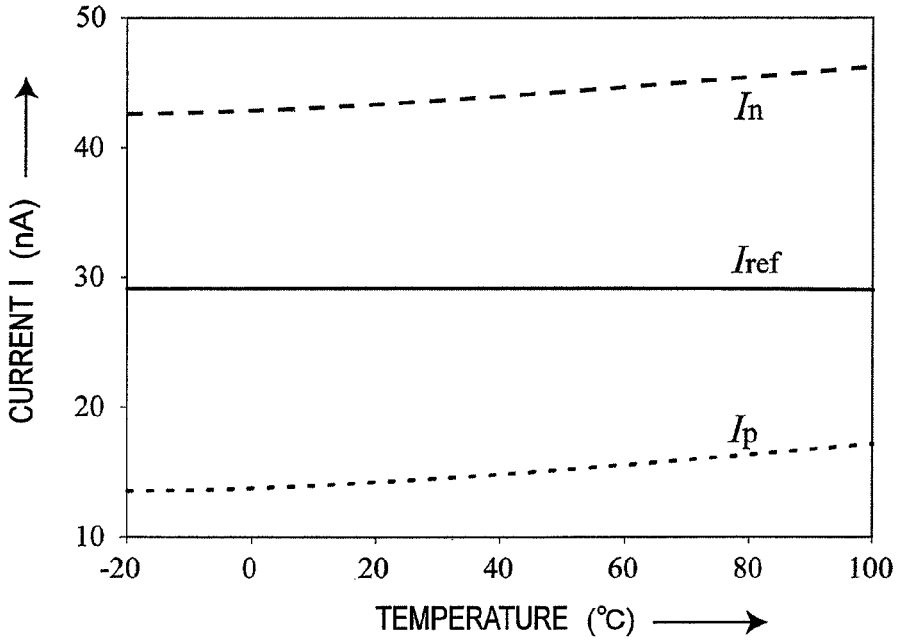
FIG. 24 is a graph showing the temperature dependence of the output current I from the reference current source circuit 302 of FIG. 22.

FIG. 24 is a graph showing the temperature dependence of the output current I from the reference current source circuit 302 of FIG. 22. FIG. 24 shows a change in the output current when the temperature of the reference current source circuit 302 was changed from −20° C. to 100° C. As apparent from FIG. 24, the output current $I_{ref}$ was almost constant with respect to the temperature change, the change width of the output current $I_{ref}$ is 0.10 nA, the average current was 29.1 nA. The temperature change rate calculated from these was 0.34%. As compared with the reference current source circuit according to the first prior art, the reference current source circuit 302 can realize improvement of about 96%. Therefore, it was confirmed that the reference current source circuit 302 could generate the constant current with respect to the temperature change.

The following implemental examples show results of simulations by designing six reference current source circuits 101 to 106, respectively.

FIRST IMPLEMENTAL EXAMPLE

Figure 25:
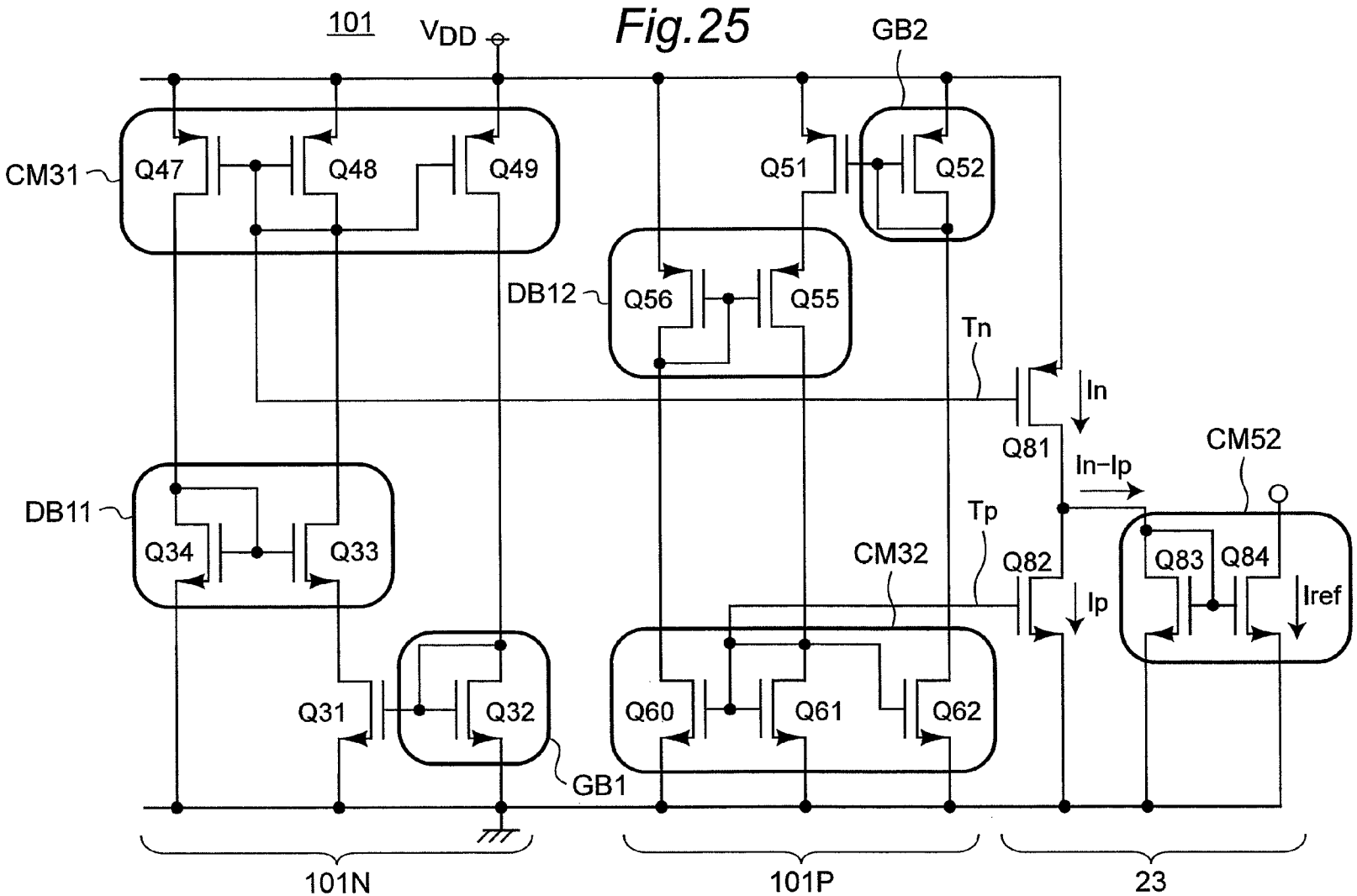
FIG. 25 is a circuit diagram showing a configuration of the reference source circuit 101 according to a first implemental example of the present invention.

FIG. 25 is a circuit diagram showing a configuration of the reference source circuit 101 according to a first implemental example of the present invention. As shown in FIG. 25, the reference source circuit 101 according to the first implemental example is configured to include an nMOS-configured power source circuit 101N, a pMOS-configured power source circuit 101P, and the current subtracter circuit 23. In this case, the nMOS-configured power source circuit 101N is provided for generating a current using the MOSFET Q31, in which the temperature characteristics of the output current from the nMOS-configured power source circuit 103N are dependent on the electron mobility. The nMOS-configured power source circuit 103N is configured to include the following:

(a) the nMOSFET Q31 generating the current;

(b) the gate bias voltage generator circuit GB1 including the diode-connected nMOSFET Q32, generating the gate bias voltage so that the nMOSFET Q31 operates in the strong inversion region, and applying the gate bias voltage to the gate of the nMOSFET Q31;

(c) the drain bias generator circuit DB11 including the pair of nMOSFETs (Q33, Q34), and generating the drain bias to be applied to the nMOSFET Q31; and (d) a current mirror circuit CM31 including three pMOSFETs Q47 to Q49, and stably supplying a power source current. In the nMOS-configured power source circuit 101N, the gate voltages of the nMOSFETs Q47 and Q48 are added up as the first voltage, which is applied to a gate of an nMOSFET Q81 of the current subtracter circuit 23 via a connection point Tn. The nMOSFET Q81 generates the current $I_n$ corresponding to a current generated by the nMOS-configured power source circuit 101N.

In addition, the pMOS-configured power source circuit 101P is formed to be complementary to the nMOS-configured power source circuit 101N, and generates a current using the pMOSFET Q51, in which the temperature characteristics of the output current from the pMOS-configured power source circuit 101P are dependent on the hole mobility. The pMOS-configured power source circuit 101P is configured to include the following:

(a) the pMOSFET Q51 generating the current;

(b) the gate bias voltage generator circuit GB2 including the diode-connected pMOSFET Q52, generating the gate bias voltage so that the pMOSFET Q51 operates in the strong inversion region, and applying the gate bias voltage to the gate of the pMOSFET Q51;

(c) the drain bias generator circuit DB12 including the pair of pMOSFETs (Q55, Q56), and generating the drain bias to be applied to the pMOSFET Q51; and (d) a current mirror circuit CM32 including three nMOSFETs Q60 to Q62, and stably supplying a power source current. In the pMOS-configured power source circuit 101P, the gate voltages of the pMOSFETs Q60 and Q61 are added up as the second voltage, which is applied to a gate of a pMOSFET Q82 of the current subtracter circuit 23 via a connection point Tp. The pMOSFET Q82 generates the current $I_p$ corresponding to a current generated by the pMOS-configured power source circuit 101P.

In addition, the current subtracter circuit 23 is configured to include four MOSFETs Q81 to Q82 connected in series between a voltage source $V_{DD}$ and a ground, and a current mirror circuit CM52 configured to include two nMOSFETs Q83 and Q84. The subtracted current ($I_n$–$I_p$) is obtained by connecting a drain of the nMOSFET Q83 of the current mirror circuit CM52 to a connection point between the two MOSFETs Q81 and Q82, and a reference output current $I_{ref}$ corresponding to the subtracted current ($I_n$–$I_p$) and being constant with respect to a temperature change is obtained at a source of the nMOSFET Q84 of the current mirror circuit CM52.

SECOND IMPLEMENTAL EXAMPLE

Figure 26:
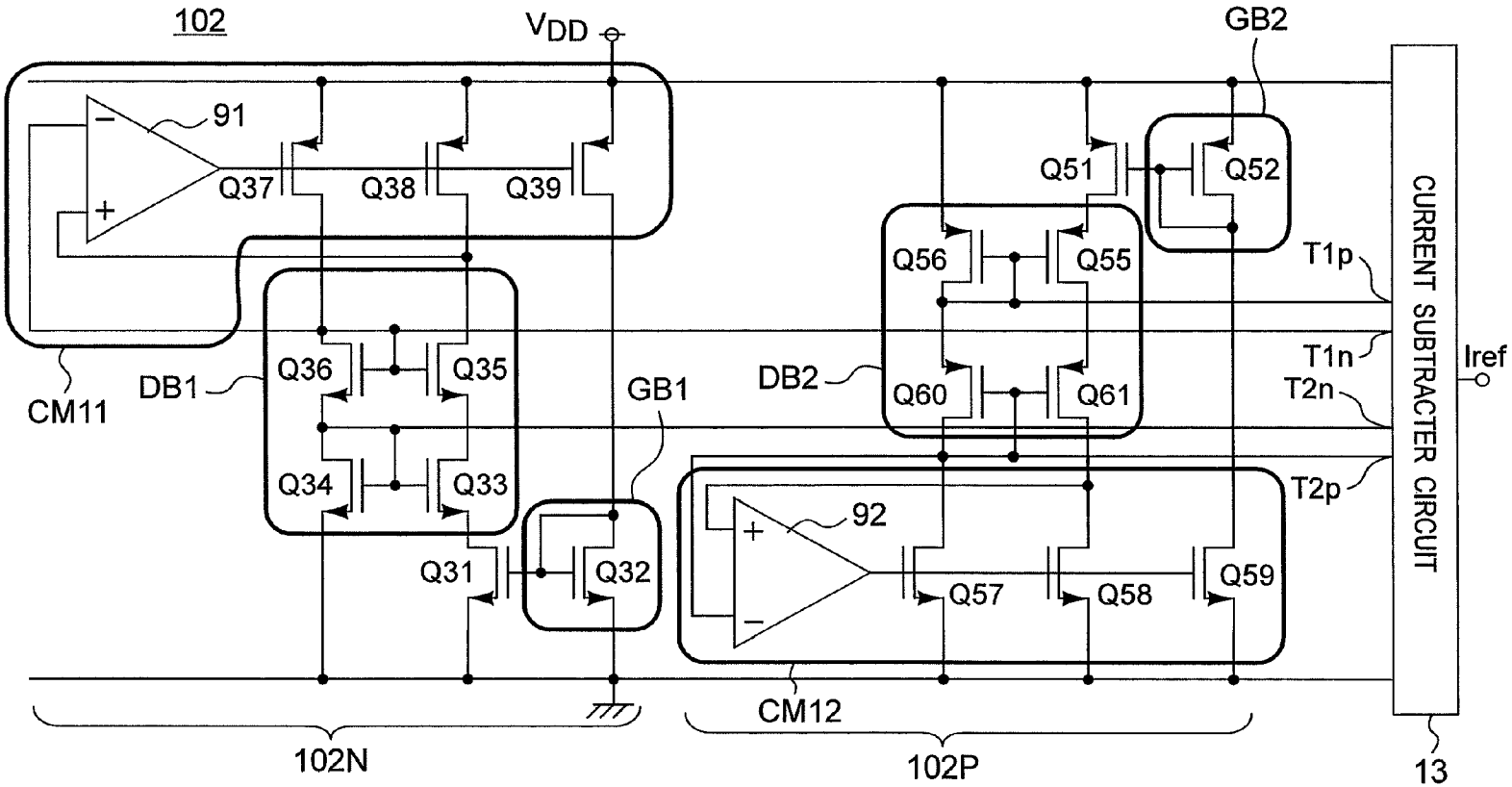
FIG. 26 is a circuit diagram showing a configuration of the reference source circuit 102 according to a second implemental example of the present invention.

FIG. 26 is a circuit diagram showing a configuration of the reference source circuit 102 according to a second implemental example of the present invention. As shown in FIG. 26, the reference source circuit 102 according to the second implemental example is configured to include an nMOS-configured power source circuit 102N, a pMOS-configured power source circuit 102P, and the current subtracter circuit 13 of FIG. 21. In this case, the nMOS-configured power source circuit 102N is provided for generating a current using the MOSFET Q31, in which the temperature characteristics of the output current from the nMOS-configured power source circuit 102N are dependent on the electron mobility. The nMOS-configured power source circuit 101N is configured to include the following:

(a) the nMOSFET Q31 generating the current;

(b) the gate bias voltage generator circuit GB1 including the diode-connected nMOSFET Q32, generating the gate bias voltage so that the nMOSFET Q31 operates in the strong inversion region, and applying the gate bias voltage to the gate of the nMOSFET Q31;

(c) the drain bias generator circuit DB1 including the two pairs of nMOSFETs (Q33, Q34) and (Q35, Q36), and generating the drain bias to be applied to the nMOSFET Q31; and (d) the current mirror circuit CM11 including the operational amplifier 91 that is configured to include the three pMOSFETs Q37 to Q39 and the CMOS circuit, and stably supplying a power source current. In the nMOS-configured power source circuit 102N, the gate voltages of the nMOSFETs Q35 and Q36 are added up as the first voltage, which is applied to the gate of the nMOSFET Q73 of the current subtracter circuit 13 via the connection point T1*n*. The gates voltages of the nMOSFETs Q33 and Q34 are added up as the second voltage, which is applied to the gate of the nMOSFET Q74 of the current subtracter circuit 13 via the connection point T2*n*. The two nMOSFETs Q73 and Q74 connected in series generate the current $I_n$ corresponding to a current generated by the nMOS-configured power source circuit 102N.

In addition, the pMOS-configured power source circuit 102P is formed to be complementary to the nMOS-configured power source circuit 101N, and generates a current using the pMOSFET Q51, in which the temperature characteristics of the output current from the pMOS-configured power source circuit 102P are dependent on the hole mobility. The pMOS-configured power source circuit 102P is configured to include the following:

(a) the pMOSFET Q51 generating the current;

(b) the gate bias voltage generator circuit GB2 including the diode-connected pMOSFET Q52, generating the gate bias voltage so that the pMOSFET Q51 operates in the strong inversion region, and applying the gate bias voltage to the gate of the pMOSFET Q51;

(c) the drain bias generator circuit DB2 including the two pairs of pMOSFETs (Q55, Q56) and (Q60, Q61), and generating the drain bias to be applied to the pMOSFET Q51; and (d) the current mirror circuit CM12 including the operational amplifier 92 that is configured to include the three nMOSFETs Q57 to Q59 and the CMOS circuit, and stably supplying a power source current. In the pMOS-configured power source circuit 102P, the gate voltages of the pMOSFETs Q55 and Q56 are added up as the third voltage, which is applied to the gate of the pMOSFET Q71 of the current subtracter circuit 13 via the connection point T1*p*. The gates voltages of the pMOSFETs Q60 and Q61 are added up as the fourth voltage, which is applied to the gate of the nMOSFET Q72 of the current subtracter circuit 13 via the connection point T2*p*. The two pMOSFETs Q71 and Q72 connected in series generate the current $I_p$ corresponding to a current generated by the pMOS-configured power source circuit 102P.

In addition, the current subtracter circuit 13 is configured in a manner similar to that of the circuits of FIGS. 21 and 22. The subtracted current ($I_n$–$I_p$) is obtained, and a reference output current $I_{ref}$ corresponding to the subtracted current ($I_n$–$I_p$) and being constant with respect to a temperature change is obtained.

In particular, in the second implemental example, the operational amplifiers 91 and 92 are used in the current mirror circuits CM11 and CM12, respectively, and this leads to that it is possible to suppress a characteristic change in the current flowing in the circuit even if the power source voltage $V_{DD}$ changes. If the operational amplifiers 91 and 92 are not provided, a drain voltage of the pMOS current mirror circuit CM11, for example, often changes. This change in the drain voltage causes a change in the current. Therefore, by using the operational amplifier 91, it is advantageously possible to make drain voltages of the two transistors be identical and to make currents thereof be identical.

Considering the diode-connected pMOSFET and the current mirror circuit that receives the voltage generated by the diode-connected pMOSFET and that generates a current, a drain voltage of the diode-connected pMOSFET is almost fixed but the other is not fixed. This drain voltage of the MOSFET possibly changes greatly if the power source changes. In that case, accuracy of the current mirror is possibly deteriorated. In order to avoid this, the operational amplifiers 91 and 92 are used. It is not necessary for the pMOS transistors Q39 and Q59 supplying currents to the gate bias voltage generator circuits GB1 and GB2, respectively, to have so high accuracy. Therefore, it is considered that even changes of currents to some extent have less influence on the pMOS transistors Q39 and Q59.

The functions and advantageous effects of the operational amplifiers 91 and 92 can be applied to fourth and sixth implemental examples and the first and second preferred embodiments.

THIRD IMPLEMENTAL EXAMPLE

Figure 27:
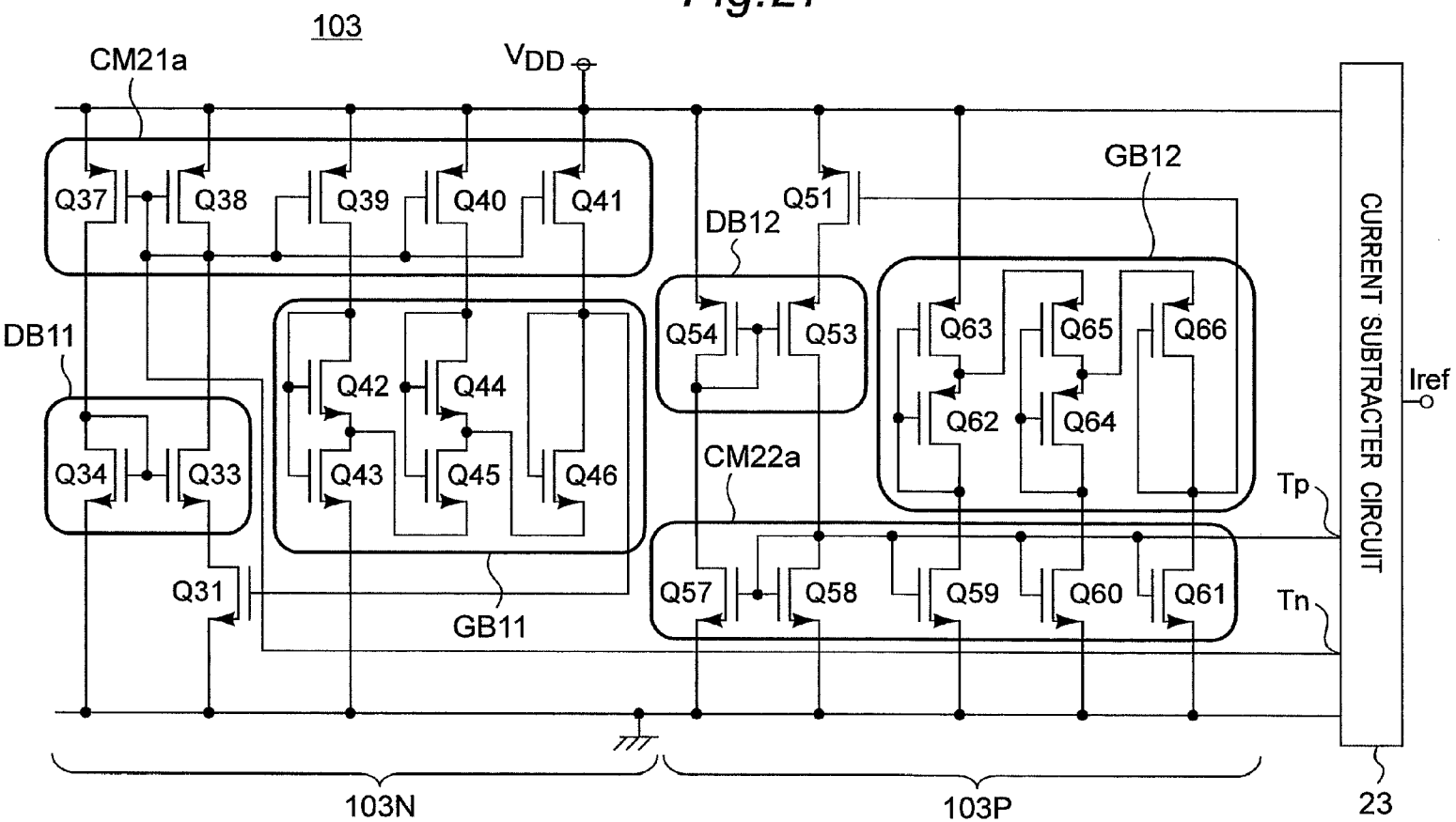
FIG. 27 is a circuit diagram showing a configuration of the reference source circuit 103 according to a third implemental example of the present invention.

FIG. 27 is a circuit diagram showing a configuration of the reference source circuit 103 according to a third implemental example of the present invention. As shown in FIG. 27, the reference source circuit 103 according to the third implemental example is configured to include an nMOS-configured power source circuit 103N, a pMOS-configured power source circuit 103P, and the current subtracter circuit 23 of FIG. 25. In this case, the nMOS-configured power source circuit 103N is provided for generating a current using the MOSFET Q31, in which the temperature characteristics of the output current from the nMOS-configured power source circuit 103N are dependent on the electron mobility. The nMOS-configured power source circuit 103N is configured to include the following:

(a) the nMOSFET Q31 generating the current;

(b) a gate bias voltage generator circuit GB11 for configuring two differential pairs using four nMOSFETs Q42 and Q44 to Q46, the gate bias voltage generator circuit GB11 further including an nMOSFET Q43, generating a gate bias voltage so that the nMOSFET Q31 operates in the strong inversion region, and applying the gate bias voltage to the gate of the nMOSFET Q31;

(c) the drain bias generator circuit DB11 including the pair of nMOSFETs (Q33, Q34), and generating the drain bias to be applied to the nMOSFET Q31; and (d) a current mirror circuit CM21*a* including five pMOSFETs Q37 to Q41, and stably supplying a power source current. In the nMOS-configured power source circuit 103N, the gate voltages of the nMOSFETs Q37 and Q38 are added up as the first voltage, which is applied to the current subtracter circuit 23 via the connection point Tn, and this leads to that the nMOS-configured power source circuit 103N generates the current $I_n$.

In addition, the pMOS-configured power source circuit 103P is formed to be complementary to the nMOS-configured power source circuit 103N, and generates a current using the pMOSFET Q51, in which the temperature characteristics of the output current from the pMOS-configured power source circuit 103P are dependent on the hole mobility. The pMOS-configured power source circuit 103P is configured to include the following:

(a) the pMOSFET Q51 generating the current;

(b) a gate bias voltage generator circuit GB12 for configuring two differential pairs using four pMOSFETs Q62 and Q64 to Q66, the gate bias voltage generator circuit GB12 further including an pMOSFET Q63, generating a gate bias voltage so that the pMOSFET Q51 operates in the strong inversion region, and applying the gate bias voltage to the gate of the pMOSFET Q51;

(c) the drain bias generator circuit DB12 including the pair of pMOSFETs (Q53, Q54), and generating the drain bias to be applied to the pMOSFET Q51; and (d) a current mirror circuit CM22*a* including five nMOSFETs Q57 to Q61, and stably supplying a power source current. In the pMOS-configured power source circuit 103P, the gate voltages of the pMOSFETs Q57 and Q58 are added up as the second voltage, which is applied to the current subtracter circuit 13 via the connection point T1*p*, and this leads to that the pMOS-configured power source circuit 103P generates the current $I_p$.

Figure 9:
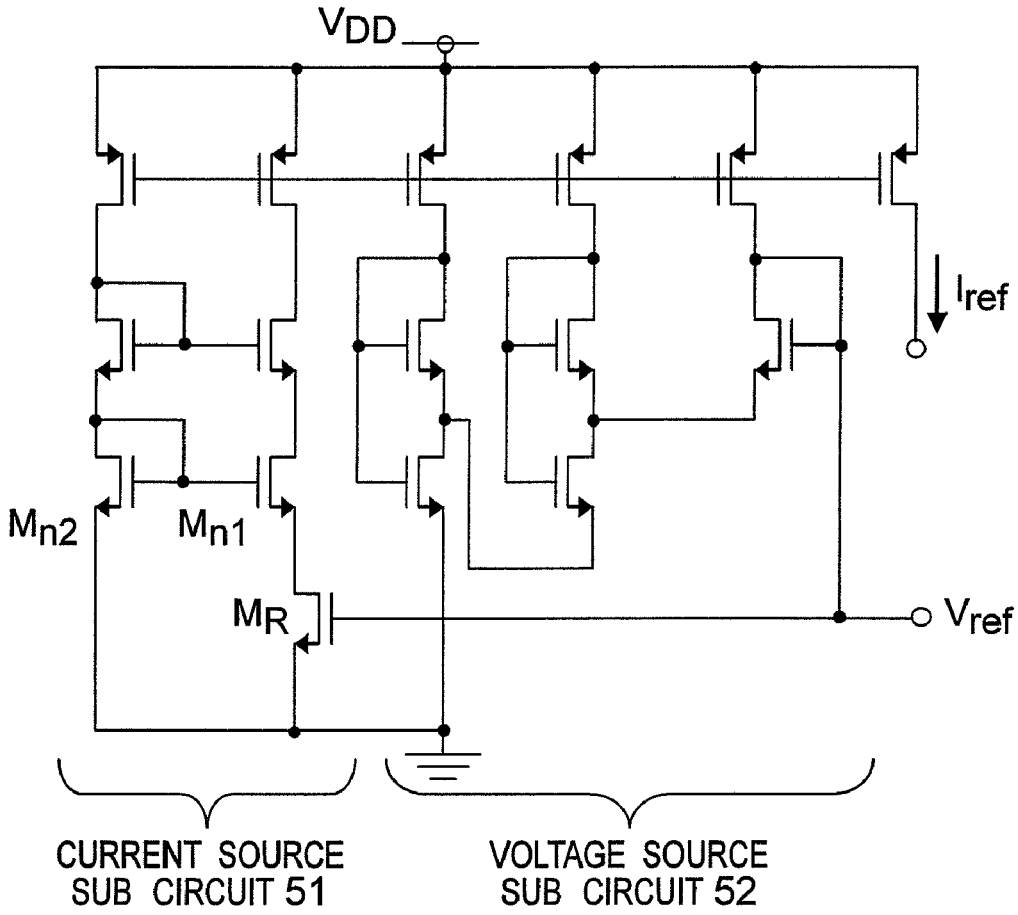
Fig.9 PRIOR ART
FIG. 9 is a circuit diagram showing a configuration of a reference voltage source circuit according to a second prior art.
Figure 10:
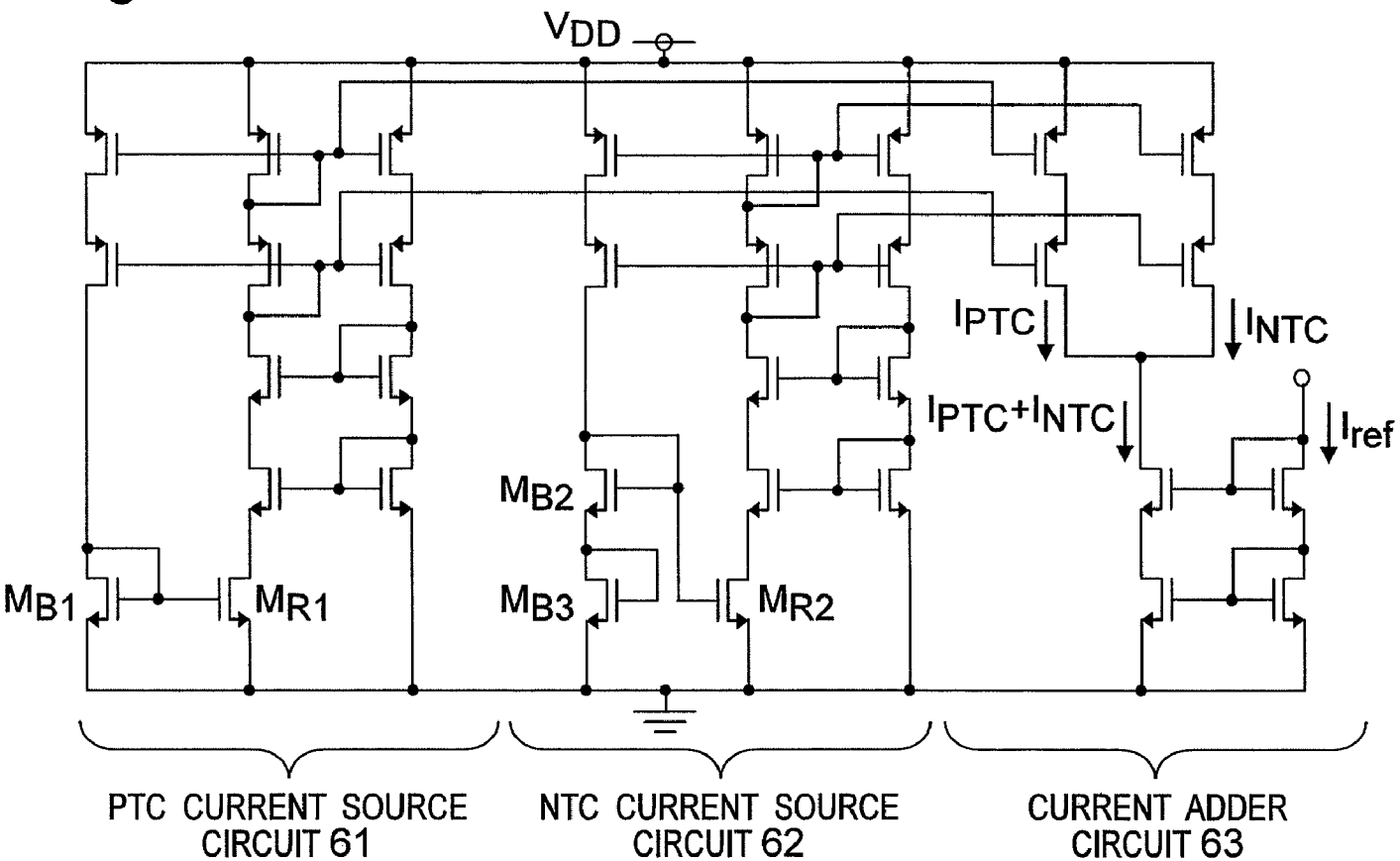
Fig.10 PRIOR ART
FIG. 10 is a circuit diagram showing a configuration of a reference current source circuit according to a third prior art.
Figure 11A:
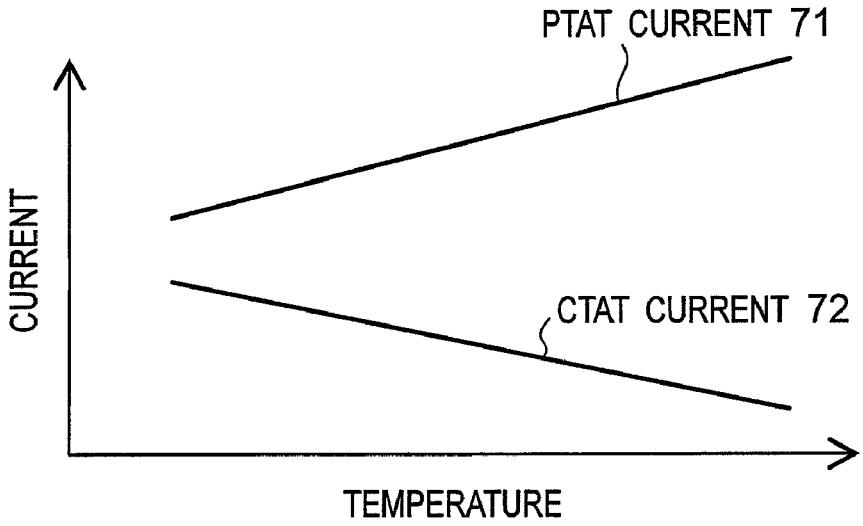
Fig.11A PRIOR ART
FIG. 11A is a chart showing a method of generating a constant current according to the prior art, that is, a graph showing temperature changes of a PTAT (Proportional To Absolute Temperature) current 71 that increases in proportion to the temperature and a CTAT (Conversely Proportional To Absolute Temperature) current 72 that decreases in proportion to the temperature.
Figure 11B:
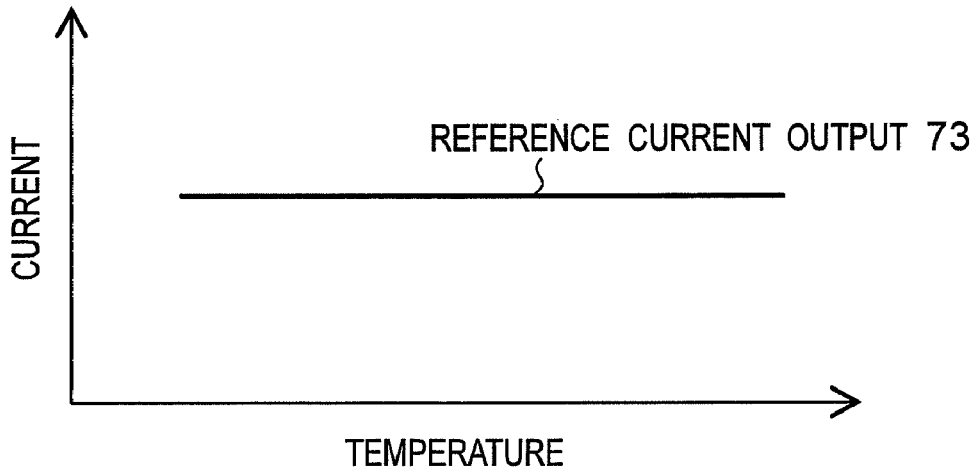
Fig.11B PRIOR ART
FIG. 11B is a graph showing that the constant current is obtained by adding up the PTAT current 71 and the CTAT current 72 of FIG. 11A.
Figure 12A:
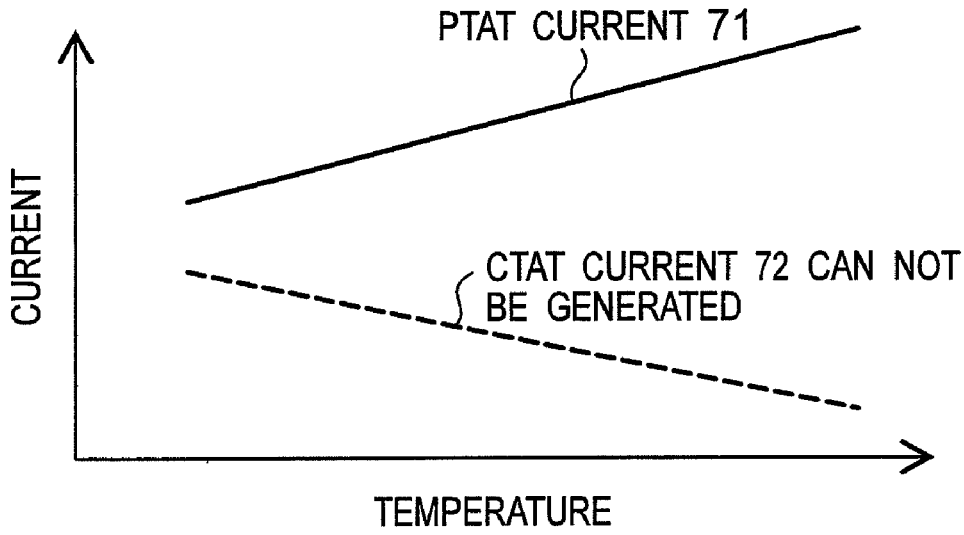
Fig.12A PRIOR ART
FIG. 12A is a graph showing that a minute current generator circuit according to the prior art cannot generate the CTAT current 72.
Figure 12B:
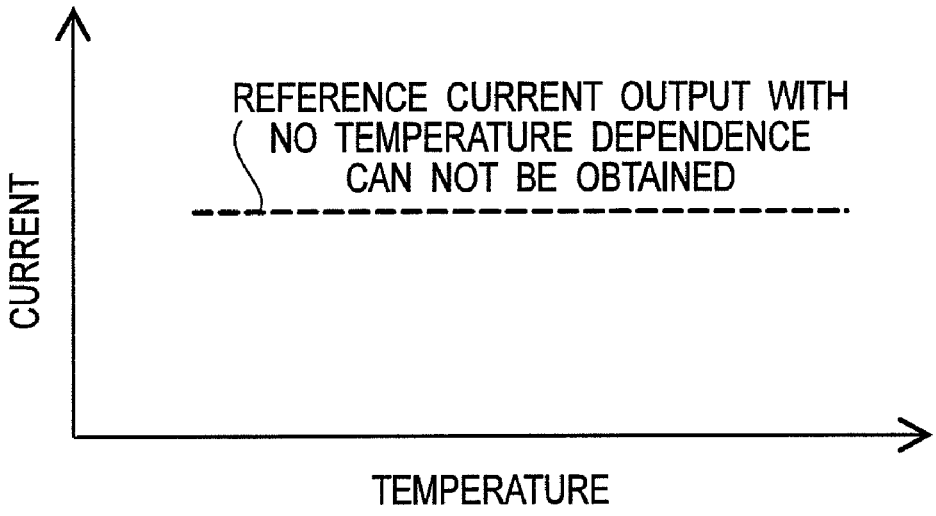
Fig.12B PRIOR ART
FIG. 12B is a graph showing that the minute current generator circuit according to the prior art cannot obtain a reference current output without temperature dependence as a result of FIG. 12A.

In addition, the current subtracter circuit 23 is configured in a manner similar to that of the circuit of FIG. 25. The subtracted current ($I_p$–$I_p$) is obtained, and a reference output current $I_{ref}$ corresponding to the subtracted current ($I_p$–$I_p$) and being constant with respect to a temperature change is obtained. In particular, in the third implemental example, the voltage source circuit is configured by using the two differential pairs in view of the consideration with reference to FIG. 9 in each of the gate bias voltage generator circuits GB11 and GB12. Therefore, as shown in the Equations (21) and (22), the reference current source circuit 103 is stable with respect to process variations. Accordingly, as compared with the first and second implemental examples, the reference current source circuit 103 can advantageously output the output current with reducing the influence of the process variations.

FOURTH IMPLEMENTAL EXAMPLE

Figure 28:
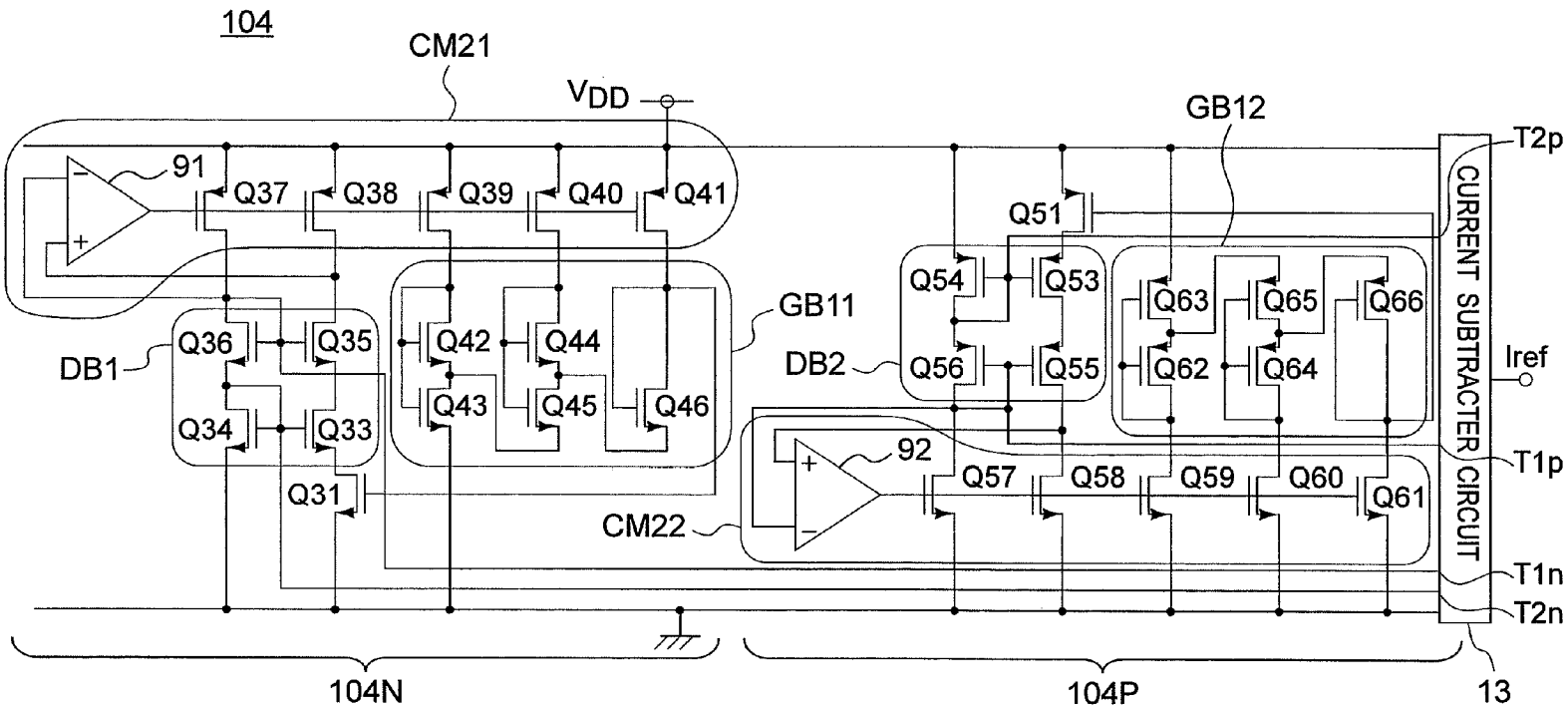
FIG. 28 is a circuit diagram showing a configuration of the reference source circuit 104 according to a fourth implemental example of the present invention.

FIG. 28 is a circuit diagram showing a configuration of the reference source circuit 104 according to a fourth implemental example of the present invention. As shown in FIG. 28, the reference source circuit 104 according to the fourth implemental example is configured to include an nMOS-configured power source circuit 104N, a pMOS-configured power source circuit 104P, and the current subtracter circuit 13 of FIG. 21. In this case, the nMOS-configured power source circuit 104N is provided for generating a current using the MOSFET Q31, in which the temperature characteristics of the output current from the nMOS-configured power source circuit 104N are dependent on the electron mobility. The nMOS-configured power source circuit 104N is configured to include the following:

(a) the nMOSFET Q31 generating the current;

(b) a gate bias voltage generator circuit GB11 for configuring two differential pairs using four nMOSFETs Q42 and Q44 to Q46, the gate bias voltage generator circuit GB11 further including an nMOSFET Q43, generating a gate bias voltage so that the nMOSFET Q31 operates in the strong inversion region, and applying the gate bias voltage to the gate of the nMOSFET Q31;

(c) the drain bias generator circuit DB1 including the two pairs of nMOSFETs (Q33, Q34) and (Q35, Q36), and generating the drain bias to be applied to the nMOSFET Q31; and (d) the current mirror circuit CM21 including the operational amplifier 91 that is configured to include the five pMOSFETs Q37 to Q41 and the CMOS circuit, and stably supplying a power source current. In the nMOS-configured power source circuit 104N, the gate voltages of the nMOSFETs Q35 and Q36 are added up as the first voltage, which is applied to the gate of the nMOSFET Q73 of the current subtracter circuit 13 via the connection point T1*n*. The gates voltages of the nMOSFETs Q33 and Q34 are added up as the second voltage, which is applied to the gate of the nMOSFET Q74 of the current subtracter circuit 13 via the connection point T2*n*. The two nMOSFETs Q73 and Q74 connected in series generate the current $I_n$ corresponding to a current generated by the nMOS-configured power source circuit 104N.

In addition, the pMOS-configured power source circuit 104P is formed to be complementary to the nMOS-configured power source circuit 104N, and generates a current using the pMOSFET Q51, in which the temperature characteristics of the output current from the pMOS-configured power source circuit 104P are dependent on the hole mobility. The pMOS-configured power source circuit 104P is configured to include the following:

(a) the pMOSFET Q51 generating the current;

(b) a gate bias voltage generator circuit GB12 for configuring two differential pairs using four pMOSFETs Q62 and Q64 to Q66, the gate bias voltage generator circuit GB12 further including an pMOSFET Q63, generating a gate bias voltage so that the pMOSFET Q51 operates in the strong inversion region, and applying the gate bias voltage to the gate of the pMOSFET Q51;

(c) the drain bias generator circuit DB2 including the two pairs of pMOSFETs (Q53, Q54) and (Q55, Q56), and generating the drain bias to be applied to the pMOSFET Q51; and (d) the current mirror circuit CM22 including the operational amplifier 92 that is configured to include the five nMOSFETs Q57 to Q61 and the CMOS circuit, and stably supplying a power source current. In the pMOS-configured power source circuit 104P, the gate voltages of the pMOSFETs Q53 and Q54 are added up as a third voltage, which is applied to a gate of the pMOSFET Q71 of the current subtracter circuit 13 via a connection point T1*p*. The gates voltages of the pMOSFETs Q55 and Q56 are added up as a fourth voltage, which is applied to a gate of the nMOSFET Q72 of the current subtracter circuit 13 via a connection point T2*p*. The two pMOSFETs Q71 and Q72 connected in series generate a current $I_p$ corresponding to a current generated by the pMOS-configured power source circuit 104P.

In addition, the current subtracter circuit 13 is configured in a manner similar to that of the circuit of FIG. 21. The subtracted current ($I_n$–$I_p$) is obtained, and a reference output current $I_{ref}$ corresponding to the subtracted current ($I_n$–$I_p$) and being constant with respect to a temperature change is obtained. In particular, in the fourth implemental example, the voltage source circuit is configured by using the two differential pairs in view of the consideration with reference to FIG. 9 in each of the gate bias voltage generator circuits GB11 and GB12. Therefore, as shown in the Equations (21) and (22), the reference current source circuit 104 is stable with respect to process variations. Accordingly, as compared with the first and second implemental examples, the reference current source circuit 104 can advantageously output the output current with reducing the influence of the process variations.

FIFTH IMPLEMENTAL EXAMPLE

Figure 29:
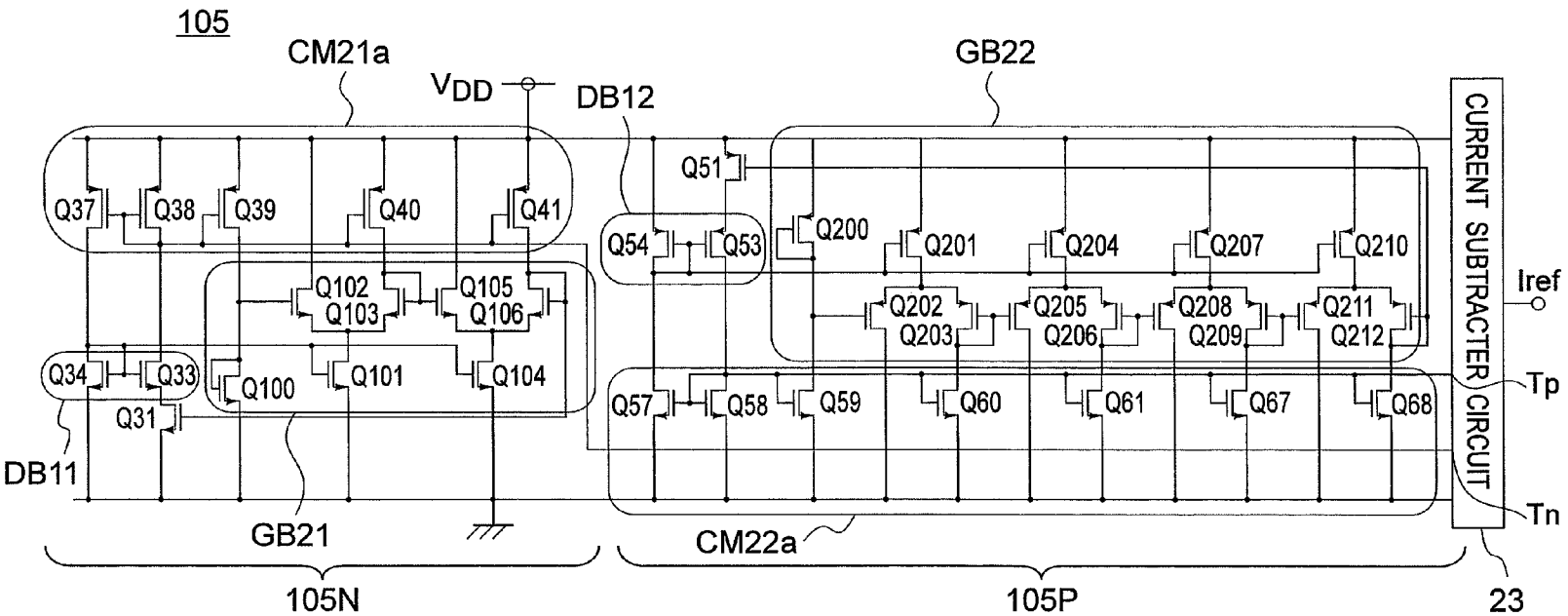
FIG. 29 is a circuit diagram showing a configuration of the reference source circuit 105 according to a fifth implemental example of the present invention.

FIG. 29 is a circuit diagram showing a configuration of the reference source circuit 105 according to a fifth implemental example of the present invention. As shown in FIG. 29, the reference source circuit 105 according to the fifth implemental example is configured to include an nMOS-configured power source circuit 105N, a pMOS-configured power source circuit 105P, and the current subtracter circuit 23 of FIG. 25. In this case, the nMOS-configured power source circuit 105N is provided for generating a current using the MOSFET Q31, in which temperature characteristics of the output current from the nMOS-configured power source circuit 105N are dependent on the electron mobility. The nMOS-configured power source circuit 105N is configured to include the following:

(a) the nMOSFET Q31 generating the current;

(b) the gate bias voltage generator circuit GB21 including the diode-connected nMOSFET Q100 and the two differential pair circuits (Q101 to Q103) and (Q104 to Q106), generating the gate bias voltage so that the nMOSFET Q31 operates in the strong inversion region, and applying the gate bias voltage to the gate of the nMOSFET Q31;

(c) the drain bias generator circuit DB11 including the pair of nMOSFETs (Q33, Q34), and generating the drain bias to be applied to the nMOSFET Q31; and (d) a current mirror circuit CM21*a* including five pMOSFETs Q37 to Q41, and stably supplying a power source current. In the nMOS-configured power source circuit 105N, the gate voltages of the nMOSFETs Q37 and Q38 are added up as the first voltage, which is applied to the current subtracter circuit 23 via the connection point Tn, and this leads to that the nMOS-configured power source circuit 105N generates the current $I_n$.

In addition, the pMOS-configured power source circuit 105P is formed to be complementary to the nMOS-configured power source circuit 105N, and generates a current using the pMOSFET Q51, in which the temperature characteristics of the output current from the pMOS-configured power source circuit 105P are dependent on the hole mobility. The pMOS-configured power source circuit 105P is configured to include the following:

(a) the pMOSFET Q51 generating the current;

(b) the gate bias voltage generator circuit GB22 including the diode-connected nMOSFET Q200 and the four differential pair circuits (Q201 to Q203), (Q204 to Q206), (Q207 to Q209), and (Q210 to Q212), generating the gate bias voltage so that the pMOSFET Q51 operates in the strong inversion region, and applying the gate bias voltage to the gate of the pMOSFET Q51;

(c) the drain bias generator circuit DB12 including the pair of pMOSFETs (Q53, Q54), and generating the drain bias to be applied to the pMOSFET Q51; and (d) a current mirror circuit CM22*a* including seven nMOSFETs Q57 to Q61, Q67, and Q68 stably supplying a power source current. In the pMOS-configured power source circuit 105P, the gate voltages of the pMOSFETs Q53 and Q54 are added up as the second voltage, which is applied to the current subtracter circuit 23 via the connection point Tp, and this leads to that the pMOS-configured power source circuit 105P generates the current $I_p$.

In addition, the current subtracter circuit 23 is configured in a manner similar to that of the circuit of FIG. 25. The subtracted current ($I_n$–$I_p$) is obtained, and a reference output current $I_{ref}$ corresponding to the subtracted current ($I_n$–$I_p$) and being constant with respect to a temperature change is obtained. In particular, in the fifth implemental example, the voltage source circuit is configured by using the two differential pairs in view of the consideration with reference to FIG. 9 in each of the gate bias voltage generator circuits GB11 and GB12. Therefore, as shown in the Equations (21) and (22), the reference current source circuit 105 is stable with respect to process variations. Accordingly, as compared with the first and second implemental examples, the reference current source circuit 105 can advantageously output the output current with reducing the influence of the process variations.

SIXTH IMPLEMENTAL EXAMPLE

Figure 30:
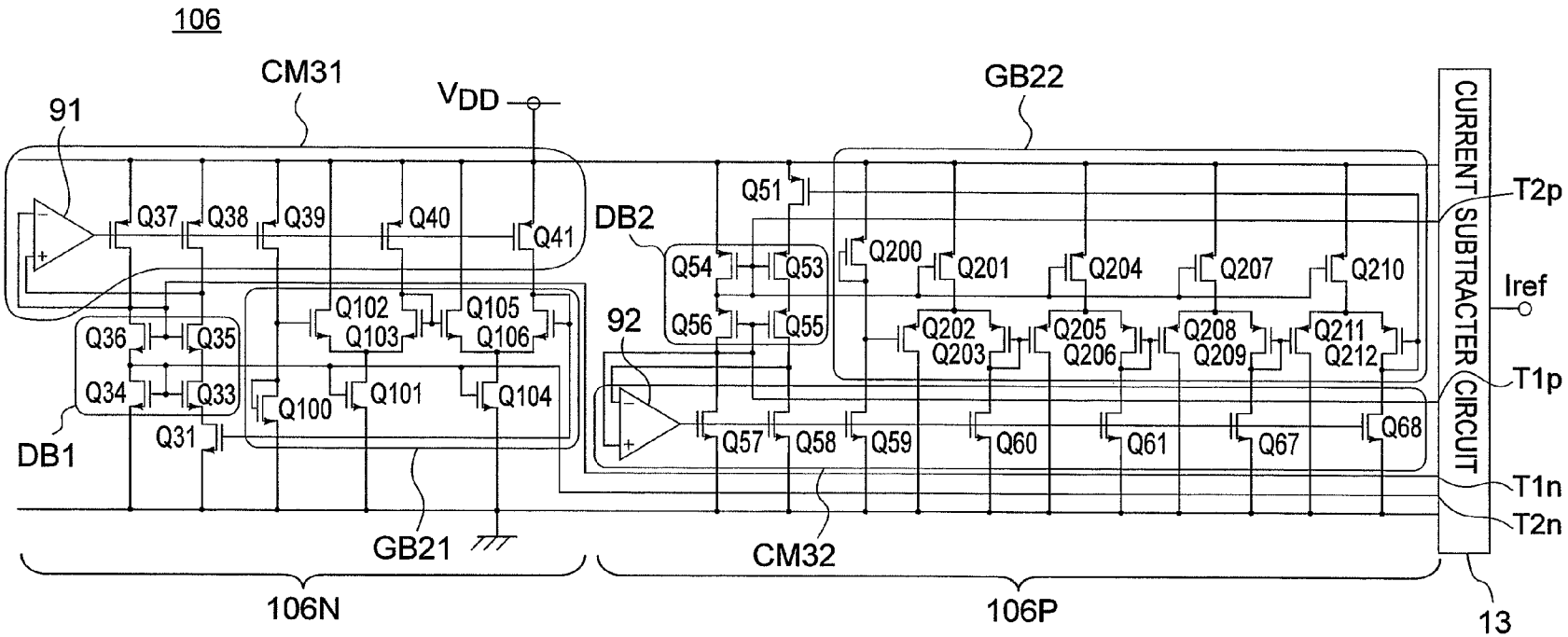
FIG. 30 is a circuit diagram showing a configuration of the reference source circuit 106 according to a sixth implemental example of the present invention.

FIG. 30 is a circuit diagram showing a configuration of the reference source circuit 106 according to a sixth implemental example of the present invention. As shown in FIG. 30, the reference source circuit 106 according to the sixth implemental example is configured to include an nMOS-configured power source circuit 106N, a pMOS-configured power source circuit 106P, and the current subtracter circuit 13. In this case, the nMOS-configured power source circuit 106N is provided for generating a current using the MOSFET Q31, in which the temperature characteristics of the output current from the nMOS-configured power source circuit 106N are dependent on the electron mobility. The nMOS-configured power source circuit 106N is configured to include the following:

(a) the nMOSFET Q31 generating the current;

(b) the gate bias voltage generator circuit GB21 including the diode-connected nMOSFET Q100 and the two differential pair circuits (Q101 to Q103) and (Q104 to Q106), generating the gate bias voltage so that the nMOSFET Q31 operates in the strong inversion region, and applying the gate bias voltage to the gate of the nMOSFET Q31;

(c) the drain bias generator circuit DB1 including the two pairs of nMOSFETs (Q33, Q34) and (Q35, Q36), and generating the drain bias to be applied to the nMOSFET Q31; and (d) the current mirror circuit CM31 including the operational amplifier 91 that is configured to include the five pMOSFETs Q37 to Q41 and the CMOS circuit, and stably supplying a power source current. In the nMOS-configured power source circuit 106N, the gate voltages of the nMOSFETs Q35 and Q36 are added up as the first voltage, which is applied to the gate of the nMOSFET Q73 of the current subtracter circuit 13 via the connection point T1*n*. The gates voltages of the nMOSFETs Q33 and Q34 are added up as the second voltage, which is applied to the gate of the nMOSFET Q74 of the current subtracter circuit 13 via the connection point T2*n*. The two nMOSFETs Q73 and Q74 connected in series generate the current $I_n$ corresponding to a current generated by the nMOS-configured power source circuit 106N.

In addition, the pMOS-configured power source circuit 106P is formed to be complementary to the nMOS-configured power source circuit 106N, and generates a current using the pMOSFET Q51, in which the temperature characteristics of the output current from the pMOS-configured power source circuit 106P are dependent on the hole mobility. The pMOS-configured power source circuit 106P is configured to include the following:

(a) the pMOSFET Q51 generating the current;

(b) the gate bias voltage generator circuit GB22 including the diode-connected nMOSFET Q200 and the four differential pair circuits (Q201 to Q203), (Q204 to Q206), (Q207 to Q209), and (Q210 to Q212), generating the gate bias voltage so that the pMOSFET Q51 operates in the strong inversion region, and applying the gate bias voltage to the gate of the pMOSFET Q51;

(c) the drain bias generator circuit DB2 including the two pairs of pMOSFETs (Q53, Q54) and (Q55, Q56), and generating the drain bias to be applied to the pMOSFET Q51; and (d) the current mirror circuit CM32 including the operational amplifier 92 that is configured to include the seven nMOSFETs Q57 to Q61, Q67, Q68 and the CMOS circuit, and stably supplying a power source current. In the pMOS-configured power source circuit 106P, the gate voltages of the pMOSFETs Q53 and Q54 are added up as the third voltage, which is applied to the gate of the pMOSFET Q71 of the current subtracter circuit 13 via the connection point T1*p*. The gates voltages of the pMOSFETs Q55 and Q56 are added up as the fourth voltage, which is applied to the gate of the nMOSFET Q72 of the current subtracter circuit 13 via the connection point T2*p*. The two pMOSFETs Q71 and Q72 connected in series generate the current $I_p$ corresponding to a current generated by the pMOS-configured power source circuit 106P.

In addition, the current subtracter circuit 13 is configured in a manner similar to that of the circuit of FIG. 21. The subtracted current ($I_n$–$I_p$) is obtained, and a reference output current $I_{ref}$ corresponding to the subtracted current ($I_n$–$I_p$) and being constant with respect to a temperature change is obtained. In particular, in the sixth implemental example, the voltage source circuit is configured by using a plurality of differential pairs in view of the consideration with reference to FIG. 9 in each of the gate bias voltage generator circuits GB21 and GB22. Therefore, as shown in the Equations (21) and (22), the reference current source circuit 106 is stable with respect to process variations. Accordingly, as compared with the first and second implemental examples, the reference current source circuit 106 can advantageously output the output current with reducing the influence of the process variations.

In the above-mentioned sixth implemental example, the gate bias voltage generator circuits GB21 and GB22 differ in the number of differential pair circuits. This is intended to improve accuracy of the bias voltage applied to each of the gates of the current generation MOSFETs Q31 and Q51.

Simulation Results

The inventors of the present invention did the following simulations for each of the implemental examples configured as mentioned above:

(1) A simulation using a parameter set of typical values so as to make validation in an ideal state; and (2) A simulation with changing parameters as shown below using Monte Carlo simulation method.

In the latter Monte Carlo simulation, it is validated whether the circuit operates stably by dispersing parameters based on statistical probability using a manufacturing process variation dataset provided by an LSI manufacturing vendor on the premise of global variations (different parameters among LSI chips) and random variations (different parameters in an LSI chip). FIG. 31 shows a global variation parameter set. That is, FIG. 31 is a table showing an example of the global variation parameter set (typical values and variations of a 0.35 μm-CMOS parameters) in the Monte Carlo simulation executed by the inventors of the present invention for the reference current source circuits 101, 104, and 106 according to the first, fourth, and sixth implemental examples. In this case, each parameter is set so as to be distributed and dispersed around a typical value by as much as a variation. When it is normally assumed as a Gaussian distribution, a distribution form is assumed as a uniform distribution in FIG. 31. Manufacturing vendors normally recommend using the uniform distribution. However, the uniform distribution is adopted in the simulations because the uniform distribution has stricter conditions.

As the random variation parameter set, 0.35 μm-CMOS parameters $\sigma_P$ are represented by the following Equation (49):

$$\sigma_P = \frac{A_P}{\sqrt{LW}}.$$

As apparent from the Equation (49), the dispersion of variations in the LSI chip is inversely proportional to a square root of a device element area (LW). FIG. 32 shows parameters of variations. That is, FIG. 32 is a table showing a parameter set of threshold voltages and mobilities in the Monte Carlo simulation. Referring to FIG. 32, only the threshold voltages and the mobilities are considered, the distribution form is assumed as the Gaussian distribution, random variation components are added to the variation values of the global variations in the random variations.

Figures 33A, 33B, 33C:
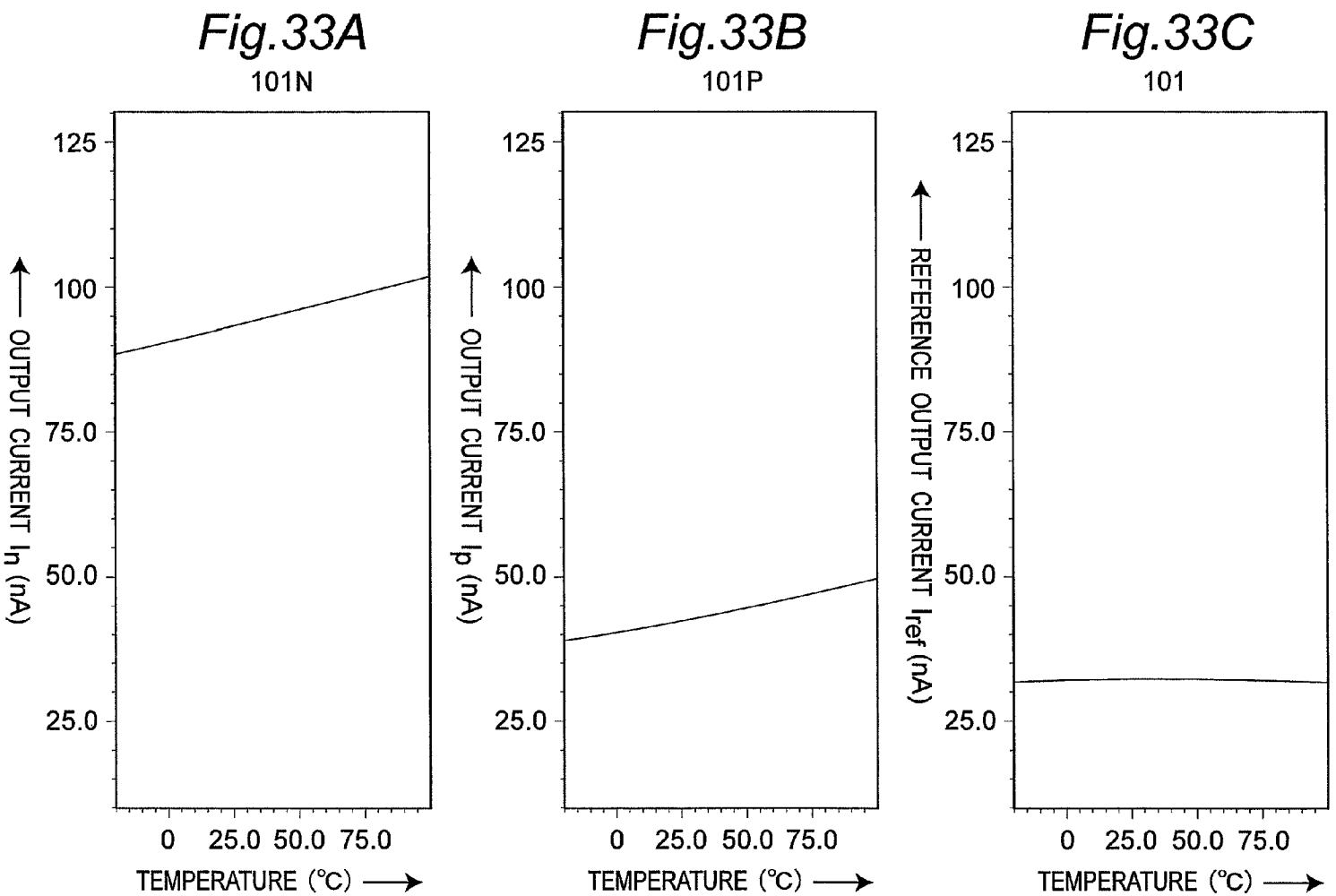
FIG. 33A is a graph showing a result of a simulation (once for a typical value) of the reference current source circuit 101 according to the first implemental example and showing temperature characteristics of an output current $I_n$ from an nMOS-configured power source circuit 101N in the reference current source circuit 101.
FIG. 33B is a graph showing temperature characteristics of an output current $I_p$ from a pMOS-configured power source circuit 101P in the reference current source circuit 101.
FIG. 33C is a graph showing temperature characteristics of a reference output current $I_{ref}$ from the reference current source circuit 101.

FIG. 33A is a graph showing a result of a simulation (once for a typical value) of the reference current source circuit 101 according to the first implemental example and showing temperature characteristics of the output current $I_n$ from the nMOS-configured power source circuit 101N in the reference current source circuit 101. FIG. 33B is a graph showing temperature characteristics of the output current $I_p$ from the pMOS-configured power source circuit 101P in the reference current source circuit 101. FIG. 33C is a graph showing temperature characteristics of the reference output current $I_{ref}$ from the reference current source circuit 101.

Figure 34C:
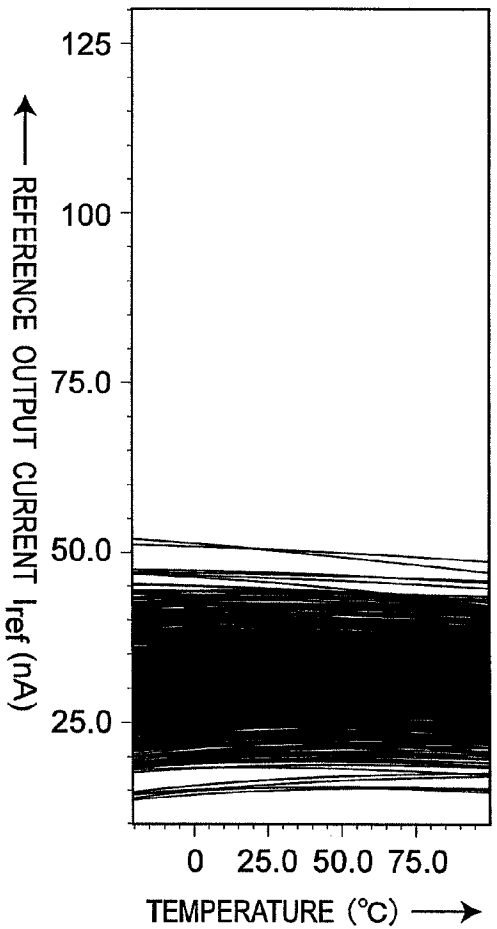
FIG. 34C is a graph showing temperature characteristics of the reference output current $I_{ref}$ from the reference current source circuit 101.
Figure 34B:
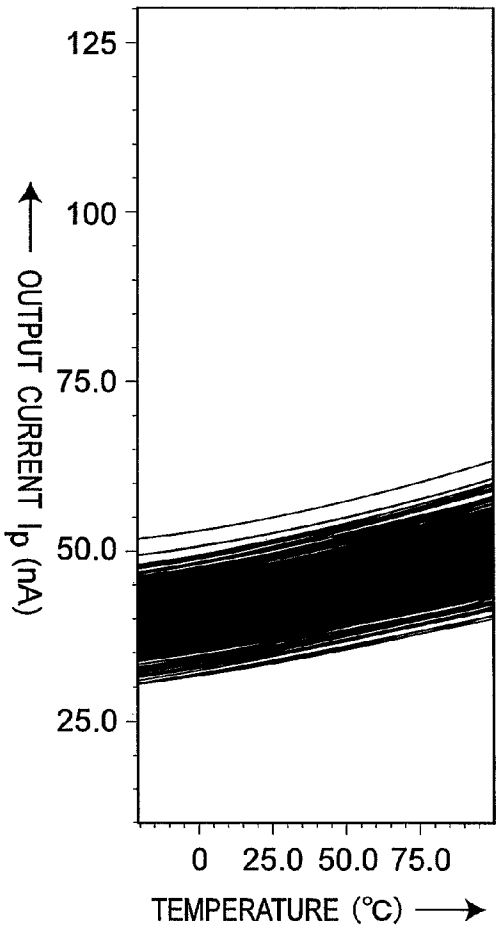
FIG. 34B is a graph showing temperature characteristics of the output current $I_p$ from the pMOS-configured power source circuit 101P in the reference current source circuit 101.
Figure 34A:
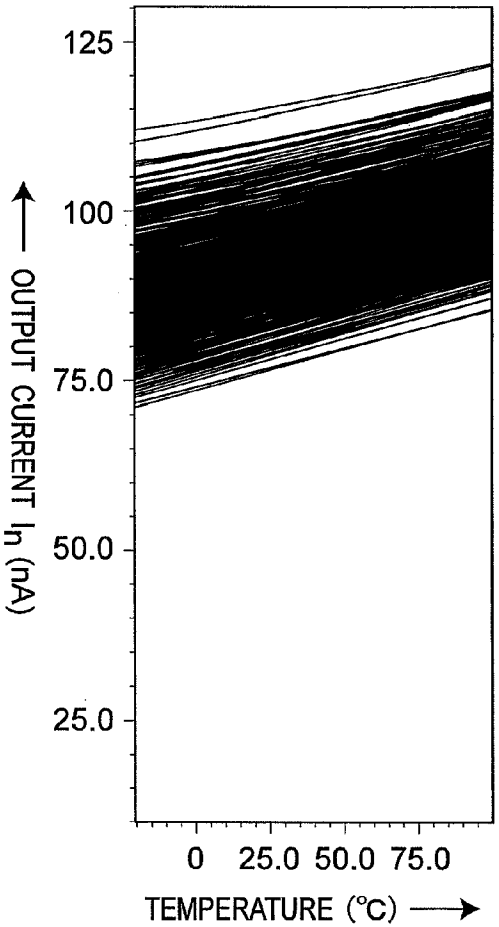
FIG. 34A is a graph showing a result of (500) Monte Carlo simulations of the reference current source circuit 101 according to the first implemental example and showing temperature characteristics of the output current $I_n$ from the nMOS-configured power source circuit 101N in the reference current source circuit 101.

FIG. 34A is a graph showing a result of (500) Monte Carlo simulations of the reference current source circuit 101 according to the first implemental example and showing temperature characteristics of the output current $I_n$ from the nMOS-configured power source circuit 101N in the reference current source circuit 101. FIG. 34B is a graph showing temperature characteristics of the output current $I_p$ from the pMOS-configured power source circuit 101P in the reference current source circuit 101. FIG. 34C is a graph showing temperature characteristics of the reference output current $I_{ref}$ from the reference current source circuit 101.

Figures 35A, 35B, 35C:
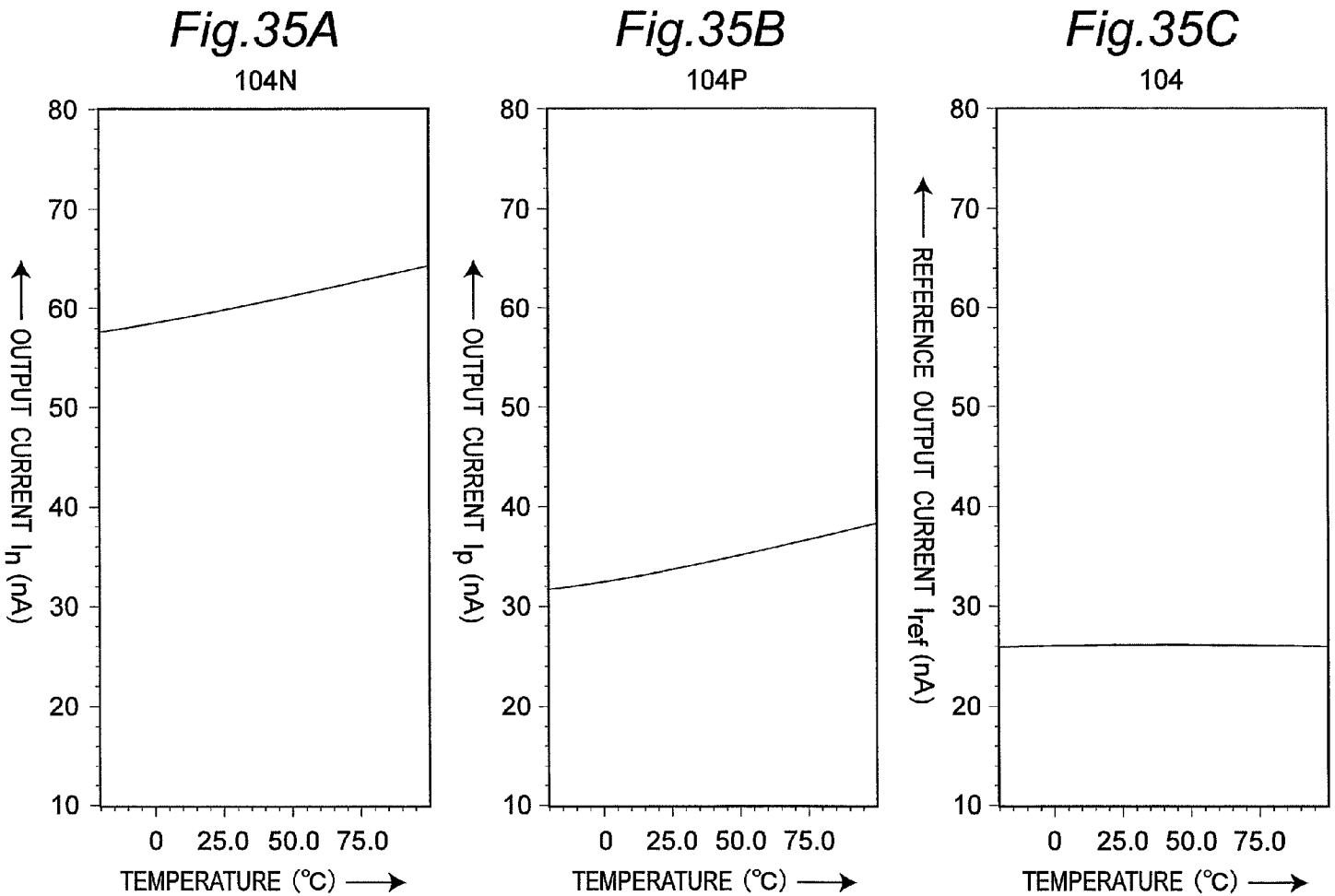
FIG. 35A is a graph showing a result of a simulation (once for a typical value) of the reference current source circuit 104 according to the fourth implemental example and showing temperature characteristics of the output current $I_n$ from an nMOS-configured power source circuit 104N in the reference current source circuit 104.
FIG. 35B is a graph showing temperature characteristics of an output current $I_p$ from a pMOS-configured power source circuit 104P in the reference current source circuit 104.
FIG. 35C is a graph showing temperature characteristics of a reference output current $I_{ref}$ from the reference current source circuit 104.

FIG. 35A is a graph showing a result of a simulation (once for a typical value) of the reference current source circuit 104 according to the fourth implemental example and showing temperature characteristics of the output current $I_n$ from the nMOS-configured power source circuit 104N in the reference current source circuit 104. FIG. 35B is a graph showing temperature characteristics of the output current $I_p$ from the pMOS-configured power source circuit 104P in the reference current source circuit 104. FIG. 35C is a graph showing temperature characteristics of the reference output current $I_{ref}$ from the reference current source circuit 104.

Figures 36A, 36B, 36C:
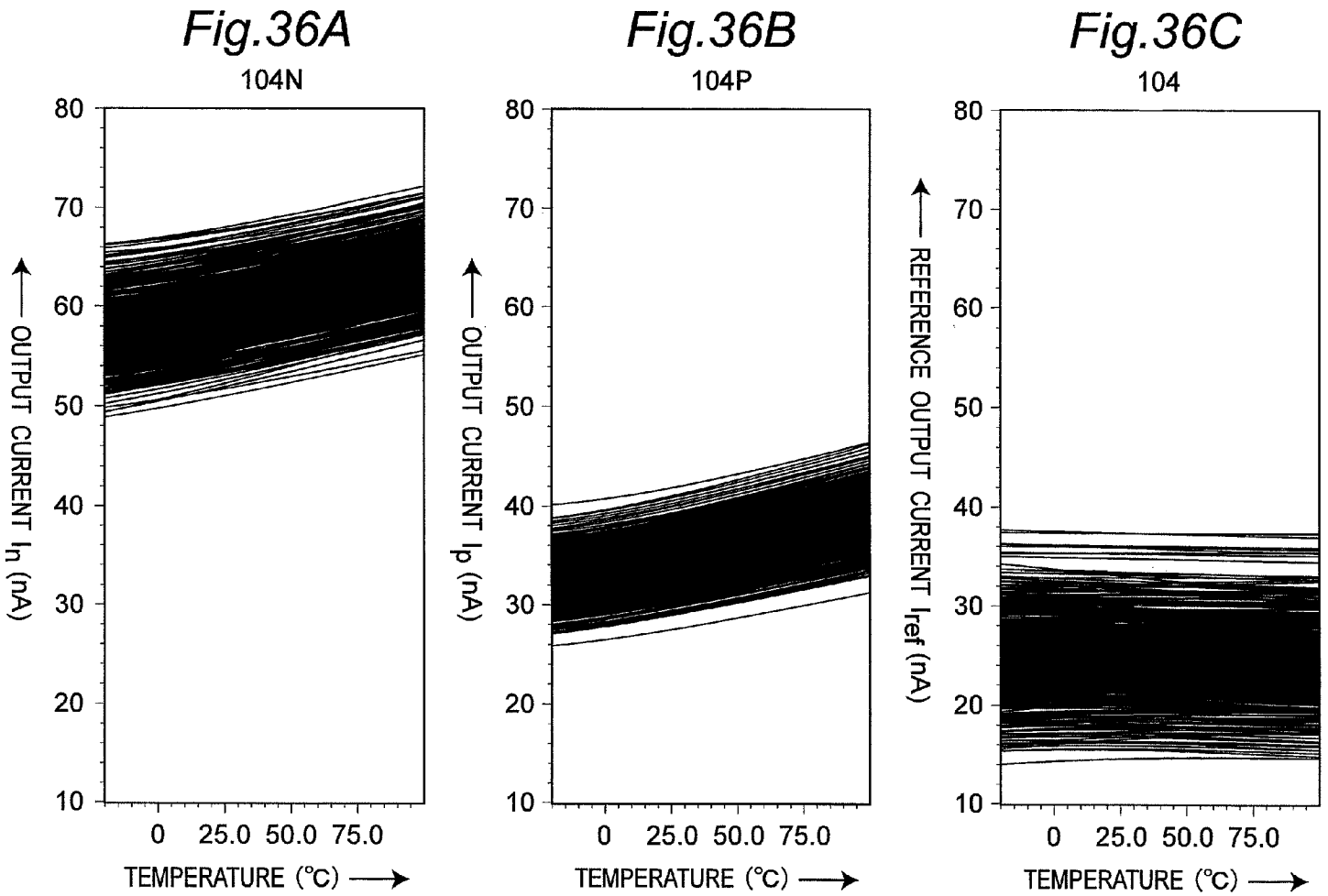
FIG. 36A is a graph showing a result of (500) Monte Carlo simulations of the reference current source circuit 104 according to the fourth implemental example and showing temperature characteristics of the output current $I_n$ from the nMOS-configured power source circuit 104N in the reference current source circuit 104.
FIG. 36B is a graph showing temperature characteristics of the output current $I_p$ from the pMOS-configured power source circuit 104P in the reference current source circuit 104.
FIG. 36C is a graph showing temperature characteristics of the reference output current $I_{ref}$ from the reference current source circuit 104.

FIG. 36A is a graph showing a result of (500) Monte Carlo simulations of the reference current source circuit 104 according to the fourth implemental example and showing temperature characteristics of the output current $I_n$ from the nMOS-configured power source circuit 104N in the reference current source circuit 104. FIG. 36B is a graph showing temperature characteristics of the output current $I_p$ from the pMOS-configured power source circuit 104P in the reference current source circuit 104. FIG. 36C is a graph showing temperature characteristics of the reference output current $I_{ref}$ from the reference current source circuit 104.

Figures 37A, 37B, 37C:
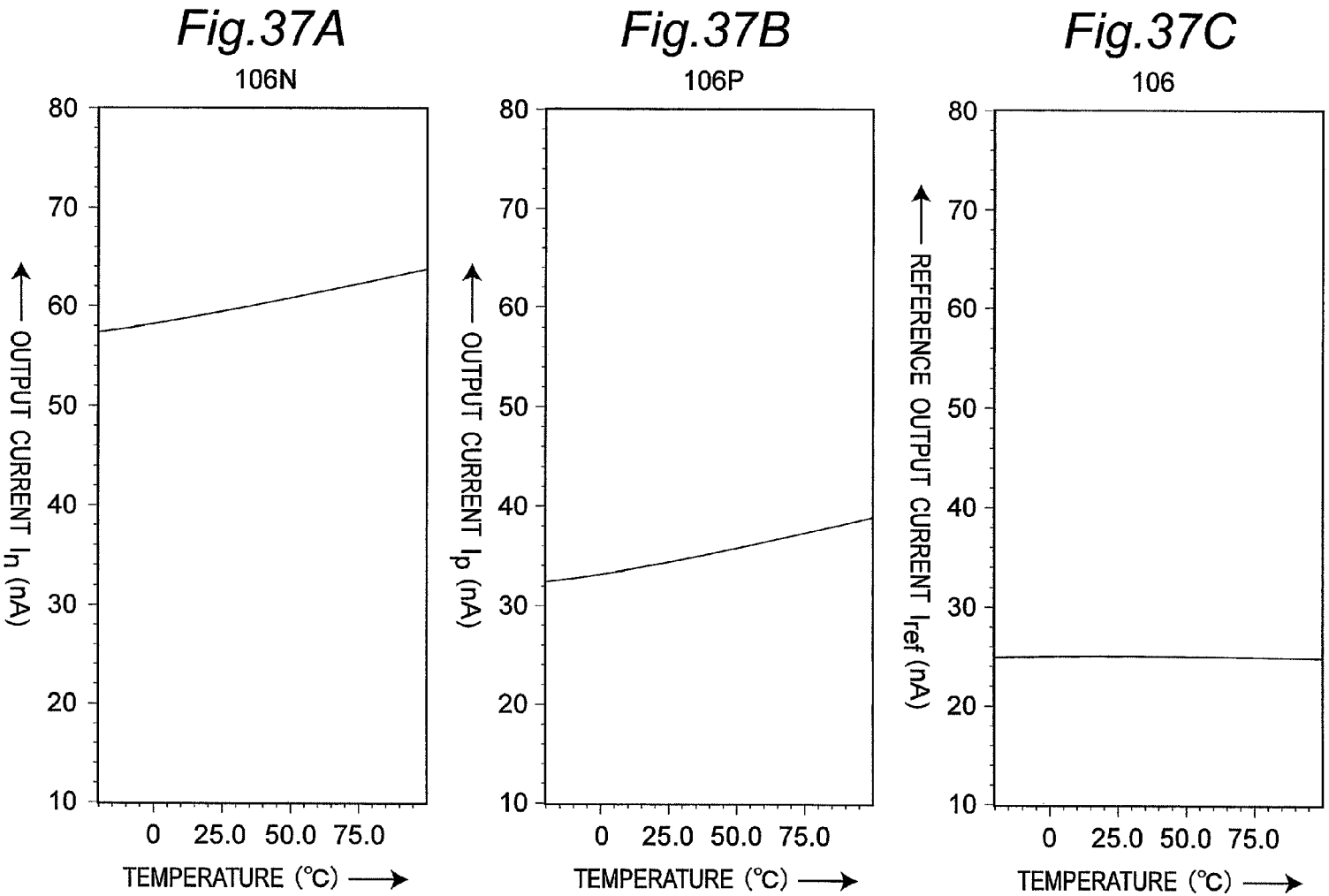
FIG. 37A is a graph showing a result of a simulation (once for a typical value) of the reference current source circuit 106 according to the sixth implemental example and showing temperature characteristics of an output current $I_n$ from an nMOS-configured power source circuit 106N in the reference current source circuit 106.
FIG. 37B is a graph showing temperature characteristics of an output current $I_p$ from a pMOS-configured power source circuit 106P in the reference current source circuit 106.
FIG. 37C is a graph showing temperature characteristics of a reference output current $I_{ref}$ from the reference current source circuit 106.

FIG. 37A is a graph showing a result of a simulation (once for a typical value) of the reference current source circuit 106 according to the sixth implemental example and showing temperature characteristics of the output current $I_n$ from the nMOS-configured power source circuit 106N in the reference current source circuit 106. FIG. 37B is a graph showing temperature characteristics of the output current $I_p$ from the pMOS-configured power source circuit 106P in the reference current source circuit 106. FIG. 37C is a graph showing temperature characteristics of the reference output current $I_{ref}$ from the reference current source circuit 106.

Figures 38A, 38B, 38C:
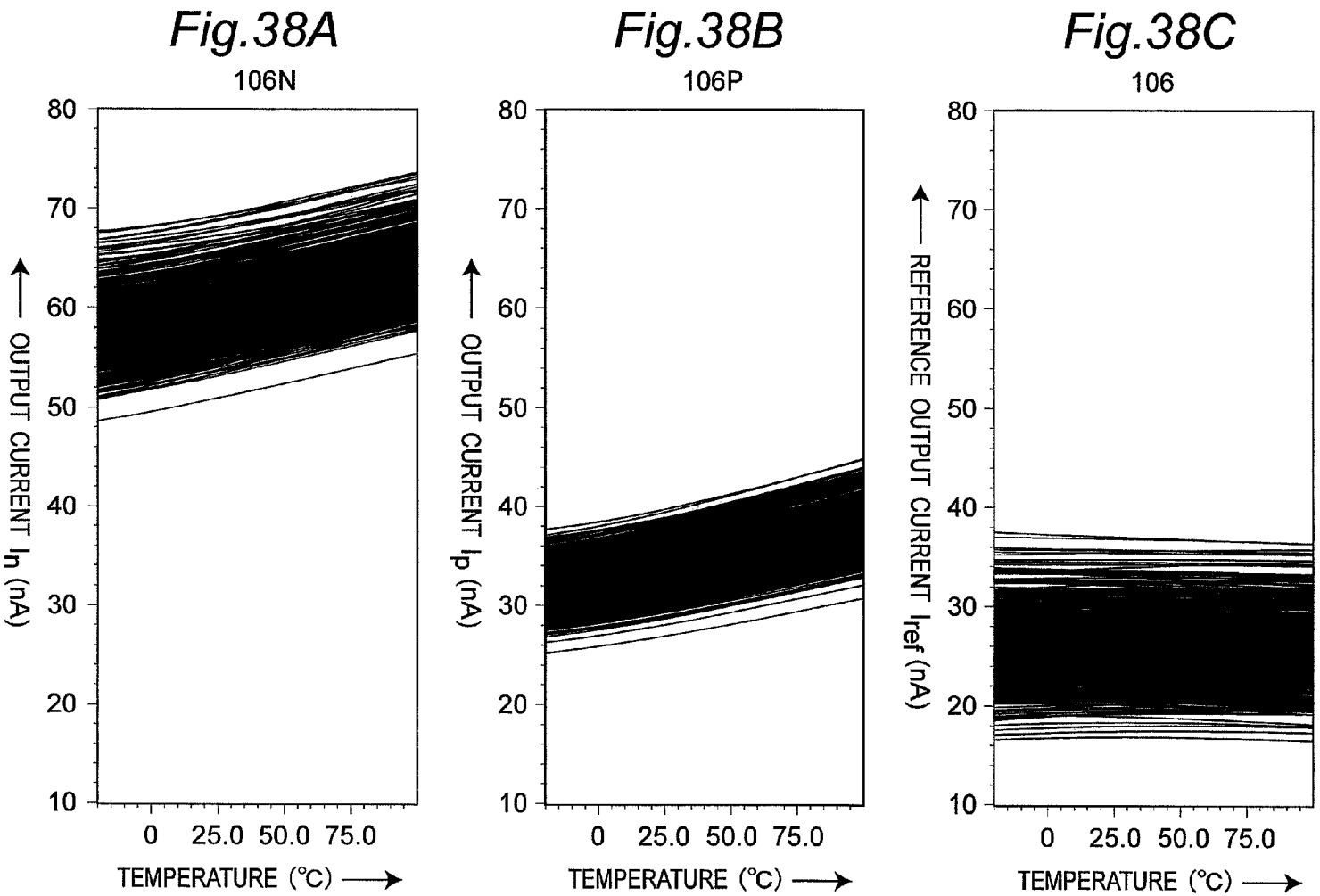
FIG. 38A is a graph showing a result of (500) Monte Carlo simulations of the reference current source circuit 106 according to the sixth implemental example and showing temperature characteristics of the output current $I_n$ from the nMOS-configured power source circuit 106N in the reference current source circuit 106.
FIG. 38B is a graph showing temperature characteristics of the output current $I_p$ from the pMOS-configured power source circuit 106P in the reference current source circuit 106.
FIG. 38C is a graph showing temperature characteristics of the reference output current $I_{ref}$ from the reference current source circuit 106.

FIG. 38A is a graph showing a result of (500) Monte Carlo simulations of the reference current source circuit 106 according to the sixth implemental example and showing temperature characteristics of the output current $I_n$ from the nMOS-configured power source circuit 106N in the reference current source circuit 106. FIG. 38B is a graph showing temperature characteristics of the output current $I_p$ from the pMOS-configured power source circuit 106P in the reference current source circuit 106. FIG. 38C is a graph showing temperature characteristics of the reference output current $I_{ref}$ from the reference current source circuit 106.

Figures 39A, 39B, 39C:
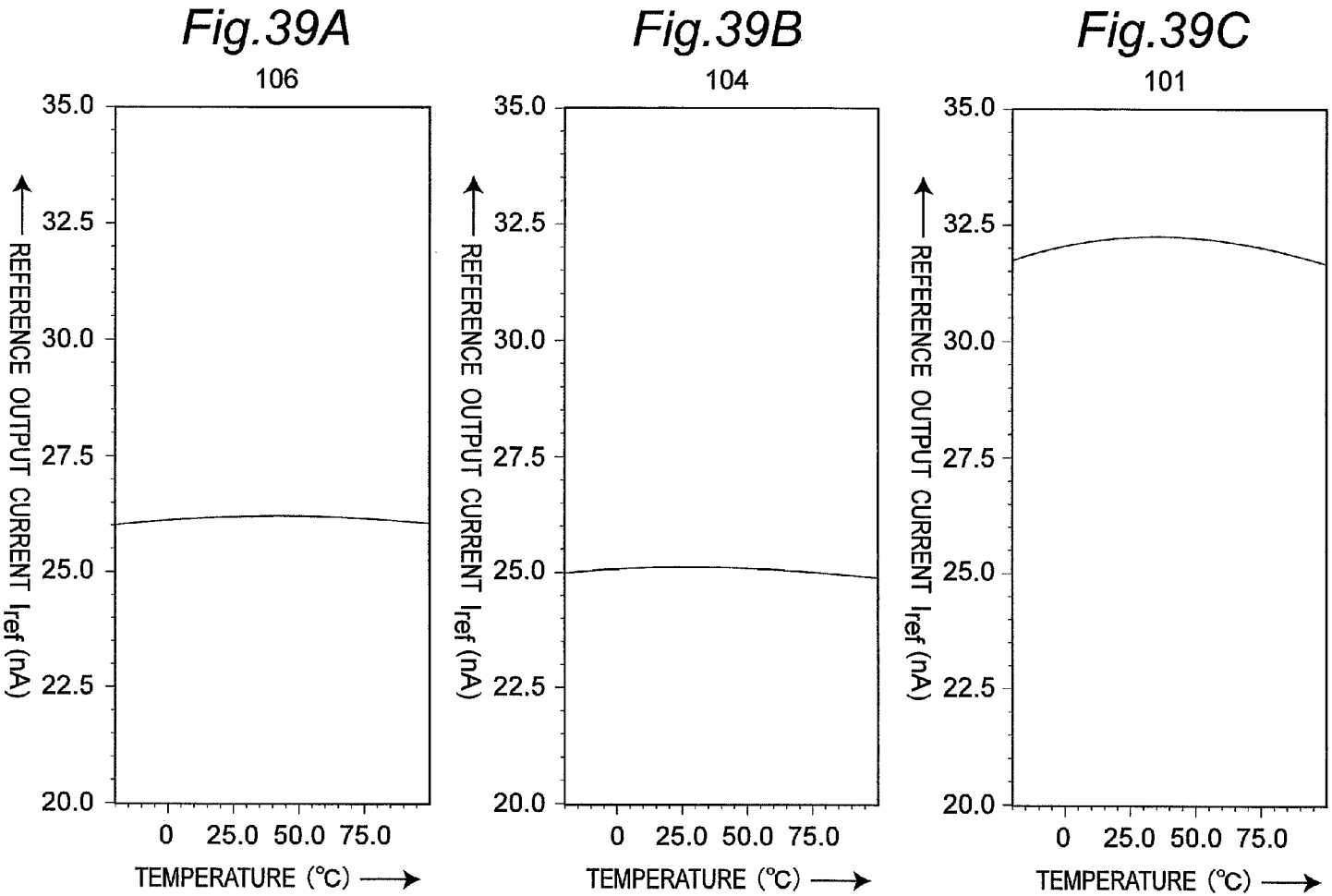
FIG. 39A is a graph showing a result of a simulation (once for a typical value) of the reference current source circuit 106 according to the sixth implemental example and showing temperature characteristics of the reference output current $I_{ref}$ from the reference current source circuit 106.
FIG. 39B is a graph showing a result of a simulation (once for a typical value) of the reference current source circuit 104 according to the fourth implemental example and showing temperature characteristics of the reference output current $I_{ref}$ from the reference current source circuit 104.
FIG. 39C is a graph showing a result of a simulation (once for a typical value) of the reference current source circuit 101 according to the first implemental example and showing temperature characteristics of the reference output current $I_{ref}$ from the reference current source circuit 101.
Figure 40C:
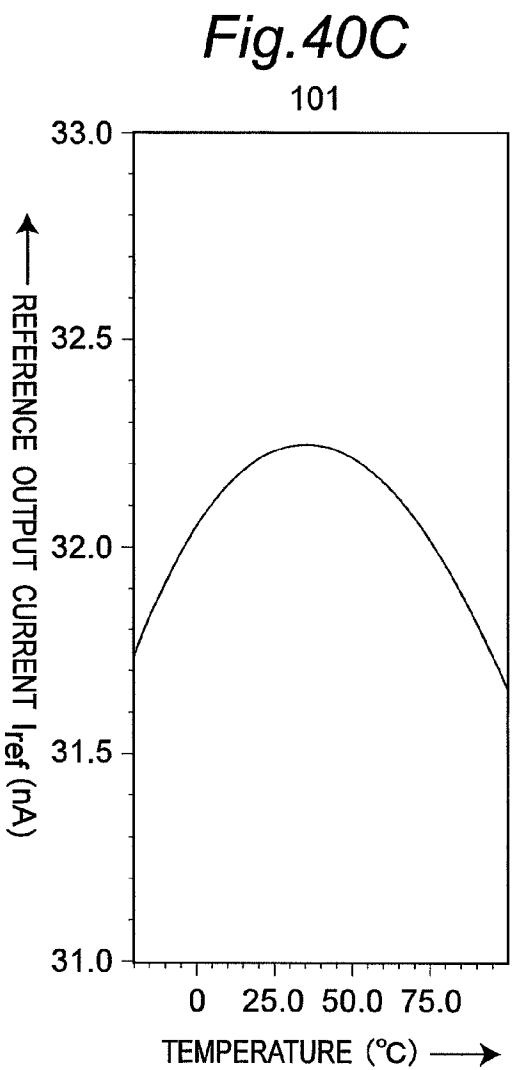
FIG. 40C is an enlarged chart of FIG. 39C.
Figure 40B:
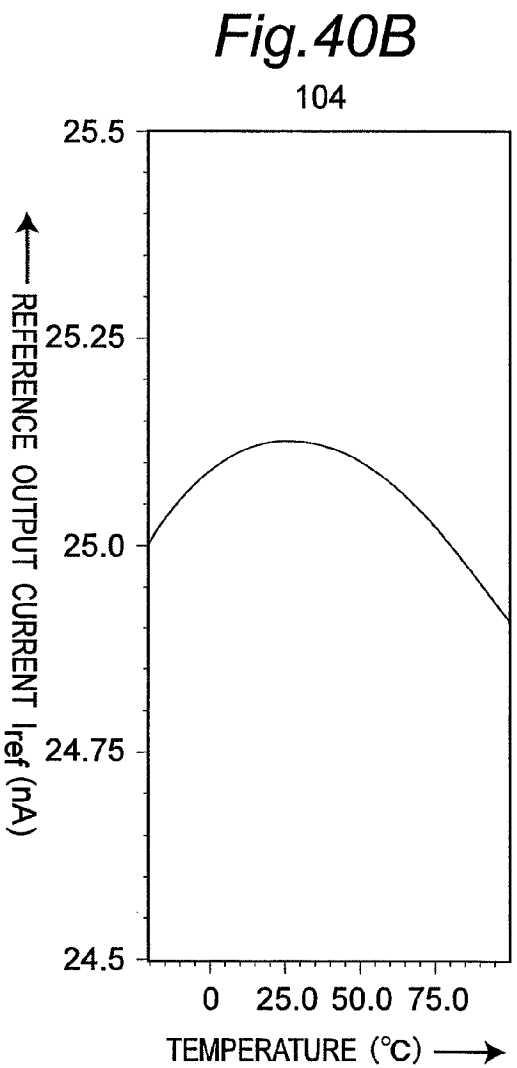
FIG. 40B is an enlarged chart of FIG. 39B.
Figure 40A:
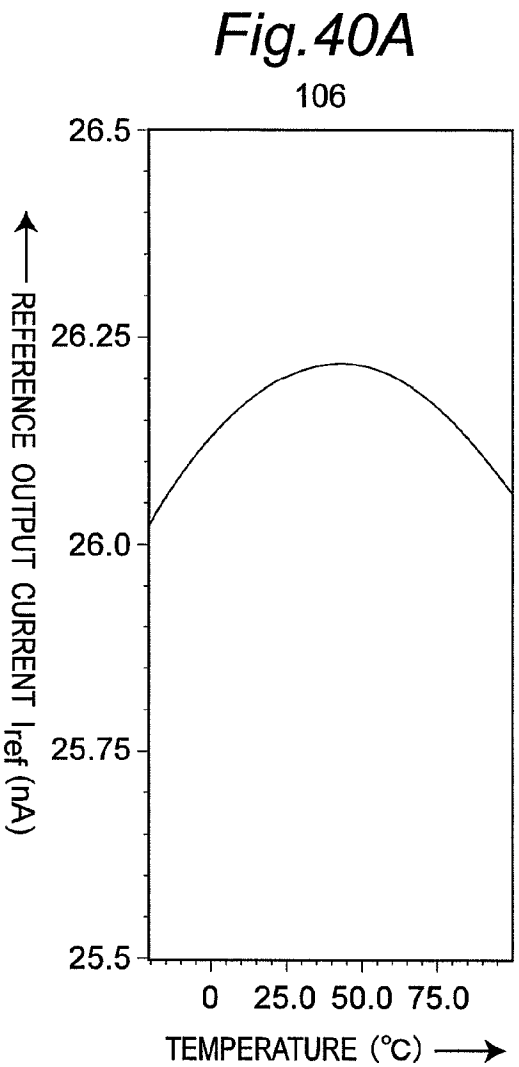
FIG. 40A is an enlarged chart of FIG. 39A.

FIG. 39A is a graph showing a result of a simulation (once for a typical value) of the reference current source circuit 106 according to the sixth implemental example and showing temperature characteristics of the reference output current $I_{ref}$ from the reference current source circuit 106. FIG. 39B is a graph showing a result of a simulation (once for a typical value) of the reference current source circuit 104 according to the fourth implemental example and showing temperature characteristics of the reference output current $I_{ref}$ from the reference current source circuit 104. FIG. 39C is a graph showing a result of a simulation (once for a typical value) of the reference current source circuit 101 according to the first implemental example and showing temperature characteristics of the reference output current $I_{ref}$ from the reference current source circuit 101. In addition, FIG. 40A is an enlarged chart of FIG. 39A, FIG. 40B is an enlarged chart of FIG. 39B, and FIG. 40C is an enlarged chart of FIG. 39C.

Figures 41A, 41B, 41C:
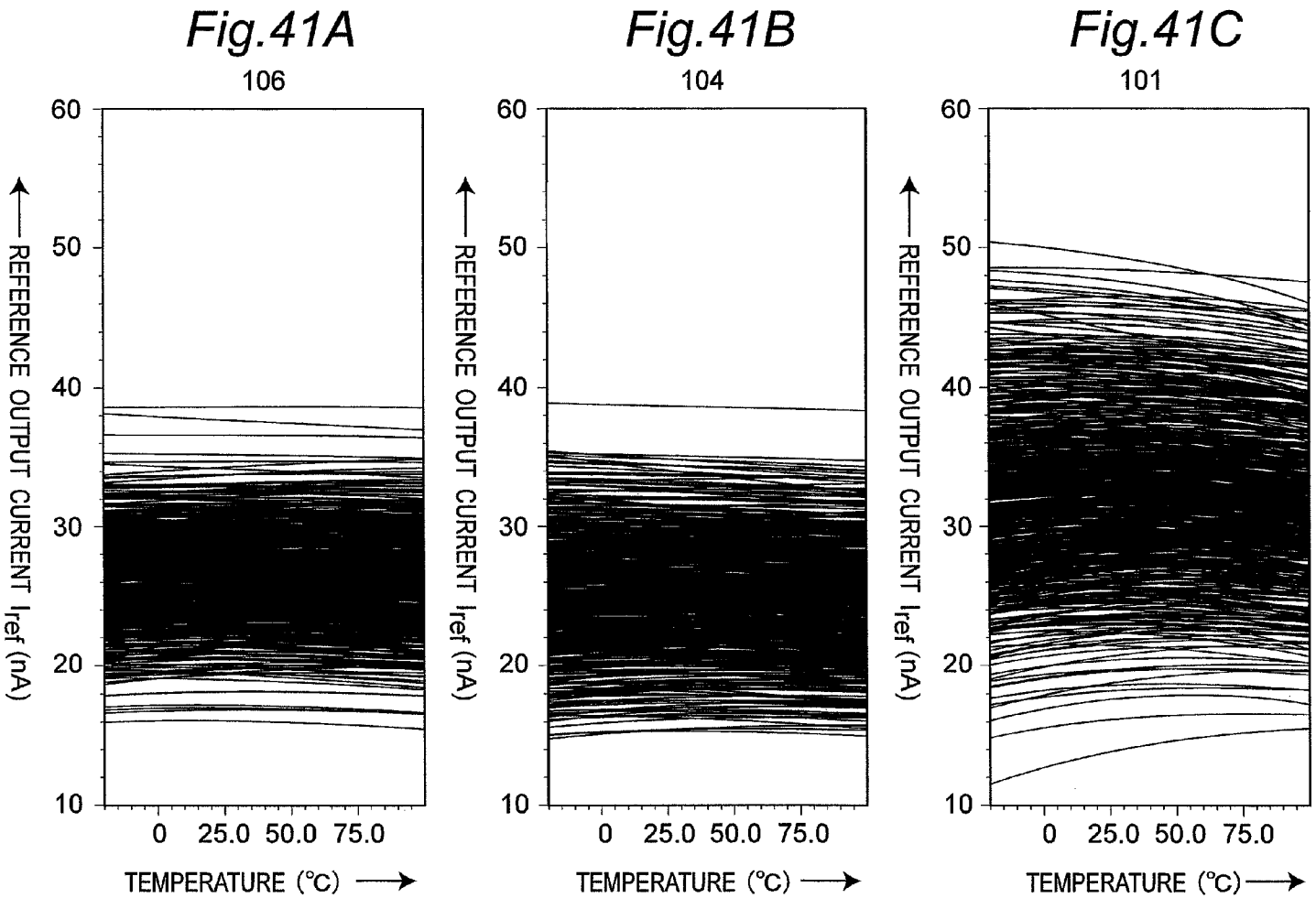
FIG. 41A is a graph showing a result of (500) Monte Carlo simulations of the reference current source circuit 106 according to the sixth implemental example and showing temperature characteristics of the reference output current $I_{ref}$ from the reference current source circuit 106.
FIG. 41B is a graph showing a result of (500) Monte Carlo simulations of the reference current source circuit 104 according to the fourth implemental example and showing temperature characteristics of the reference output current $I_{ref}$ from the reference current source circuit 104.
FIG. 41C is a graph showing a result of (500) Monte Carlo simulations of the reference current source circuit 101 according to the first implemental example and showing temperature characteristics of the reference output current $I_{ref}$ from the reference current source circuit 101.

FIG. 41A is a graph showing a result of (500) Monte Carlo simulations of the reference current source circuit 106 according to the sixth implemental example and showing temperature characteristics of the reference output current $I_{ref}$ from the reference current source circuit 106. FIG. 41B is a graph showing a result of (500) Monte Carlo simulations of the reference current source circuit 104 according to the fourth implemental example and showing temperature characteristics of the reference output current $I_{ref}$ from the reference current source circuit 104. FIG. 41C is a graph showing a result of (500) Monte Carlo simulations of the reference current source circuit 101 according to the first implemental example and showing temperature characteristics of the reference output current $I_{ref}$ from the reference current source circuit 101.

Figure 42C:
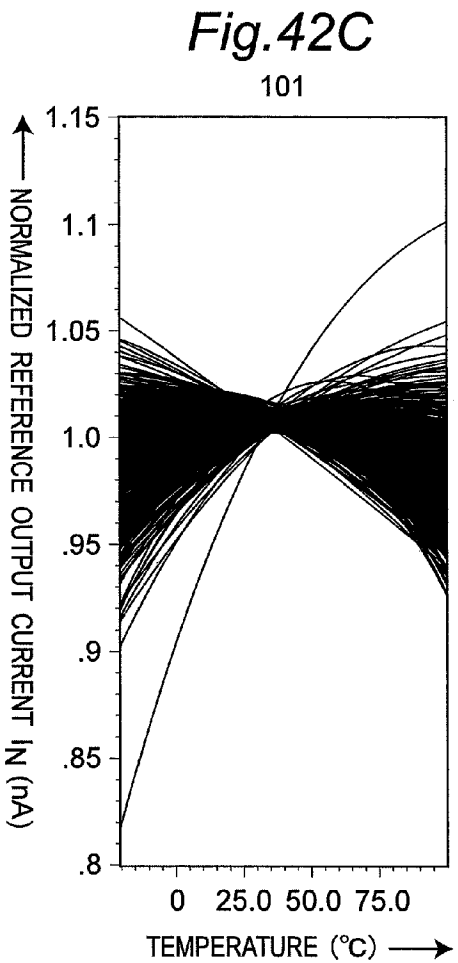
FIG. 42C is a graph showing temperature characteristics of a normalized reference output current $I_N$ obtained by normalizing the reference output current $I_{ref}$ at each trial of FIG. 41C by a temperature-average current at each trial.
Figure 42B:
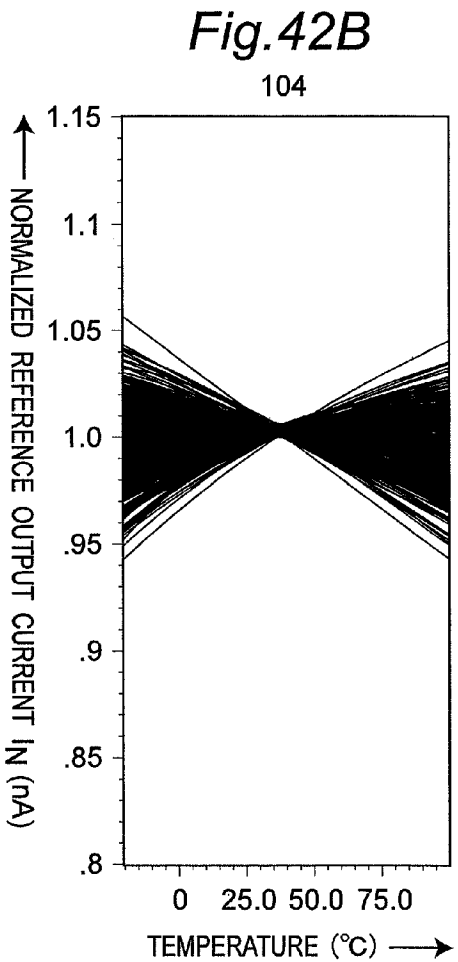
FIG. 42B is a graph showing temperature characteristics of a normalized reference output current $I_N$ obtained by normalizing the reference output current $I_{ref}$ at each trial of FIG. 41B by a temperature-average current at each trial.
Figure 42A:
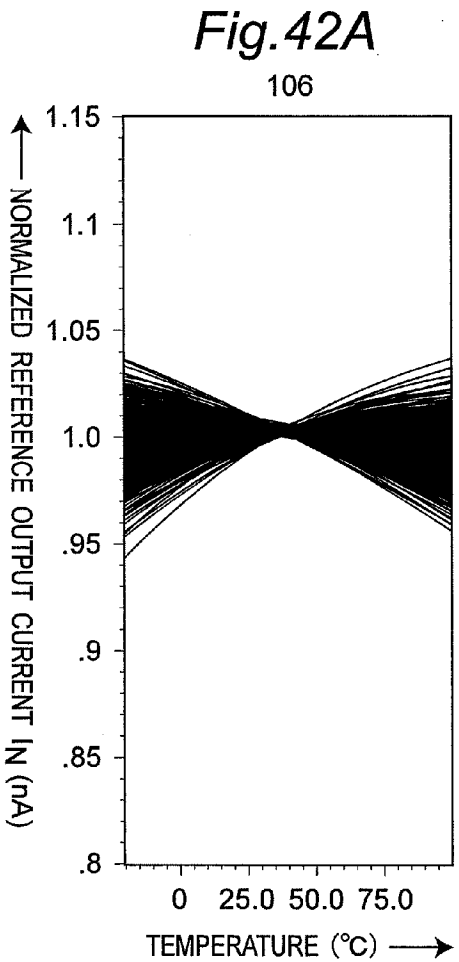
FIG. 42A is a graph showing temperature characteristics of a normalized reference output current $I_N$ obtained by normalizing the reference output current $I_{ref}$ at each trial of FIG. 41A by a temperature-average current at each trial.

FIG. 42A is a graph showing temperature characteristics of a normalized reference output current $I_N$ obtained by normalizing the reference output current $I_{ref}$ at each trial of FIG. 41A by a temperature-average current at each trial. FIG. 42B is a graph showing temperature characteristics of a normalized reference output current $I_N$ obtained by normalizing the reference output current $I_{ref}$ at each trial of FIG. 41B by a temperature-average current at each trial. FIG. 42C is a graph showing temperature characteristics of a normalized reference output current $I_N$ obtained by normalizing the reference output current $I_{ref}$ at each trial of FIG. 41C by a temperature-average current at each trial.

Figures 43A, 43B, 43C:
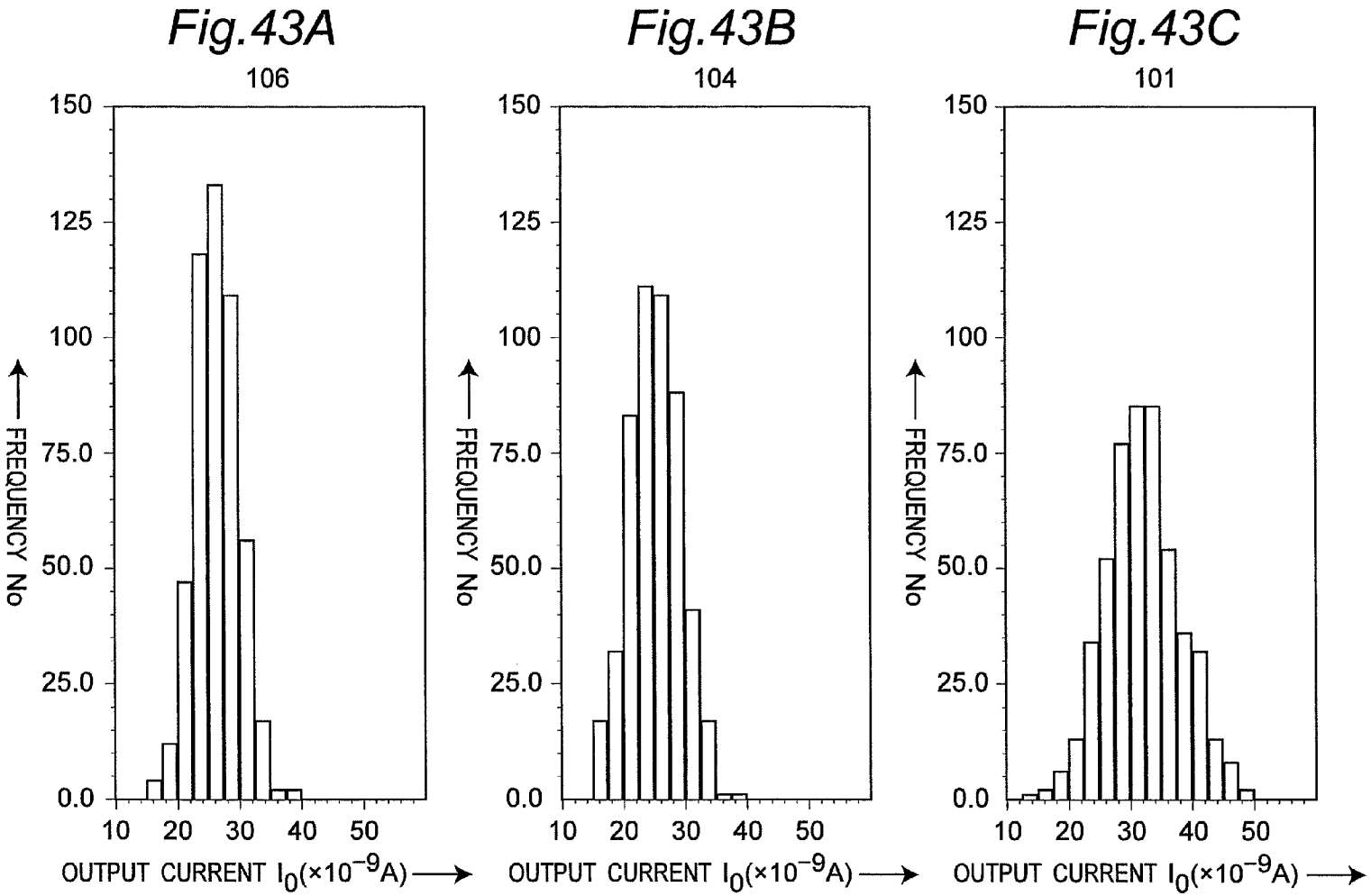
FIG. 43A is a histogram showing frequency of the reference output current $I_{ref}$ (temperature average) of FIG. 41A.
FIG. 43B is a histogram showing frequency of the reference output current $I_{ref}$ (temperature average) of FIG. 41B.
FIG. 43C is a histogram showing frequency of the reference output current $I_{ref}$ (temperature average) of FIG. 41C.

FIG. 43A is a histogram showing frequency of the reference output current $I_{ref}$ (temperature average) of FIG. 41A. FIG. 43B is a histogram showing frequency of the reference output current $I_{ref}$ (temperature average) of FIG. 41B. FIG. 43C is a histogram showing frequency of the reference output current $I_{ref}$ (temperature average) of FIG. 41C.

FIG. 44 is a table showing results of characteristic evaluation of the reference current source circuits 101, 104, and 106 according to the first, fourth, and sixth implemental examples, respectively, and the nMOS-configured power source circuit 106N of the reference current source circuit 106 according to the sixth implemental example.

As apparent from results of FIGS. 33A, 33B and 33C to 44, each of all the circuits can cancel the temperature dependence of the output current using the difference between the electron mobility and the hole mobility. In this case, the reference current source circuits 101 and 102 according to the first and second implemental examples, respectively, have a small performance for variations in the parameters but have such an advantageous effect as the most saving of a circuit area. Furthermore, each of the reference current source circuits 103 and 104 according to the third and fourth implemental examples, respectively, has a large performance for variations in the parameters but is considered to have such an advantageous effect as the most saving of power since an occupation area is about intermediate and the number of current paths is small. Moreover, each of the reference current source circuits 105 and 106 according to the fifth and sixth implemental examples, respectively, is the largest performance for variations in the parameters but is disadvantageously high in consumption power since an occupation area is large and the number of current paths is large.

Figure 45:
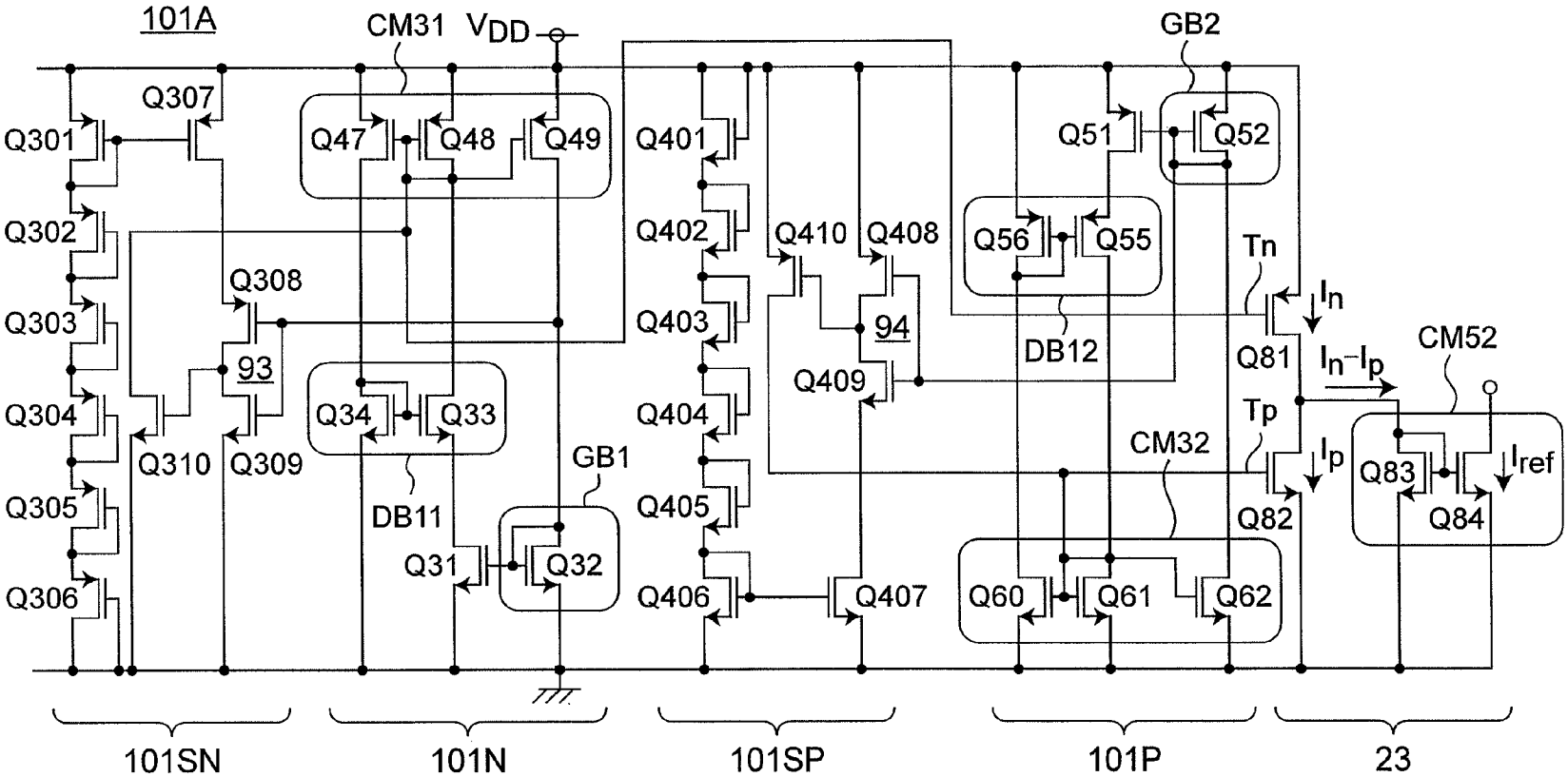
FIG. 45 is a circuit diagram showing a configuration of a reference current source circuit 101A according to a third preferred embodiment of the present invention.

FIG. 45 is a circuit diagram showing a configuration of a reference current source circuit 101A according to a third preferred embodiment of the present invention. The reference current source circuit 101A according to the third preferred embodiment is characterized by further including startup circuits 101SN and 101SP in the reference current source circuit 101 according to the first implemental example of FIG. 25 (a circuit configuration of which is not described in the present preferred embodiment). The startup circuits 101SN and 101SP are provided for the following reasons. In the reference current source circuit 101, there are cases where voltages of gates of nMOSFETs are all 0 V and those of gates of pMOSFETs are all a power source voltage $V_{DD}$. In this case, the circuit is in a state of not operating because no operating current flows in the circuit (this state is referred to as "zero current state", hereinafter). In order to avoid this, the startup circuits 101SN and 101SP are used.

Referring to FIG. 45, the startup circuit 101SN is configured to include a plurality of stages of diode-connected pMOSFETs Q301 to Q306, a pMOSFET Q307 for configuring a current mirror circuit, a pMOSFET Q308 and an nMOSFET Q309 for configuring an inverter 93, and an nMOSFET Q310 extracting and flowing an operating current. In addition, the startup circuit 101SP is configured to include a plurality of stages of diode-connected nMOSFETs Q401 to Q406, an nMOSFET Q407 for configuring a current mirror circuit, a pMOSFET Q408 and an nMOSFET Q409 for configuring an inverter 94, and a pMOSFET Q410 for forcibly flowing the operating current. In this case, the startup circuits 101SN and 101SP operate only in the above-mentioned zero current state, and do not operate if operating at a normal operating point.

In the startup circuit 101SN, a non-operating state of the nMOS-configured power source circuit 101N is detected by causing the inverter 93 to monitor a source voltage of the nMOSFET Q32. When the source voltage is 0 V (indicating the non-operating state), an output signal from the inverter 93 is high level. In addition, the high-level output signal is applied to a gate of the nMOSFET Q310 to turn on the nMOSFET Q310. Accordingly, the nMOSFET Q310 extracts current from the pMOSFET Q48, and the extracted current serves as a starting current to start the circuit 101N and to allow the circuit 101N to operate stably. On the other hand, if the voltage monitored by the inverter 93 is the operating voltage, then the output signal from the inverter 93 is low level (0 V), the low-level output signal is applied to the gate of the nMOSFET Q310, and the nMOSFET Q310 is kept to be turned off. Accordingly, the nMOSFET Q310 flows no current. That is, the startup circuit 101SN has no influence on circuit operation during normal operation. It is to be noted that a plurality of stages of diode-connected pMOSFETs Q301 to Q306 generates a constant minute current, and that the pMOSFET Q307 serving as the current mirror circuit of the pMOSFETs Q301 to Q306 supplies a minute current corresponding to the minute current to the inverter 93 as a bias operating current and controls the current flowing into the inverter 93 not to be larger so as to reduce power consumption.

The startup circuit 101SP operates in a manner similar to that of the startup circuit 101SN as follows. In the startup circuit 101SN, a non-operating state of the pMOS-configured power source circuit 101P is detected by causing the inverter 94 to monitor a source voltage of the pMOSFET Q52. When the source voltage is high level (equal to power source voltage $V_{DD}$), an output signal from the inverter 94 is low level. In addition, the low-level output signal is applied to a gate of the pMOSFET Q410 to turn on the pMOSFET Q410. Accordingly, the pMOSFET Q410 forcibly flows a current into the nMOSFET Q61, and this current serves as a starting current to start the circuit 101P and to allow the circuit 101P to operate stably. On the other hand, if the voltage monitored by the inverter 94 is 0 V, then the output signal from the inverter 94 is high level, the high-level output signal is applied to the gate of the pMOSFET Q410, and the pMOSFET Q410 is kept to be turned off. Accordingly, the pMOSFET Q410 flows no current. That is, the startup circuit 101SP has no influence on circuit operation during normal operation. It is to be noted that a plurality of stages of diode-connected nMOSFETs Q401 to Q406 generates a constant minute current, and that the nMOSFET Q407 serving as the current mirror circuit of the nMOSFETs Q401 to Q406 supplies a minute current corresponding to the above-mentioned minute current to the inverter 94 as a bias operating current and controls the current flowing into the inverter 94 not to be larger so as to reduce power consumption.

Figure 46:
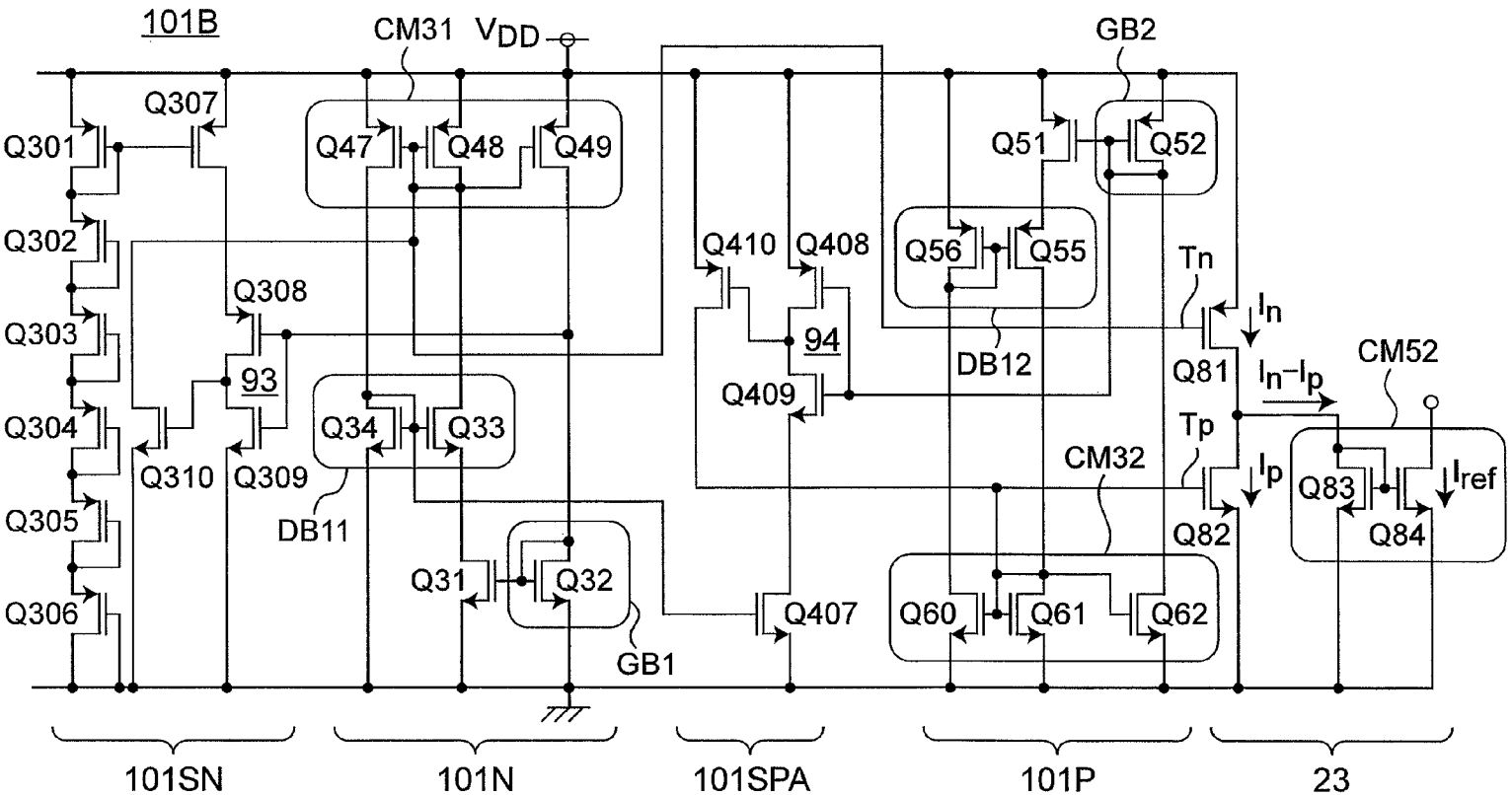
FIG. 46 is a circuit diagram showing a configuration of a reference current source circuit 101B according to a modified preferred embodiment of the third preferred embodiment of the present invention.

FIG. 46 is a circuit diagram showing a configuration of a reference current source circuit 101B according to a modified preferred embodiment of the third preferred embodiment of the present invention. The reference current source circuit 101B according to the modified preferred embodiment of the third preferred embodiment differs from the reference current source circuit 101A of FIG. 45 in the following respects.

(1) The reference current source circuit 101B includes a startup circuit 101SPA in place of the startup circuit 101SP. In this case, the startup circuit 101SPA is characterized, as compared with the startup circuit 101SP, in that a plurality of stages of diode-connected nMOSFETs Q401 to Q406 are not used, an nMOSFET Q407 serving as a current mirror circuit generates a current corresponding to a current of the reference current source circuit 101N (which current is specifically, for example, a source current of the nMOSFET Q34), and in that the generated current is used as a bias current of an inverter 94. By so configuring, the reference current source circuit 101B exhibits an effect that a circuit scale can be made small because the reference current source circuit 101B does not use a plurality of stages of diode-connected nMOSFETs Q401 to Q406.

Figure 47:
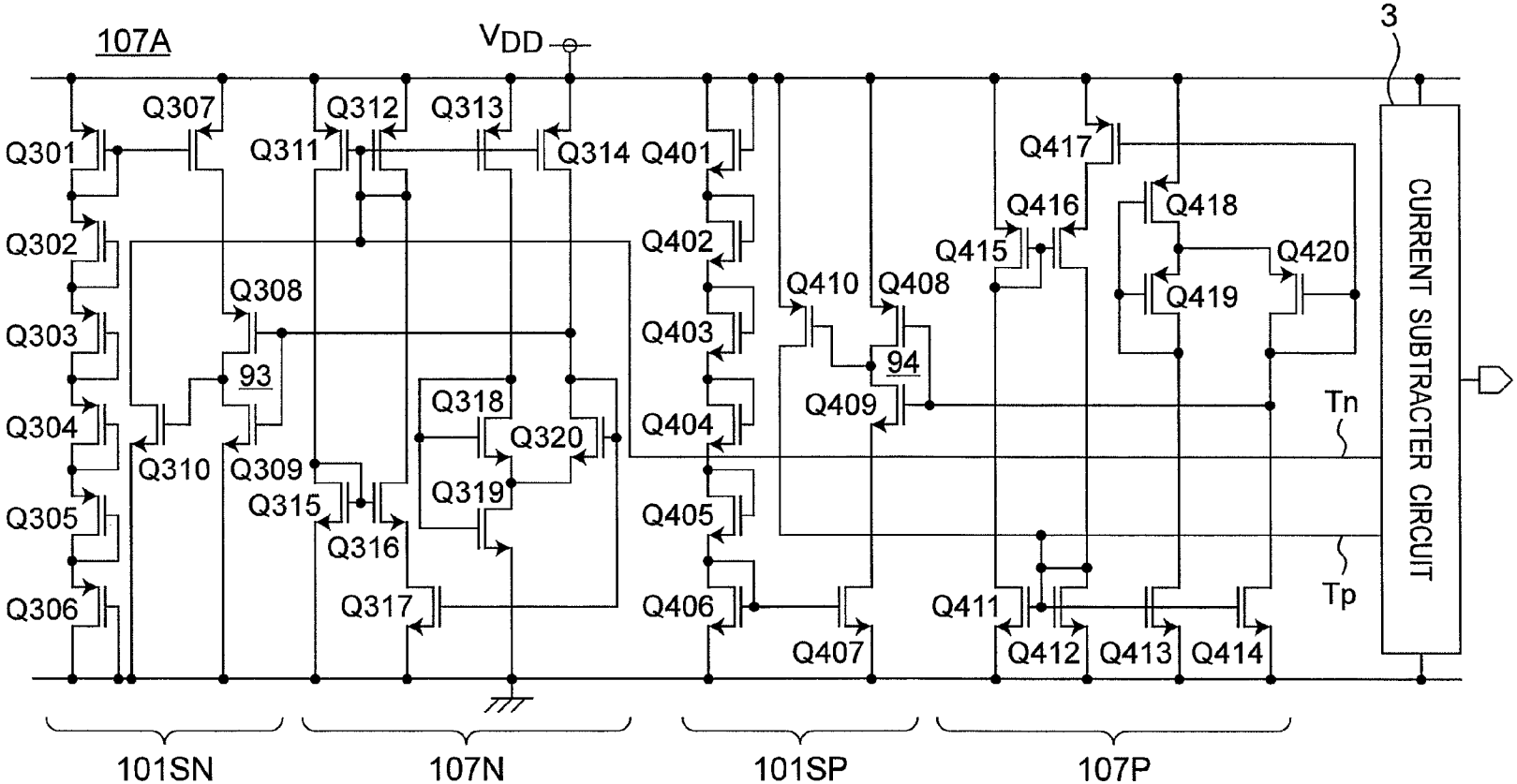
FIG. 47 is a circuit diagram showing a configuration of a reference current source circuit 107A according to a fourth preferred embodiment of the present invention.

FIG. 47 is a circuit diagram showing a configuration of a reference current source circuit 107A according to a fourth preferred embodiment of the present invention. The reference current source circuit 107A according to the fourth preferred embodiment is configured to include an nMOS-configured power source circuit 107N, a pMOS-configured power source circuit 107P, a current subtracter circuit 3, and startup circuits 101SN and 101SP, and characterized as follows.

(1) The reference current source circuit 107A configures the nMOS-configured power source circuit 107N using pMOSFETs Q311 to Q314 and nMOSFETs Q315 to Q320, and the startup circuit 101SN of FIG. 45 is added to the nMOS-configured power source circuit 107N.

(2) The reference current source circuit 107A configures the pMOS-configured power source circuit 107P using nMOSFETs Q411 to Q414 and pMOSFETs Q415 to Q420, and the startup circuit 101SN of FIG. 45 is added to the nMOS-configured power source circuit 107N.

The reference current source circuit 107A configured as mentioned above operates in a manner similar to that of the reference current source circuit 101A of FIG. 45 and exhibits similar functions and effects to those of the reference current source circuit 101A of FIG. 45.

Figure 48:
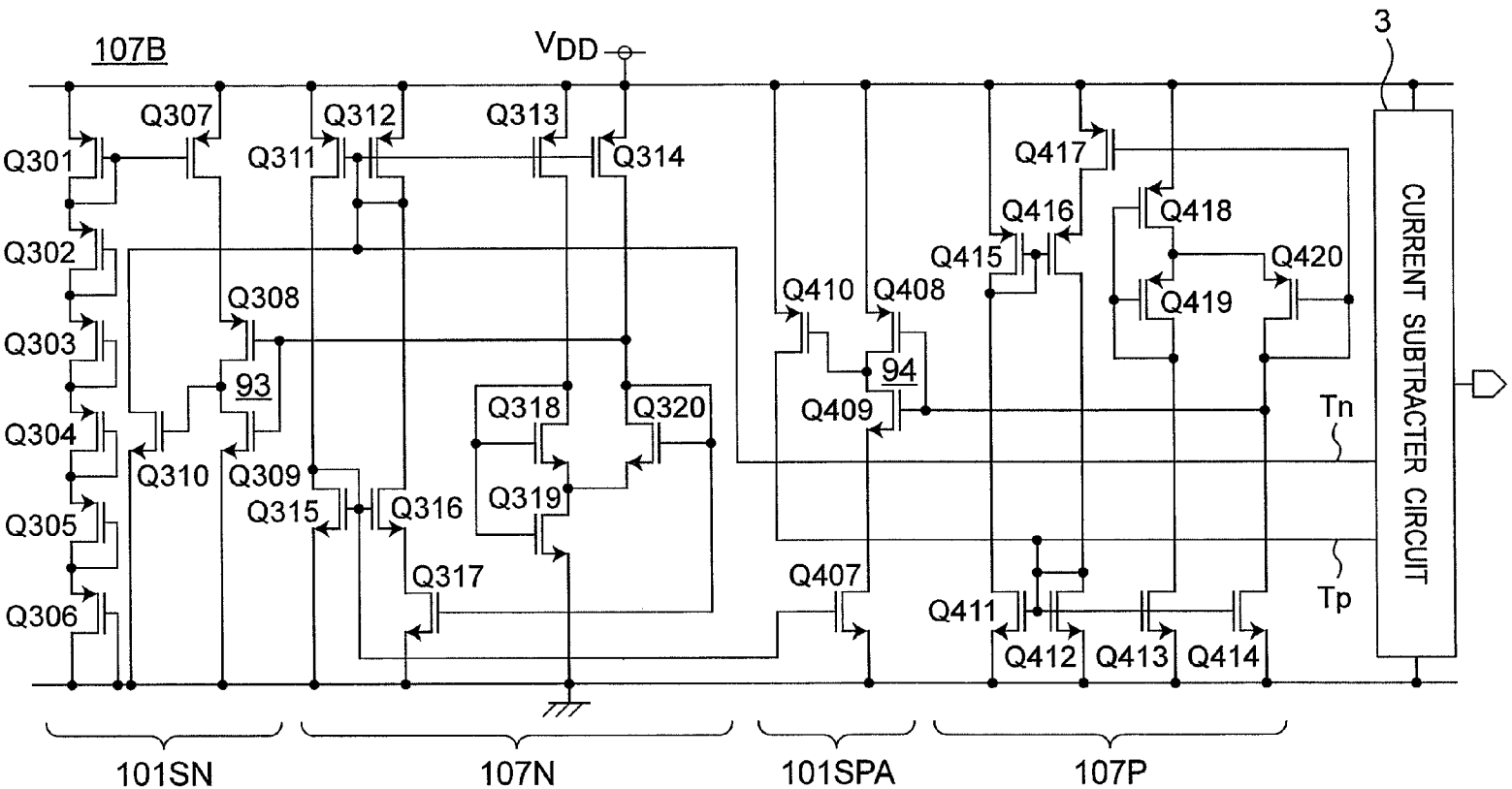
FIG. 48 is a circuit diagram showing a configuration of a reference current source circuit 107B according to a modified preferred embodiment of the fourth preferred embodiment of the present invention.

FIG. 48 is a circuit diagram showing a configuration of a reference current source circuit 107B according to a modified preferred embodiment of the fourth preferred embodiment of the present invention. The reference current source circuit 107B according to the modified preferred embodiment of the fourth preferred embodiment is configured to include an nMOS-configured power source circuit 107N, a pMOS-configured power source circuit 107P, a current subtracter circuit 3, and startup circuits 101SN and 101SPA, and characterized, as compared with the fourth preferred embodiment of FIG. 47, by including the startup circuit SPA in place of the startup circuit 101SP.

The reference current source circuit 107B configured as mentioned above operates in a manner similar to that of the reference current source circuit 101B of FIG. 46 and exhibits similar functions and effects to those of the reference current source circuit 101B of FIG. 46.

Figure 49:
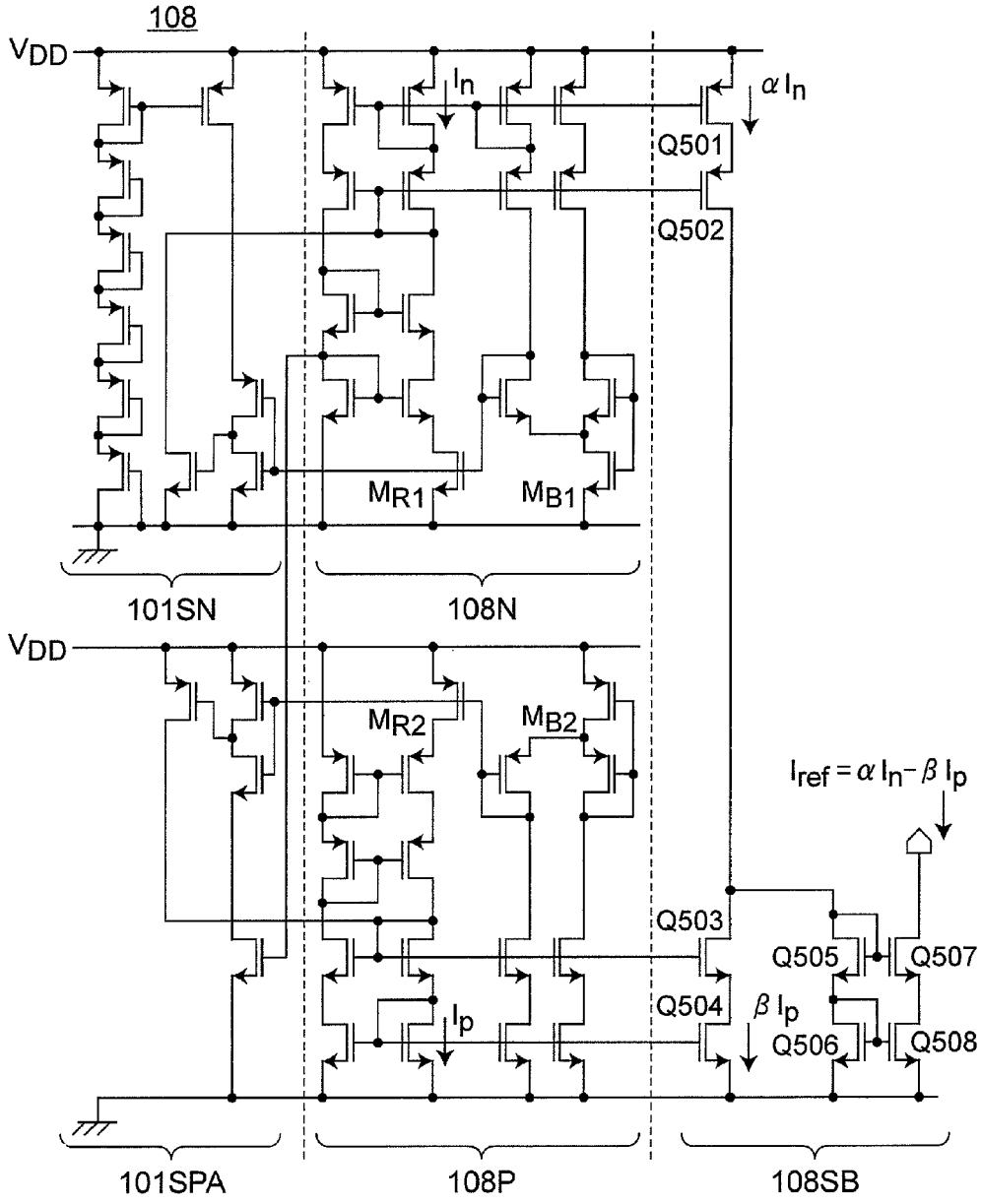
FIG. 49 is a circuit diagram showing a configuration of a reference current source circuit 108 according to a prototype of the present invention.

FIG. 49 is a circuit diagram showing a configuration of a reference current source circuit 108 according to a prototype of the present invention. The reference current source circuit 108 according to the prototype is configured to include an nMOS-configured power source circuit 108N, a pMOS-configured power source circuit 108P, a current subtracter circuit 108SB, and startup circuits 101SN and 101SPA. The current subtracter circuit 108SB is configured to include pMOSFETs Q501 and Q502 and nMOSFETs Q503 to Q508. In the reference current source circuit 108 configured as mentioned above, the current subtracter circuit 108SB generates and outputs a reference output current $I_{ref}$ obtained by subtracting the output current $I_P$ generated by the pMOS-configured power source circuit 108P from a current $\alpha$In corresponding to the output current $I_n$ generated by the nMOS-configured power source circuit 108N. That is, the reference current source circuit 108 operates in a manner similar to that of the reference current source circuit 101B of FIG. 46 and the reference current source circuit 107B of FIG. 48, and exhibits similar functions and effects to those of the reference current source circuits 101B and 107B.

Figure 50B:
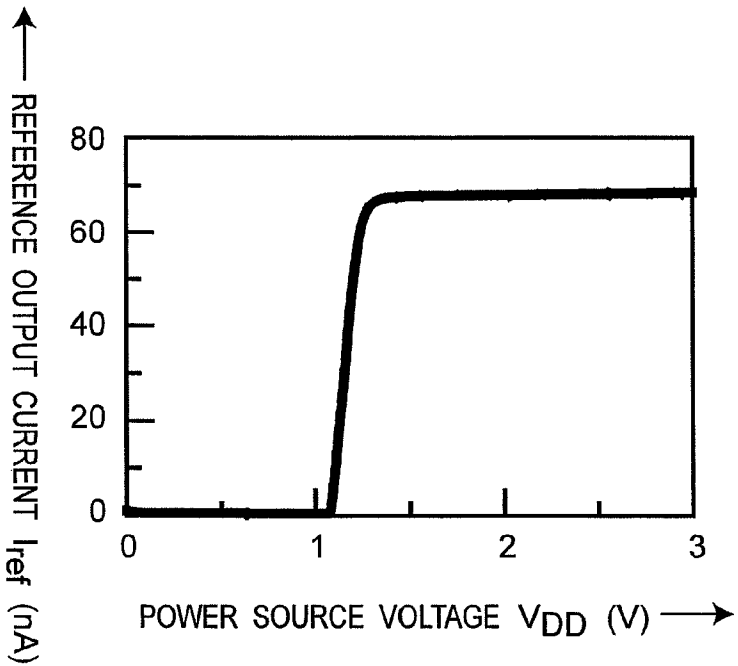
FIG. 50B is a graph showing a measurement result of the reference current source circuit 108 according to the prototype of FIG. 49 and showing power source voltage dependence of the reference output current $I_{ref}$.
Figure 50A:
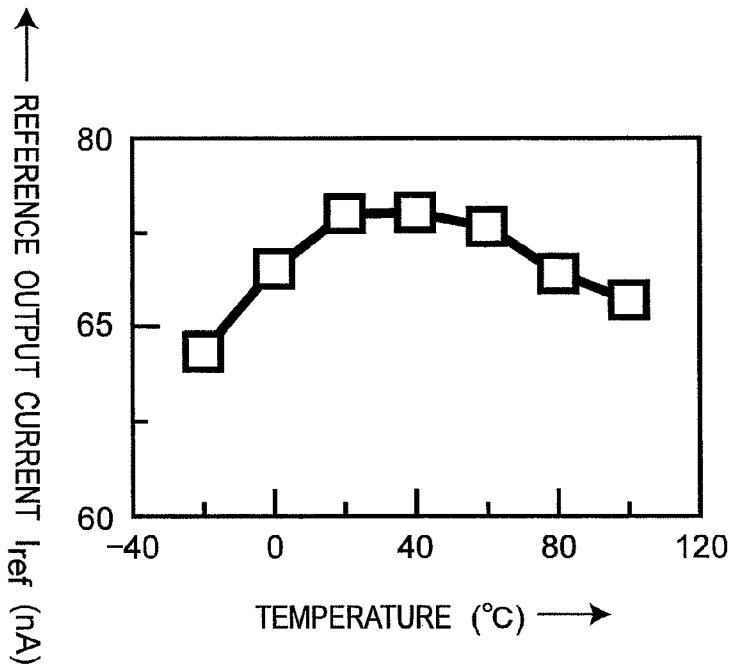
FIG. 50A is a graph showing a measurement result of the reference current source circuit 108 according to the prototype of FIG. 49 and showing temperature dependence of the reference output current $I_{ref}$.

FIG. 50A is a graph showing a measurement result of the reference current source circuit 108 according to the prototype of FIG. 49 and showing temperature dependence of the reference output current $I_{ref}$. As apparent from FIG. 50A, a temperature change is suppressed within 0.4%/° C. in a range from −20° C. to 100° C.

FIG. 50B is a graph showing a measurement result of the reference current source circuit 108 according to the prototype of FIG. 49 and showing power source voltage dependence of the reference output current $I_{ref}$. The reference current source circuit 108 operates normally at a power source voltage equal to or higher than 1.5 V, and the dependence of the reference output current $I_{ref}$ is 0.5 nA/V.

Figure 51A:
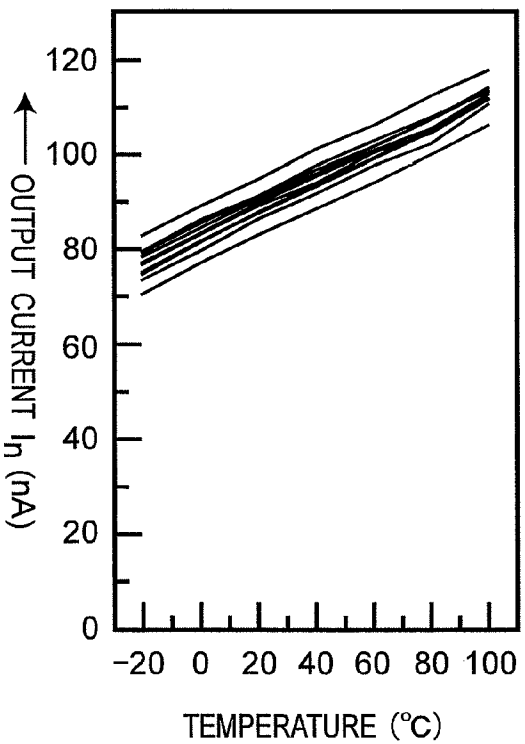
FIG. 51A is a graph showing a measurement result of the reference current source circuit 108 according to the prototype of FIG. 49 and showing temperature dependence of the output current $I_n$.
Figure 51B:
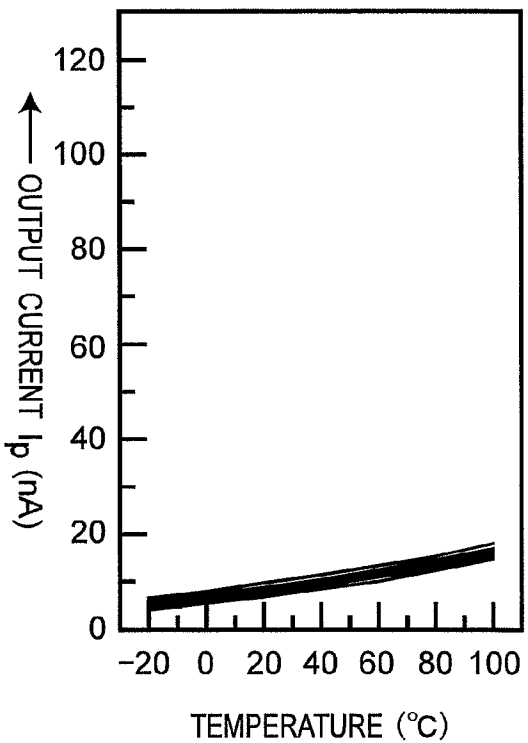
FIG. 51B is a graph showing a measurement result of the reference current source circuit 108 according to the prototype of FIG. 49 and showing temperature dependence of the output current $I_p$.
Figure 51C:
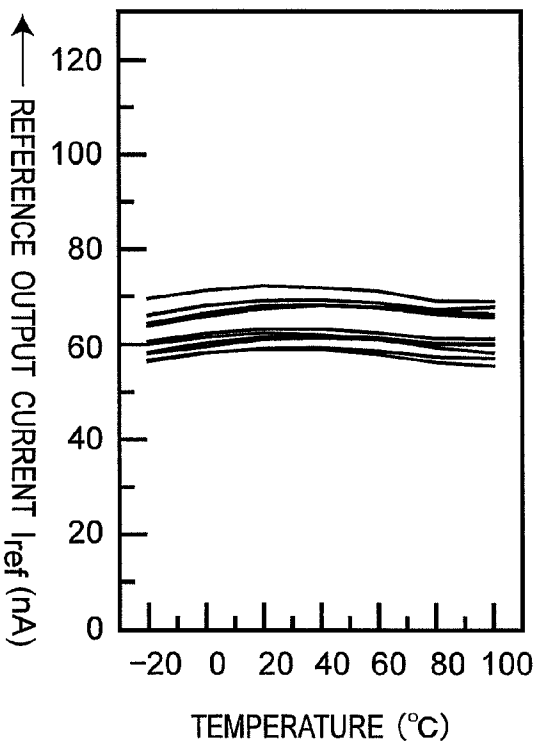
FIG. 51C is a graph showing a measurement result of the reference current source circuit 108 according to the prototype of FIG. 49 and showing temperature dependence of the reference output current $I_{ref}$.

FIGS. 51A, 51B, and 51C are graphs showing measurement results of the reference current source circuit 108 according to the prototype of FIG. 49 and showing temperature dependences of ten measurement samples. FIG. 51A is the graph showing the temperature dependence of the output current $I_n$, FIG. 51B is the graph showing the temperature dependence of the output current $I_p$, and FIG. 51C is the graph showing the temperature dependence of the reference output current $I_{ref}$. As apparent from FIGS. 51A, 51B, and 51C, all the currents $I_n$, $I_p$, and $I_{ref}$ change with the same gradient, and the circuit 108 operates normally as designed. In this case, an average value of the reference output current $I_{ref}$ is 63 nA and a standard deviation is 4.3 nA. In addition, a change coefficient is 6.8%.

Modified Preferred Embodiments

In the preferred embodiments and implemental examples mentioned so far, the current subtracter circuits 13 and 23 generate the currents based on the voltages from the respective power source circuits (such as the MOSFETs Q71 to Q74 of FIGS. 21 and 22). However, the present invention is not limited to this and each power source circuit may include the function of the current subtracter circuit.

In the preferred embodiments and implemental examples (excluding a part of the implemental examples) mentioned so far, the two voltages are generated by the respective power source circuits and the two voltages are applied to each of the current subtracter circuits 13 and 23. However, the present invention is not limited to this. A plurality of, that is, three or more voltages may be generated and the three or more voltages may be applied to each of the current subtracter circuits 13 and 23 so that the current subtracter circuits 13 and 23 can generate the currents $I_n$ and $I_p$, respectively. By generating the currents $I_n$ and $I_p$ based on the plurality of voltages, the accuracy for obtaining the stable current with respect to the process variations can be remarkably improved.

The gate bias voltage generator circuits GB11, GB12, GB21, and GB22 according to the preferred embodiments and implemental examples (excluding a part of the implemental examples) mentioned so far are configured by each using a plurality of differential pairs or a plurality of differential pair circuits. It is thereby possible to accurately control the gradient of the gate bias voltage change with respect to the temperature as compared with the instance of configuring a gate bias voltage generator circuit using one differential pair or one differential pair circuit. The accuracy for obtaining the stable current with respect to the process variations can be remarkably improved.

What is claimed is:

1. A reference current source circuit, comprising:

a first power source circuit including at least one current generating nMOSFET, and generating a first current having a temperature characteristic of an output current dependent on an electron mobility;

a second power source circuit including at least one current generating pMOSFET, and generating a second current having a temperature characteristic of an output current dependent on a hole mobility; and a current subtracter circuit generating a constant reference current by subtracting the second current from the first current, wherein the reference current source circuit is configured to include only nMOSFETs and pMOSFETs, the first power source circuit generates a plurality of first currents, the second power source circuit generates a plurality of second currents, and the subtractor circuit generates the constant reference current based on the plurality of first currents and the plurality of second currents.

2. The reference current source circuit of claim 1, wherein the first power source circuit further includes:

a first gate bias voltage generator circuit for generating a gate bias voltage so that the at least one current generating nMOSFET operates in a strong inversion region; and a first drain bias generator circuit for generating a drain bias for the at least one current generating nMOSFET, and wherein the second power source circuit further includes:

a second gate bias voltage generator circuit for generating a gate bias voltage so that the at least one current generating pMOSFET operates in a strong inversion region; and a second drain bias voltage generator circuit for generating a drain bias for the at least one current generating pMOSFET.

3. The reference current source circuit of claim 2, wherein the first gate bias generator circuit includes one of a plurality of differential pairs and a plurality of differential pair circuits.

4. The reference current source circuit of claim 2, wherein the first power source circuit further includes a first current mirror circuit for supplying a power source current to the at least one current generating nMOSFET, the first drain bias generator circuit, and the first gate bias voltage generator circuit, and wherein the second power source circuit further includes a second current mirror circuit for supplying a power source current to the at least one current generating pMOSFET, the second drain bias generator circuit, and the second gate bias voltage generator circuit.

5. The reference current source circuit of claim 4, wherein the first current mirror circuit includes a first operational amplifier for suppressing a change of a power source current accompanying a change of a power source voltage, and wherein the second current mirror circuit includes a second operational amplifier for suppressing a change of a power source current accompanying the change in the power source voltage.

6. The reference current source circuit of claim 1, wherein each of the first power source circuit and the second power source circuit further includes a startup circuit, and wherein the startup circuit includes:

a detection circuit for detecting that the first power source circuit and the second power source circuit do not operate; and a starting transistor for starting the first power source circuit and the second power source circuit by flowing a predetermined current into the first power source circuit and the second power source circuit when the detection circuit detects that the first power source circuit and the second power source circuit do not operate.

7. The reference current source circuit of claim 6, wherein the startup circuit of each of the first power source circuit and the second power source circuit further includes a current supply circuit for supplying a bias operating current to the detection circuit, and wherein the current supply circuit includes:

a minute current generator circuit for generating a predetermined minute current from the power source voltage; and a third current mirror circuit for generating a minute current corresponding to the generated minute current as the bias operating current.

8. The reference current source circuit of claim 6, wherein the startup circuit of the first power source circuit further includes a first current supply circuit for supplying a bias operating current to the detection circuit, wherein the first current supply circuit includes:

a minute current generator circuit for generating a predetermined minute current from a power source voltage; and a third current mirror circuit for generating a minute current corresponding to the generated minute current as the bias operating current, wherein the startup circuit of the second power source circuit further includes a second current supply circuit for supplying a bias operating current to the detection circuit, and wherein the second current supply circuit includes a fourth current mirror circuit for generating a current corresponding to an operating current after starting the second power source circuit as the bias operating current.

* * * * *